US012571583B2

(12) United States Patent
Tambasco et al.

(10) Patent No.: US 12,571,583 B2
(45) Date of Patent: Mar. 10, 2026

(54) REFRIGERATED APPLIANCE WITH AUTOMATICALLY ADJUSTABLE SETPOINT

(71) Applicant: Hoshizaki America, Inc., Peachtree City, GA (US)

(72) Inventors: Michael Tambasco, Newnan, GA (US); Gregory Maples, Senoia, GA (US); Cole Whitehurst, Atlanta, GA (US); Kevin Huckaby, Newnan, GA (US); Jeremy Neill, Gay, GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 131 days.

(21) Appl. No.: 17/889,249

(22) Filed: Aug. 16, 2022

(65) Prior Publication Data

US 2024/0060712 A1 Feb. 22, 2024

(51) Int. Cl.
*F25D 17/08* (2006.01)
*F25D 11/02* (2006.01)
(Continued)

(52) U.S. Cl.
CPC ..... *F25D 29/003* (2013.01); *F25D 11/02* (2013.01); *F25D 17/08* (2013.01); *F25D 23/003* (2013.01);
(Continued)

(58) Field of Classification Search
CPC ..... F25D 11/02; F25D 17/08; F25D 23/003; F25D 2317/0672; F25D 2700/02; F25D 2700/121; F25D 29/00; F25D 29/003
See application file for complete search history.

(56) References Cited

U.S. PATENT DOCUMENTS 1,584,244 A 5/1926 Rabickow
2,181,636 A 11/1939 Saunders
(Continued)

FOREIGN PATENT DOCUMENTS

DE 202005006835 8/2005
DE 102016104553 9/2017
(Continued)

OTHER PUBLICATIONS

Tambasco, Michael; Requirement for Restriction/Election for U.S. Appl. No. 17/889,246, filed Aug. 16, 2022, mailed Jul. 19, 2024, 6 pgs.
(Continued)

*Primary Examiner* — Filip Zec
(74) *Attorney, Agent, or Firm* — Taylor Duma LLP

(57) ABSTRACT

A method of using a refrigerated appliance can include regulating a temperature of a first insulated enclosure of a first refrigerated portion of the appliance within a first predetermined temperature range, the appliance including the first refrigerated portion and a second refrigerated portion positioned below the first refrigerated portion; moving a closure device of the first refrigerated portion from an open position to a closed position, the closure device configured to selectively cover and limit leakage of air from an ambient environment to and from a second insulated enclosure of the second refrigerated portion; and adjusting a predetermined temperature range of the first insulated enclosure by a predetermined offset value based on a sensor signaling that the closure device is in the closed position.

29 Claims, 38 Drawing Sheets

(51) Int. Cl.
*F25D 23/00* (2006.01)
*F25D 29/00* (2006.01)

(52) U.S. Cl.
CPC .. *F25D 2317/0672* (2013.01); *F25D 2700/02* (2013.01); *F25D 2700/121* (2013.01)

(56) References Cited

U.S. PATENT DOCUMENTS

| | | | | |
|---|---|---|---|---|
| 2,201,265 | A | 5/1940 | Hill | |
| 2,508,255 | A | 5/1950 | Hardin | |
| 2,741,101 | A | 4/1956 | Trulaske | |
| 2,922,546 | A | 1/1960 | Trulaske | |
| 3,136,983 | A | 6/1964 | Trulaske | |
| D200,029 | S | 1/1965 | Costantini et al. | |
| 3,259,184 | A | 7/1966 | Trulaske | |
| 3,302,351 | A | 2/1967 | Trulaske | |
| 3,328,105 | A | 6/1967 | Trulaske | |
| 3,760,535 | A | 9/1973 | Trulaske | |
| 4,007,604 | A | 2/1977 | Ballarin | |
| 4,127,968 | A | 12/1978 | Trulaske | |
| D265,316 | S | 7/1982 | Trulaske | |
| D271,107 | S | 10/1983 | Trulaske | |
| D273,298 | S | 4/1984 | Trulaske | |
| 4,457,140 | A | 7/1984 | Rastelli | |
| D286,730 | S | 11/1986 | Tzifkansky et al. | |
| 4,685,311 | A | 8/1987 | Rastelli | |
| 4,802,340 | A | 2/1989 | Johnson | |
| 4,875,745 | A | 10/1989 | Trulaske | |
| 4,890,746 | A | 1/1990 | Trulaske | |
| 4,955,486 | A | 9/1990 | Trulaske | |
| 5,076,443 | A | 12/1991 | Trulaske | |
| 5,168,719 | A | 12/1992 | Branz et al. | |
| 5,182,923 | A | 2/1993 | Trulaske | |
| 5,182,924 | A | 2/1993 | Trulaske | |
| 5,191,769 | A | 3/1993 | Mangini et al. | |
| 5,282,367 | A | 2/1994 | Moore et al. | |
| 5,355,686 | A | 10/1994 | Weiss | |
| 5,363,672 | A | 11/1994 | Moore et al. | |
| 5,433,082 | A | 7/1995 | Trulaske | |
| D368,483 | S | 4/1996 | Bone | |
| D368,484 | S | 4/1996 | Bone | |
| 5,553,354 | A | 9/1996 | Trulaske | |
| 5,584,547 | A | 12/1996 | Trulaske | |
| 5,699,676 | A | 12/1997 | Trulaske | |
| 5,704,093 | A | 1/1998 | Trulaske | |
| 5,803,560 | A | 9/1998 | Trulaske | |
| D400,546 | S | 11/1998 | Trulaske | |
| D402,138 | S | 12/1998 | Trulaske | |
| 5,937,666 | A | 8/1999 | Trulaske | |
| D416,713 | S | 11/1999 | Trulaske | |
| D420,367 | S | 2/2000 | Trulaske | |
| D421,534 | S | 3/2000 | Trulaske | |
| 6,089,036 | A | 7/2000 | Carlson | |
| 6,109,051 | A | 8/2000 | Majordy | |
| 6,151,905 | A | 11/2000 | Smith | |
| D438,724 | S | 3/2001 | Trulaske | |
| D439,914 | S | 4/2001 | Trulaske | |
| D441,990 | S | 5/2001 | Trulaske | |
| D443,625 | S | 6/2001 | Vazquez | |
| D444,966 | S | 7/2001 | Trulaske et al. | |
| D448,589 | S | 10/2001 | Trulaske | |
| D452,395 | S | 12/2001 | Trulaske | |
| 6,385,990 | B1 | 5/2002 | Lee | |
| D461,335 | S | 8/2002 | Trulaske et al. | |
| 6,453,694 | B1 | 9/2002 | Trulaske | |
| D467,450 | S | 12/2002 | Trulaske | |
| 6,523,719 | B2 | 2/2003 | Trulaske | |
| 6,557,363 | B1 | 5/2003 | Haasis et al. | |
| 6,564,569 | B1 | 5/2003 | Havens | |
| 6,612,124 | B1 | 9/2003 | Hatch et al. | |
| 6,792,769 | B2 | 9/2004 | Trulaske | |
| 6,941,765 | B2 | 9/2005 | Sung | |
| 6,978,630 | B2 | 12/2005 | Wensink et al. | |
| 7,024,878 | B2 | 4/2006 | Trulaske | |
| D537,456 | S | 2/2007 | Davis | |
| 7,181,921 | B2 * | 2/2007 | Nuiding | F25D 11/022 62/526 |
| D541,315 | S | 4/2007 | Trulaske | |
| 7,219,508 | B2 | 5/2007 | Durbin | |
| 7,243,506 | B2 | 7/2007 | Spillner | |
| 7,269,964 | B2 | 9/2007 | Hand | |
| D552,877 | S | 10/2007 | Trulaske | |
| 7,401,473 | B2 | 7/2008 | Lesage et al. | |
| 7,663,497 | B2 * | 2/2010 | Chishima | G01F 23/2845 340/613 |
| 7,686,405 | B2 | 3/2010 | Trulaske | |
| 7,707,846 | B2 | 5/2010 | Trulaske | |
| 7,748,228 | B2 | 7/2010 | Walker et al. | |
| 7,942,012 | B2 | 5/2011 | Ritchie et al. | |
| 8,477,029 | B2 * | 7/2013 | Ashrafzadeh | G06Q 10/087 340/625 |
| 8,638,224 | B2 * | 1/2014 | Park | F25D 29/00 340/613 |
| D721,745 | S | 1/2015 | Davis et al. | |
| 9,453,661 | B2 | 9/2016 | Junge et al. | |
| 9,538,858 | B2 | 1/2017 | Rajagopalan | |
| 9,568,202 | B2 | 2/2017 | Majordy et al. | |
| 9,581,378 | B2 | 2/2017 | Czerwonky | |
| 9,915,469 | B2 | 3/2018 | Huckaby et al. | |
| 10,288,338 | B2 * | 5/2019 | Bae | F25D 11/006 |
| 10,378,816 | B2 | 8/2019 | Delgadillo | |
| 10,794,629 | B2 * | 10/2020 | Wilson | F25D 29/008 |
| 11,796,242 | B2 * | 10/2023 | Anderson | F25D 21/04 |
| 11,828,518 | B2 * | 11/2023 | Gary | F25D 17/065 |
| 2002/0083727 | A1 | 7/2002 | Koike et al. | |
| 2007/0271937 | A1 * | 11/2007 | Kang | F25B 41/20 62/205 |
| 2012/0309285 | A1 | 12/2012 | Majordy et al. | |
| 2012/0313330 | A1 | 12/2012 | Scalf et al. | |
| 2013/0160473 | A1 * | 6/2013 | Hu | F25D 17/065 62/186 |
| 2013/0205809 | A1 * | 8/2013 | Beni | F25D 23/069 62/62 |
| 2015/0007602 | A1 | 1/2015 | Czerwonky | |
| 2017/0138660 | A1 | 5/2017 | Huckaby | |
| 2017/0188720 | A1 | 7/2017 | Palmnas | |
| 2020/0386467 | A1 * | 12/2020 | Candeo | F25D 17/045 |
| 2021/0003328 | A1 * | 1/2021 | Iovanel | F25D 49/02 |
| 2021/0055032 | A1 * | 2/2021 | Vijayan | F25D 17/08 |
| 2024/0060701 | A1 | 2/2024 | Tambasco et al. | |

FOREIGN PATENT DOCUMENTS

| | | |
|---|---|---|
| EP | 2832267 | 2/2015 |
| KR | 202012005666 | 8/2012 |
| KR | 20160099939 | 8/2016 |
| WO | 2009061312 | 5/2009 |

OTHER PUBLICATIONS

Tambasco, Michael; Office Action for Canadian patent application No. 3,170,447, filed Aug. 16, 2022, mailed May 9, 2024, 10 pgs.
Tambasco, Michael; Non-Final Office Action for U.S. Appl. No. 17/889,246, filed Aug. 16, 2022, mailed Sep. 25, 2024, 37 pgs.
Tambasco, Michael; Office Action for Canadian patent application No. 3,170,454, filed Aug. 16, 2022, mailed Apr. 2, 2024, 10 pgs.
Huckaby, Kevin; Applicant Initiated Interview Summary for U.S. Appl. No. 15/404,815, filed Jan. 12, 2017, mailed Aug. 14, 2017, 4 pgs.
Huckaby, Kevin; Issue Notification for U.S. Appl. No. 15/404,815, filed Jan. 12, 2017, mailed Feb. 21, 2018, 1 pg.
Huckaby, Kevin; Notice of Allowance for U.S. Appl. No. 15/404,815, filed Jan. 12, 2017, mailed Oct. 25, 2017, 5 pgs.
Huckaby, Kevin; PTO Response to Amendment under Rule 312 for U.S. Appl. No. 15/404,815, filed Jan. 12, 2017, mailed Feb. 8, 2018, 2 pgs.
Continental Refrigerator; Specification Sheet for 27" & 32" Sandwich Unit Refrigerators, publicly available prior to Jan. 12, 2017, 2 pgs.
Czerwonky, Bradford; Issue Notification for U.S. Appl. No. 14/027,191, filed Sep. 14, 2013, mailed Feb. 8, 2017, 1 pg.

(56) References Cited

OTHER PUBLICATIONS

Czerwonky, Bradford; Non-Final Office Action for U.S. Appl. No. 14/027,191, filed Sep. 14, 2013, mailed Jan. 14, 2016, 14 pgs.
Czerwonky, Bradford; Notice of Allowance for U.S. Appl. No. 14/027,191, filed Sep. 14, 2013, mailed Oct. 17, 2016, 14 pgs.
Czerwonky, Bradford; Notice of Allowance for U.S. Appl. No. 14/027,191, filed Sep. 14, 2013, mailed Jun. 16, 2016, 9 pgs.
Huckaby, Kevin; Non-final Office Action for U.S. Appl. No. 15/404,815, filed Jan. 12, 2017, mailed Jun. 19, 2017, 29 pgs.
Randell; Specification Sheet for a "Preparation Table—Raised Condiment Rail", publicly available prior to Jan. 12, 2017, 14 pgs.
Tambasco, Michael; Applicant-Initiated Interview Summary for U.S. Appl. No. 17/889,246, filed Aug. 16, 2022, mailed May 16, 2025, 3 pgs.
Tambasco, Michael; Notice of Allowance for U.S. Appl. No. 17/889,246, filed Aug. 16, 2022, mailed Aug. 15, 2025, 14 pgs.
Tambasco, Michael; Office Action for Canadian Patent Application No. 3,170,454, filed Aug. 16, 2022, mailed Jul. 21, 2025, 3 pgs.

* cited by examiner

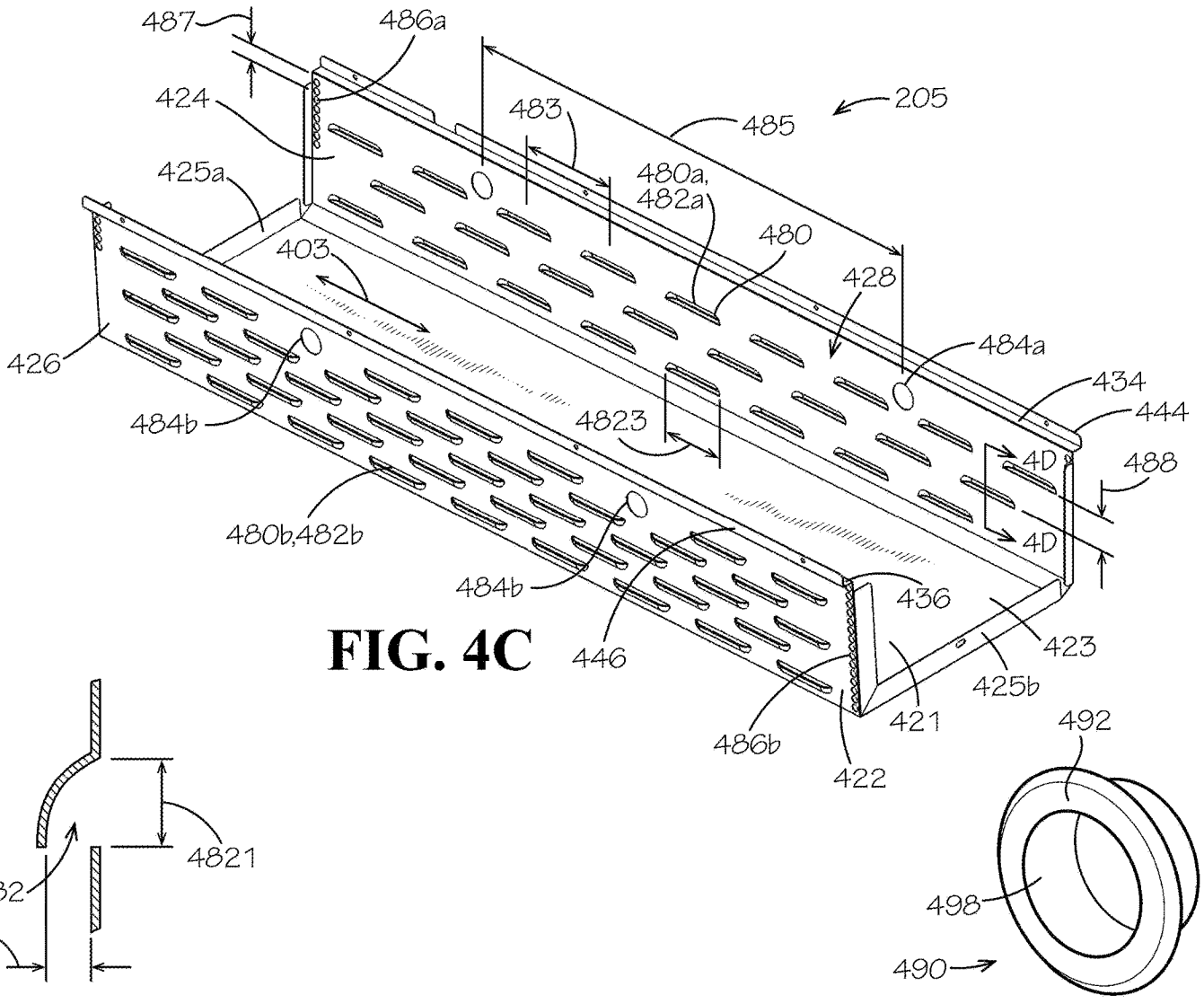
FIG. 4C
FIG. 4E
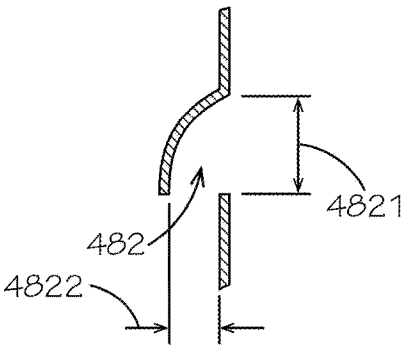
FIG. 4D

1600

1655

| | Rail Temperature Setting | | | |
|---|---|---|---|---|
| | Normal or "Day" Mode | | Offset or "Night" Mode | |
| Dial Setting | °F | °C | °F | °C |
| 0 | Power OFF | | Power OFF | |
| 1 | 36 | 2.2 | 44 | 6.6 |
| 2 | 33.75 | 0.95 | 41.75 | 5.35 |
| 3 | 31.5 | -0.3 | 39.5 | 4.1 |
| 4 | 29.25 | -1.55 | 37.25 | 2.85 |
| 5 Default | 27 | -2.8 | 35 | 1.6 |
| 6 | 24.75 | -4.05 | 32.75 | 0.35 |
| 7 | 22.5 | -5.3 | 30.5 | -0.9 |
| 8 | 20.25 | -6.55 | 28.25 | -2.15 |
| 9 | 18 | -7.8 | 26 | -3.4 |

REFRIGERATED APPLIANCE WITH AUTOMATICALLY ADJUSTABLE SETPOINT

REFERENCE TO RELATED APPLICATIONS

This application specifically incorporates by reference herein in its entirety U.S. application Ser. No. 17/889,246, entitled REFRIGERATED APPLIANCE WITH DUCTED AIR FLOW and filed by Applicant on Aug. 16, 2022.

TECHNICAL FIELD

Field of Use

This disclosure relates to refrigerated appliances. More specifically, this disclosure relates to refrigerated appliances with a refrigerated rail, the temperatures within which can be automatically adjusted based on input from rail lid position sensor or other sensor.

Related Art

Refrigerated appliances comprising an open, refrigerated rail are common and useful in a kitchen. Able to store at refrigerated temperatures a large variety of food ingredients used in food preparation such as the making of pizzas and sandwiches, such appliances can significantly improve user convenience and efficiency. Maintaining food product at proper temperatures in an open rail of a refrigerated appliance can be challenging, especially during industry-standard test conditions that require maintenance of both rail temperatures and cabinet temperatures within proper ranges. Because of the harsh environment found in a commercial kitchen in which many appliances are used, these temperatures must usually be maintained with the appliance in an ambient temperature that is usually higher than typical room temperature, but some actual use conditions can extend much higher or much lower. Current cooling methods are not practical or cost-effective for some users. Moreover, to avoid spoilage of food due to high or low temperature it is common for users to remove food product from the rail and store the food product elsewhere whenever the appliance and/or the rail will be unattended for more than a short period (e.g., overnight).

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a refrigerated appliance comprising: a refrigeration system; and a cabinet enclosing the refrigeration system at least partly and comprising: a first refrigerated portion defining a first insulated enclosure defining a pan storage cavity configured to receive at least one food pan, the first refrigerated portion comprising a closure device configured to selectively cover and limit leakage of air from the ambient environment to and from the first insulated enclosure; a second refrigerated portion positioned below the first refrigerated portion and defining a base cavity configured to receive stored product; a first sensor configured to measure a temperature of air within the first insulated enclosure; a second sensor configured to signal whether the closure device of the first refrigerated portion is in an open position or a closed position; and at least one controller configured to control, at least in part, the temperature of the air within the first insulated enclosure and measured by the first sensor within a first predetermined temperature range, the at least one controller configured to adjust the first predetermined temperature range by a predetermined offset value based on an input from the second sensor.

In a further aspect, disclosed is a method of using a refrigerated appliance, the method comprising: regulating a temperature of a first insulated enclosure of a first refrigerated portion of the appliance within a first predetermined temperature range, the appliance comprising the first refrigerated portion and a second refrigerated portion positioned below the first refrigerated portion; moving a closure device of the first refrigerated portion from an open position to a closed position, the closure device configured to selectively cover and limit leakage of air from an ambient environment to and from a second insulated enclosure of the second refrigerated portion; and adjusting a predetermined temperature range of the first insulated enclosure by a predetermined offset value based on a sensor signaling that the closure device is in the closed position.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

FIG. 4C is a front top perspective view of a rail duct of the appliance of FIG. 1A.

FIG. 4D is a perspective view of a handle of the rail duct of FIG. 4B.

FIG. 4E is a sectional view of an air transmission opening of the rail duct of FIG. 4C taken along line 4D-4D of FIG. 4C.

FIG. 100 is a sectional view of the appliance of FIG. 1B taken along line 10C-10C of FIG. 2B.

DETAILED DESCRIPTION

Figure 1B:
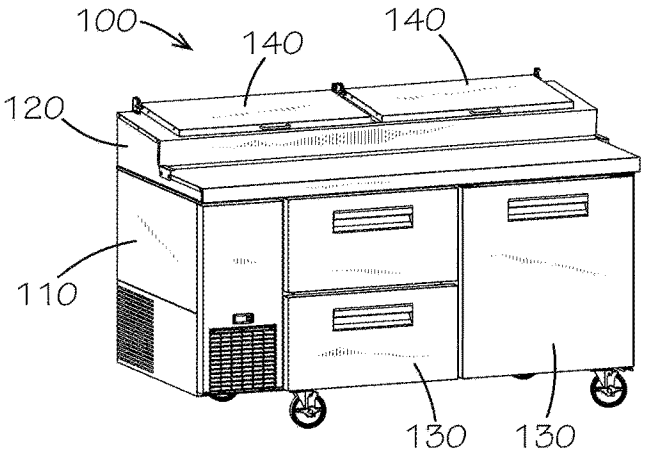
FIG. 1B is a perspective view of a two-section refrigerated preparation table appliance with a raised rail in accordance with another aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

As used herein, unless the context clearly dictates otherwise, the term "monolithic" in the description of a component means that the component is formed as a singular component that constitutes a single material without joints or seams except those resulting by re-shaping of the material.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of the appliance nearest to and occupied by a user of the appliance; "rear" is that end of the appliance that is opposite or distal the front; "left" is that which is to the left of or facing left from a person standing in front of the appliance and facing towards the front; and "right" is that which is to the right of or facing right from that same person. "Horizontal" or "horizontal orientation" describes that which is in a plane extending from left to right and aligned with the horizon. "Vertical" or "vertical orientation" describes that which is in a plane that is angled at 90 degrees to the horizontal.

In one aspect, a refrigerated appliance and associated methods, systems, devices, and various apparatuses are disclosed herein. In one aspect, the appliance can comprise a first refrigerated portion comprising a first refrigerated compartment and a second refrigerated portion comprising a second refrigerated compartment. The appliance can further comprise a sensor, which can automatically adjust a temperature of the air within the first refrigerated compartment upon its activation. Such automatic adjustment can constitute multi-mode operation of the appliance 100.

Maintaining food product at proper temperatures in an open rail of a refrigerated appliance can be challenging, especially during industry-standard (e.g., NSF/ANSI Standard 7) test conditions that require maintenance of both rail temperatures (i.e., temperatures of special simulated food material stored in pans positioned in the rail) and cabinet temperatures within proper ranges, e.g., 0.6° C. to 5.0° C. for the rail box car average temperatures using the special simulated food material and 0° C. to 4.4° C. for the lagged cabinet temperatures. Because of the harsh environment found in a commercial kitchen in which many appliances are used, these temperatures must usually be maintained with the appliance in an ambient environment defining an ambient temperature that is usually higher than typical room temperature. For example, NSF/ANSI Standard 7 test conditions typically require an ambient temperature during testing of 86° F., but some actual use conditions can reach up to around 100° F. on the warm end or down to around 45° F. on the cold end. Cooling with expensively manufactured cabinets in which refrigerant or a eutectic fluid (e.g., a liquid having similar properties to anti-freeze liquid used in motor vehicle) circulates through the walls is not a practical or cost-effective option for some users.

In addition, a typical appliance comprising a raised rail typically also comprises a rail cover for hygienic and other reasons. Because closing the cover can significantly lower the temperature of the rail and users are either not able to or accustomed to manually make the adjustments necessary to avoid freezing of product, which can result in spoilage, users often remove food product from the rail and store elsewhere whenever the appliance and/or the rail will be unattended for more than a short period (e.g., overnight). One or more of the challenges associated with these and other issues can be solved by the structures and methods disclosed herein.

Figure 1A:
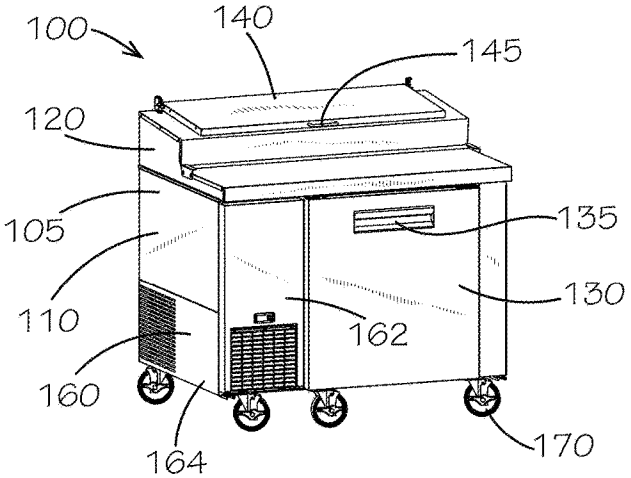
FIG. 1A is a perspective view of a one-section refrigerated preparation table appliance with a raised rail in accordance with one aspect of the current disclosure.

FIG. 1A is a perspective view of an appliance 100 in accordance with one aspect of the current disclosure. The appliance 100 can comprise a cabinet body or base 110 and a rail body or rail 120. The base 110 and the rail 120 can together form a cabinet 105 of the appliance 100. The rail 120 can extend or protrude vertical from and above the base 110. In some aspects, the rail 120 can extend the full length of the base 110. In some aspects, the rail 120 can extend only partially across the base 110. The appliance 100 and, more specifically, the base 110 thereof can comprise one or more closure devices 130. In some aspects, as shown, the closure device 130 can be or can comprise a door, which can be hinged on one side or another of the closure device 130. More specifically, a handle 135 attached to or defined in the closure device 130 can facilitate opening of the closure device 130. Similarly, the appliance 100 and, more specifically, the rail 120 thereof can comprise one or more closure devices 140. In some aspects, as shown, the closure device 140 can be or can comprise a cover or lid, which can be hinged on one side or another of the closure device 130. More specifically, a handle 145 attached to or defined in the closure device 140 can facilitate opening of the closure device 140. The closure device 140 and the closure device 130 can be oriented in different planes.

Figure 4A:
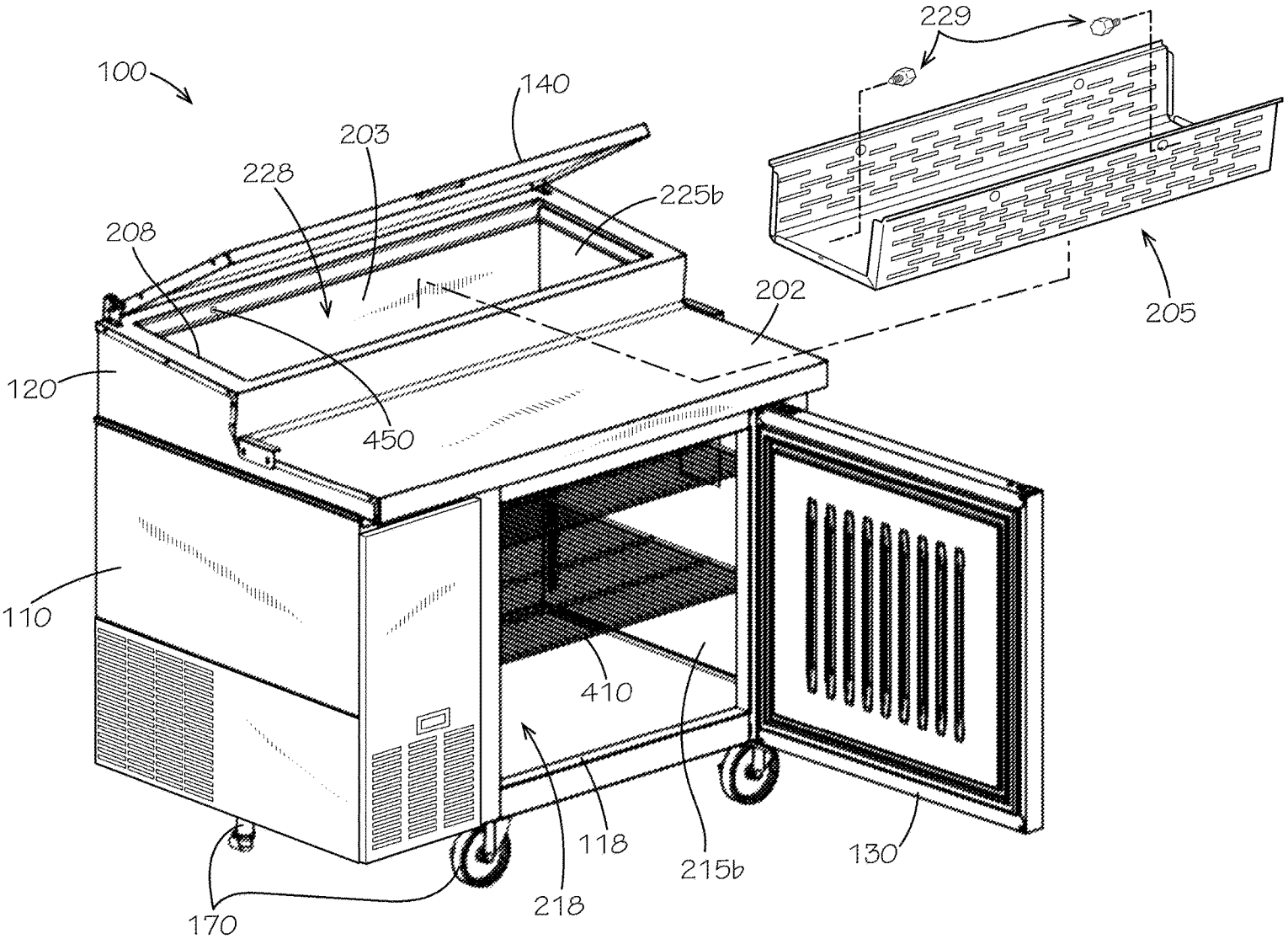
FIG. 4A is a partially exploded front perspective view of the appliance of FIG. 1A showing a rail duct of the appliance removed from the raised rail of the appliance.

The appliance 100 can comprise a refrigeration circuit or refrigeration system 150 (shown in FIG. 4B), which can be housed within a portion of the base 110 and, more specifically, a cavity defined therein. Access panels 160 such as, for example and without limitation, one or more of a front access panel 162, a side access panel 164, and a rear access panel 166 (shown in FIG. 4B) can selectively provide or block access to the refrigeration system 150 and/or other components of the appliance 100 to which a user need not have immediate access. In some aspects, as shown, the base 110 can be supported by a plurality of supports 170, which can be wheels or casters by which the appliance 100 can be rolled from one location to another. In some aspects, as shown in FIG. 4A, the supports 170 can comprise one or more legs. More generally, the appliance 100 can define one or more "sections" in which each section can define a main opening 118 (shown in FIG. 2C), which the one or more closure devices 130 can be configured to selectively cover. More specifically, each of the closure devices 130,140 can be configured to limit leakage of air from an ambient environment to and from the base 110 or the rail 120 or any portion thereof. In some aspects, an opening 208 (shown in FIG. 2C) of the rail 120 or a portion thereof and the opening 118 of the base 110 or a portion thereof can face in different directions. More specifically, the opening 208 can face generally upward and the opening 118 of the base 110 can face generally forward. In some aspects, as shown, the appliance 100 can be a one-section refrigerated preparation table defining only a single section. As disclosed herein, "refrigerated" means broadly that which is cooled or that which cools or keeps cool, whether the temperature of the cooled space, cooled product, or other disclosed elements are above or below 32° F., the freezing point of water.

FIG. 1B is a perspective view of the appliance 100 in accordance with another aspect of the current disclosure. In some aspects, as shown, the appliance 100 can be a two-section refrigerated preparation table defining two sections, which can be positioned adjacent to each other with a frame, mullion, or divider 112 (shown in FIG. 2A) positioned therebetween. The divider 112 can extend in a vertical direction. The divider 112 or any similar structure can be insulated. More specifically, the divider 112 or any similar structure can encapsulate an insulating material such as blown or block foam. The divider 112 or any similar structure can be heated to reduce or eliminate condensation that might otherwise form on an outer surface thereof.

In some aspects, as shown, the closure device 130 can be or can comprise a drawer or a set of drawers, which be supported inside a drawer frame secured to the base 110. Such a drawer frame or equivalent structure can comprise a frame, mullion, or divider 114 (shown in FIG. 2A), which can be positioned between adjacent drawers. In some aspects, as shown, the closure device 140 can be or can comprise a pair of rail covers or lids. In some aspects, the closure device 140 can be or can comprise more than two rail covers or lids.

Figure 10A:
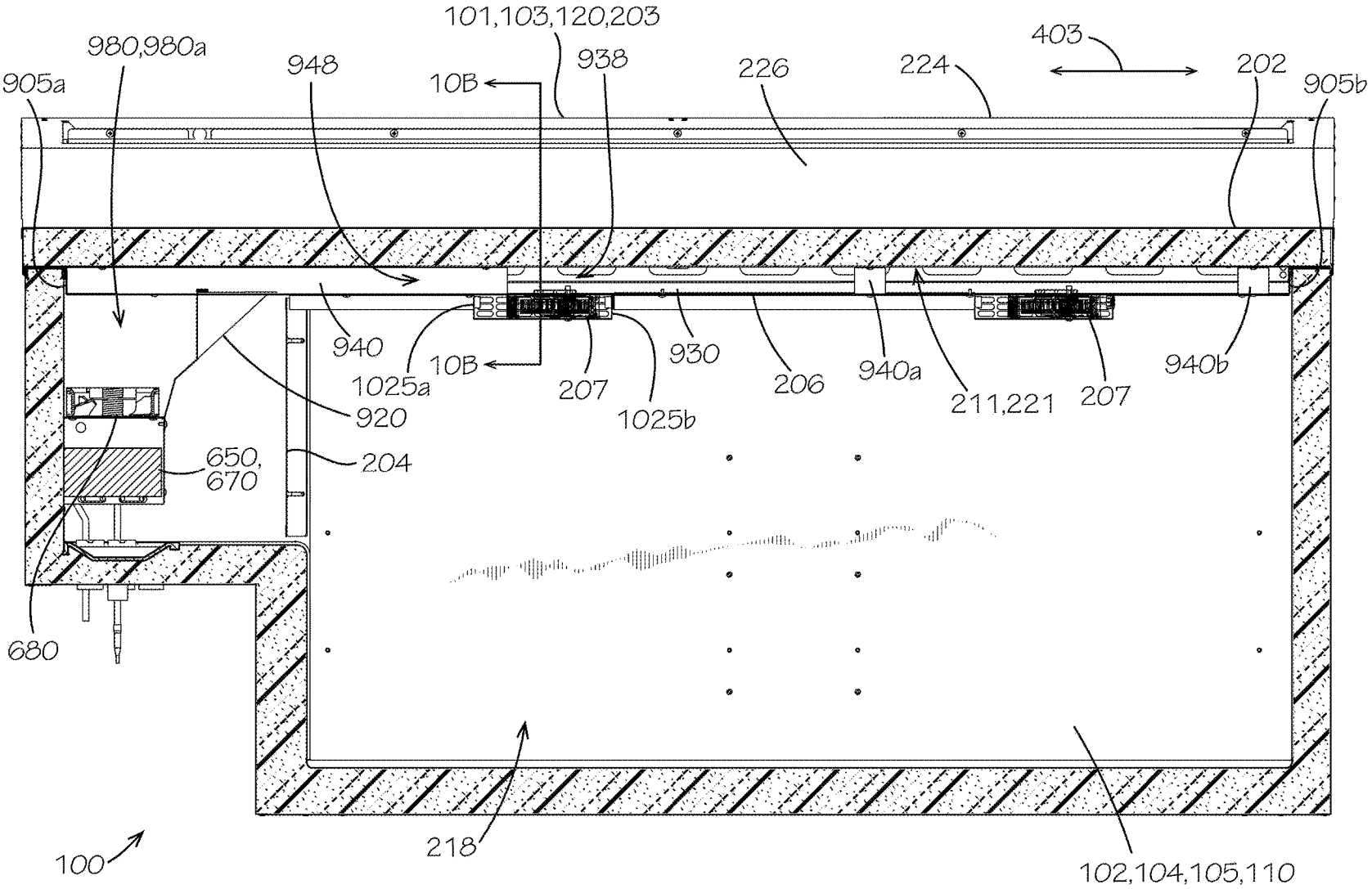
FIG. 10A is a sectional view of the appliance of FIG. 1B taken along line 10A-10A of FIG. 2B.
Figure 10B:
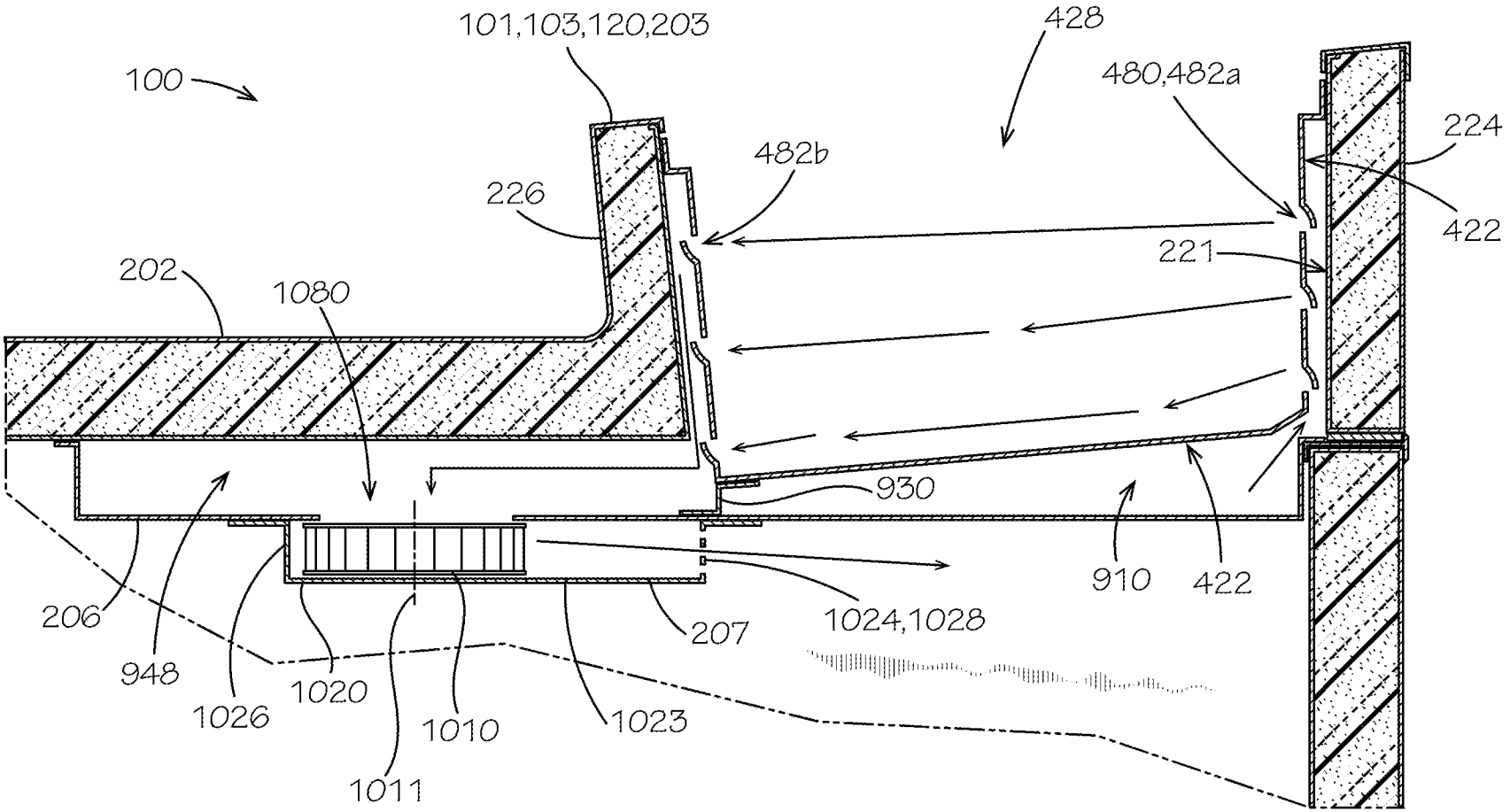
FIG. 10B is a sectional view of the appliance of FIG. 1B taken from detail 10B of FIG. 2C but taken along line 9B-9B of FIG. 2A and, as an alternate reference, along line 10B-10B of FIG. 10A in accordance with another aspect of the current disclosure and showing only geometry in the cut plane.
Figure 10C:
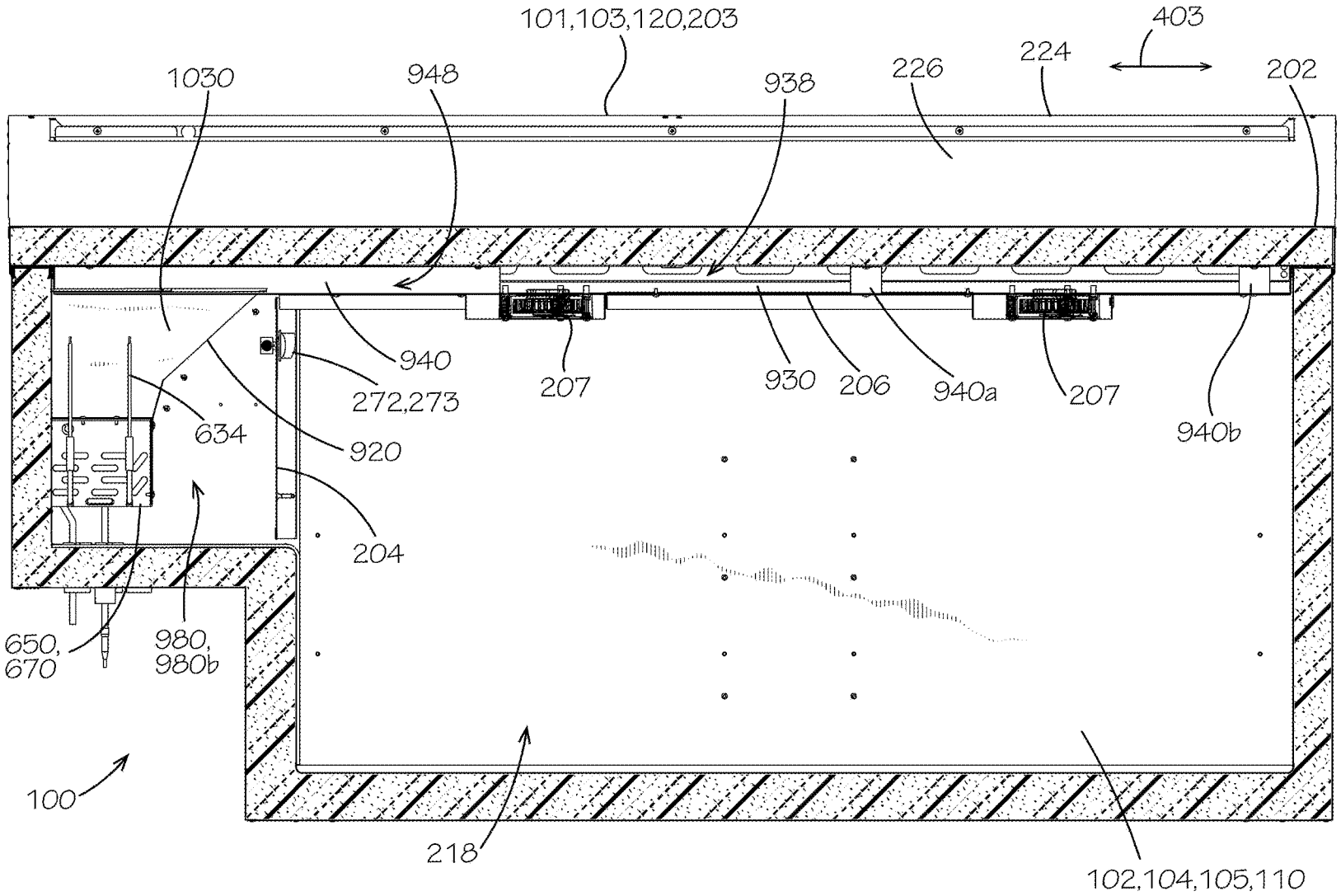

FIG. 10 is a perspective view of the appliance 100 in accordance with another aspect of the current disclosure. In some aspects, as shown, the appliance 100 can be a three-section refrigerated preparation table. By mixing and matching doors and drawers to form various combinations of closure devices 130 and/or by changing the dimensions of the base 110, the rail 120, and the closure devices 130,140, the appliance 100 can define any one of a variety of sizes and configurations. In some aspects, the appliance 100 can define a width W measured in a direction parallel with a front of the unit of 46 inches to 93 inches or inside any range of widths W starting or ending with the values 46 inches, 60 inches, 67 inches, or 93 inches. In some aspects, the width W can measure less than 46 inches or more than 93 inches. In some aspects, the appliance 100 can define a depth D measured in a direction parallel with a side of the unit of 33.25 inches or inside any range of depths D starting or ending with the values 33.25 inches. In some aspects, the depth D can measure more or less than 33.25 inches. In some aspects, the appliance 100 can define a height H measured in a vertical direction of 43.25 inches or inside any range of heights H starting or ending with the values 43.25 inches. In some aspects, the height H can measure more or less than 43.25 inches. In some aspects, the appliance 100 can define an internal volume of a cabinet or base cavity 218 (shown in FIG. 2C) measuring between 11 cubic feet and 30 cubic feet. In some aspects, the internal volume of the base cavity 218 can be outside of this range.

Figure 2B:
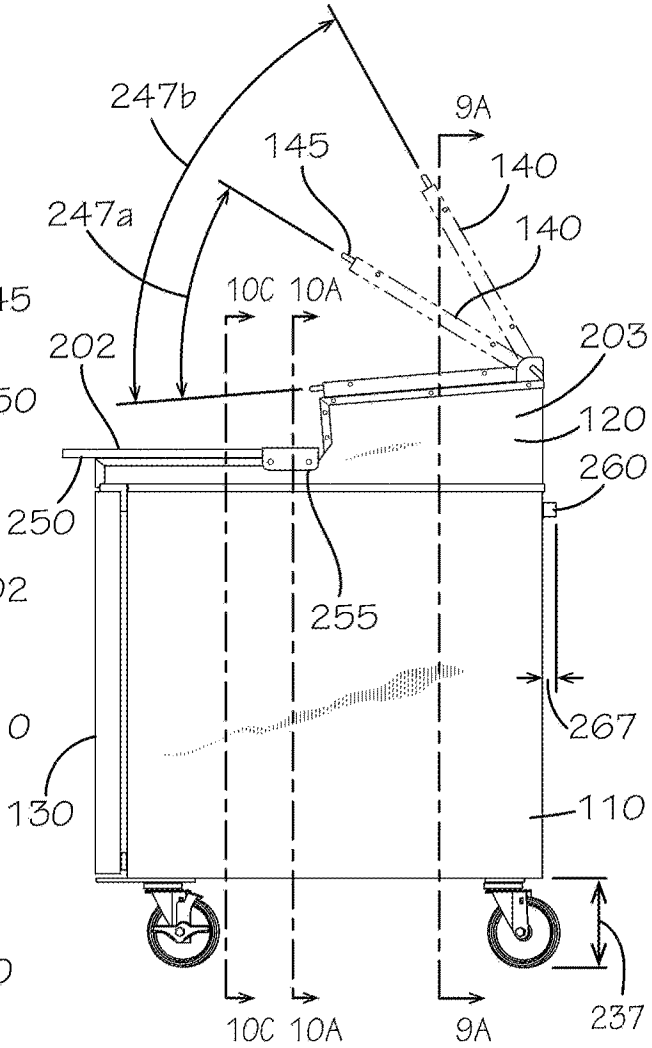
FIG. 2B is a right side view of the appliance of FIG. 1B.
Figure 2A:
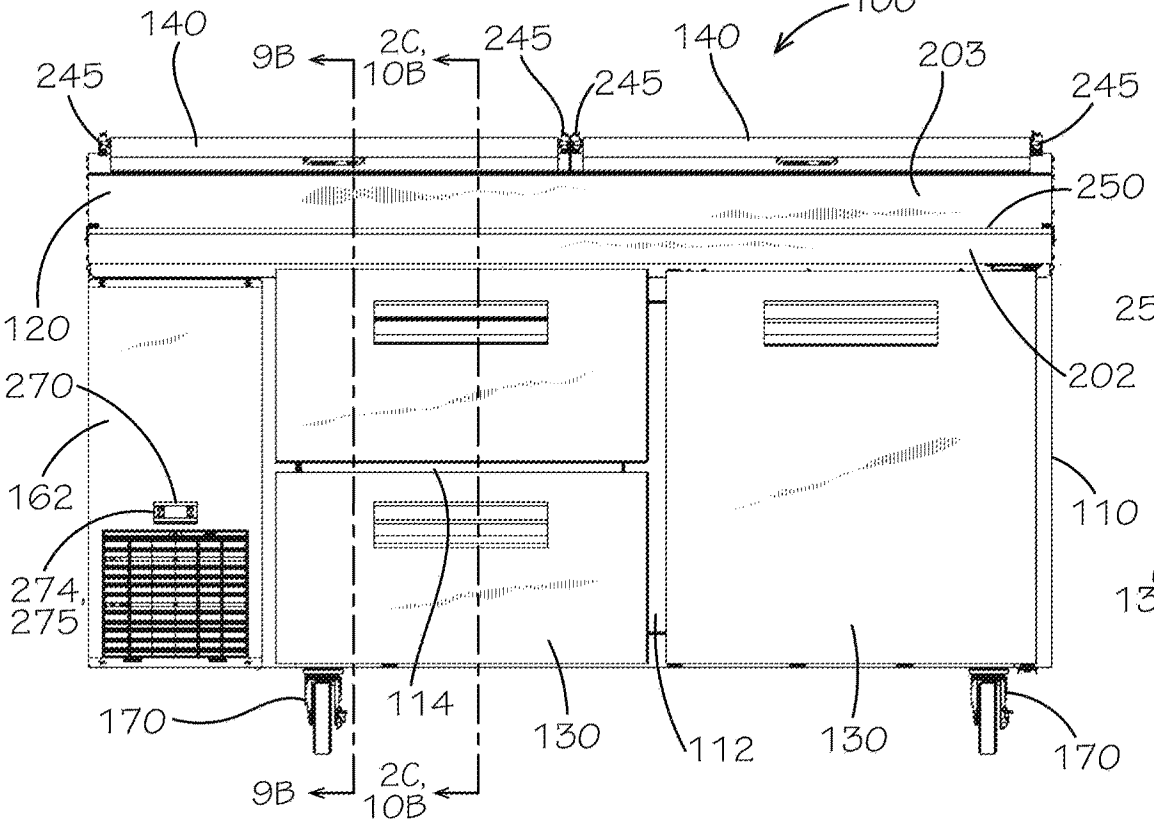
FIG. 2A is a front view of the appliance of FIG. 1B.

FIG. 2A is a front view and FIG. 2B is a right side view of the appliance 100 of FIG. 1B. In some aspects, the front access panel can be secured to the base 110 with fasteners requiring a tool for removal. In some aspects, the front access panel can be secured to the base 110 with fasteners not requiring a tool for removal. Again, the multiple sections defining main openings 118 (shown in FIG. 2C) thereof can be, at least in part, defined by the divider 112. In some aspects, including those in which the closure device 130 comprises more than one drawer in a section of the base 110, the divider 114 can extend in a horizontal direction.

The appliance 100 can comprise a controls system 270, which in some aspects can comprise a primary controller or controller 272 (shown in FIG. 2C) and a secondary controller 274. The primary controller 272 can be configured to control overall operation of the appliance 100 and, more specifically, cooling of the rail 120. Meanwhile, the secondary controller 274 can be configured to control cooling of the base 110. As shown, the secondary controller 274 comprising a control interface 275 can be secured to the front access panel 162. In some aspects, as will also be described herein, a single controller 272 of the controls system 270 can control all aspects of cooling of the appliance 100.

The rail 120 can comprise a worktop portion 202 and a rail portion 203. As also shown, the appliance 100 can comprise a cutting board 250, upon which a user can cut assemble, and/or otherwise process a product (e.g., food ingredients for use in preparing a pizza, sandwich, or other food product). The cutting board 250 can be secured to the rail 120 and, more specifically, the worktop portion 202 with brackets 255. The closure device 140 or any portion thereof of the rail 120 can be secured to the rail 120 and, more specifically, the rail portion 203 with brackets 245, about which the rail covers of the closure device 140 can hingeably open and close. More specifically, the closure device 140 and any portion thereof can open to one or more open angles 247*a,b*, at which a position of the closure device 140 can be maintained indefinitely or until a user of the appliance 100 is ready to return the closure device 140 to a closed position also shown. The open angles 247*a,b* can measure in a range such as, for example and without limitation, 30 degrees or more from the horizontal.

The appliance 100 can comprise a rear bumper or spacer 260, which can cause a rear panel (e.g., a portion of an exterior surface 222, shown in FIG. 2C, of the rail 120) of the base 110 to be automatically offset from a surface of an environment (e.g., a wall of a kitchen inside a restaurant) by an offset distance 267. The supports 170 can similarly cause a bottom panel (e.g., a portion of an exterior surface 212, shown in FIG. 2C, of the base 110) of the base 110 to be automatically offset from a surface of an environment (e.g., a floor of the same kitchen) by an offset distance 237. One or both of the offset distances 237,267 can facilitate air flow to and from the refrigeration system 150 (shown in FIG. 4B), which can occur below, behind, or to any other exposed side of the refrigeration system 150.

Figure 2C:
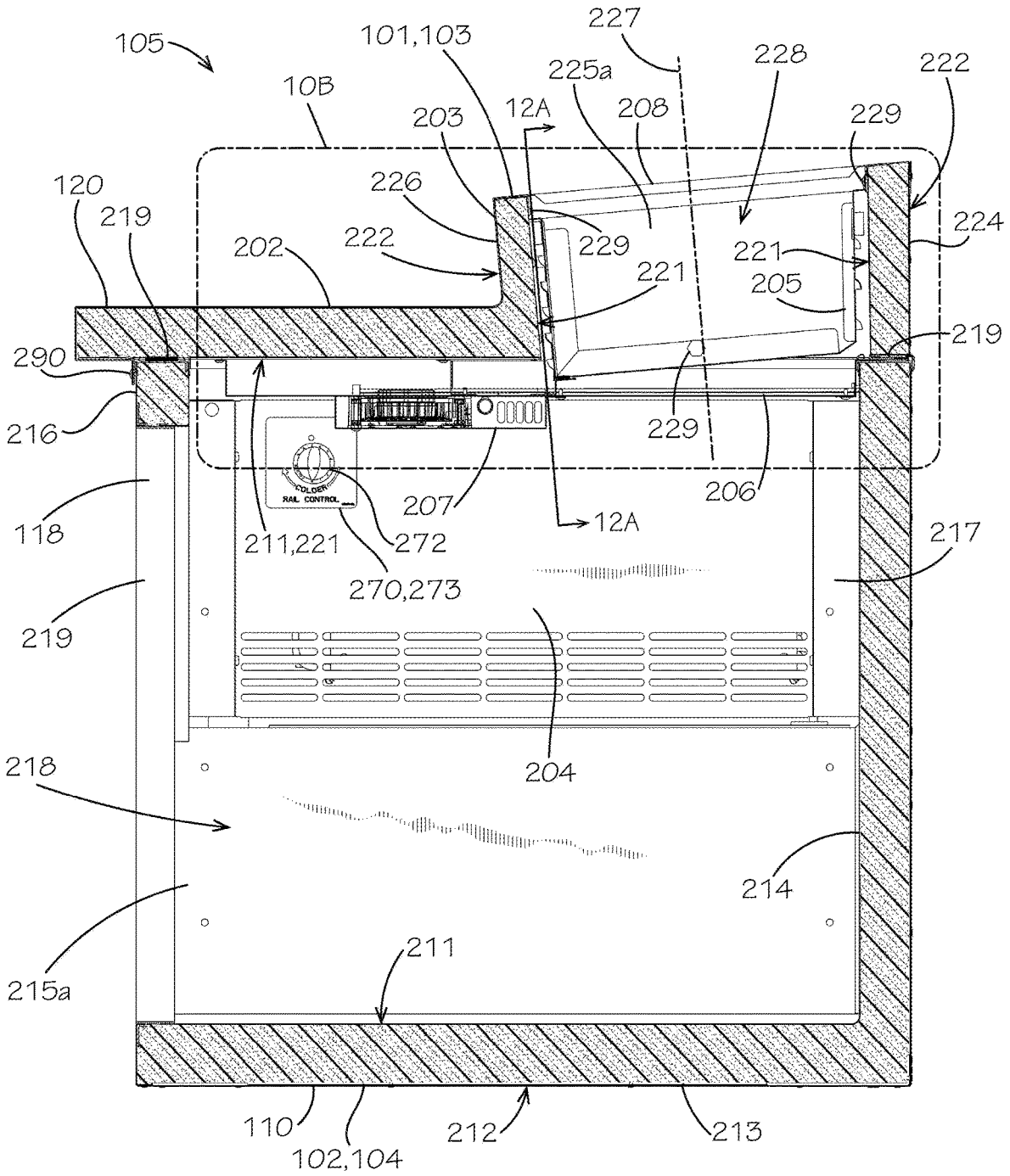
FIG. 2C is a sectional view of the appliance of FIG. 1B taken along line 2C-2C of FIG. 1B but with the drawer structure removed for clarity.

FIG. 2C is a sectional view of the appliance 100 of FIG. 1B taken along line 2C-2C of FIG. 1B but with the drawer structure, which can be one of the closure devices 130, removed for clarity. One or more walls of each of the base 110 and the rail 120 can be insulated. For example and without limitation, the walls can be insulated with blown or block foam, which can be a polyurethane foam. Either or both of the closure devices 130,140 can be similarly insulated. The rail 120 can define a first refrigerated portion 101 and, more specifically, a first insulated enclosure or first refrigerated compartment 103 thereof. The base 110 can define a second refrigerated portion 102 and, more specifically, a second insulated enclosure or second refrigerated compartment 104 thereof. The rail 120 can be lowered and then compressed onto the base 110 and a seam defined therebetween can be sealed by a thermal break 219. The thermal break 219 can comprise one or more of a dual bellow-style thermal break extrusion and a foam gasket. The rail 120 can be secured by a series of fasteners 290 along the front and rear leading edges of the cabinet. A top surface of the rail 120 can be angled with respect to the horizontal. More specifically, the top surface of the rail 120 can be angled at 5 degrees with respect to the horizontal.

The appliance 100 and, more specifically, the cabinet 105 and the base 110 can comprise an interior surface 211 and the exterior surface 212 defined by one or more of a bottom wall 213, a rear wall 214, side walls 215*a,b* (215*b* shown in FIG. 4A), a front frame 216, and an evaporator enclosure 217. The thermal break 219, which can be formed from a non-conductive or insulating material such as plastic, can interrupt or limit heat transfer between the exterior surface 212 and the interior surface 211 at any one or more connections therebetween. The cabinet 105, including in some aspects the closure device 130 (shown in FIG. 2A) and both the base 110 and the rail 120, can define the cabinet or base cavity 218. A portion of the base cavity 218 defined by the evaporator enclosure 217 can be separated from a remaining portion of the base cavity 218 defined by walls such as, for example and without limitation, the walls 213,214,215*a,b* by a return air duct 204.

The appliance 100 and, more specifically, the cabinet 105 and the rail 120 can comprise an interior surface 221 and the exterior surface 222 defined by the worktop portion 202 and the rail portion 203. More specifically, the rail 120 can comprise a rear wall 224, side walls 225*a,b* (225*b* shown in FIG. 4A), and a front wall 226. A thermal break (not shown) can interrupt or limit heat transfer between the exterior surface 222 and the interior surface 221 at any one or more connections therebetween. More specifically, tape formed from an insulating material (e.g., double-sided tape comprising any insulating carrier, backing, or substrate) can be positioned between two adjoining panel formed from a conducting material to provide a thermal break. In some aspects, as shown, a portion of the interior surface 221 and, more specifically, some or all of the interior surface 221 in contact with the thermal break 219 of the base 110 can be a thermal break, which can be formed from a non-conductive or insulating material such as plastic. The rail 120, including in some aspects the closure device 140 (shown in FIG. 2B), can define a rail cavity 228 and the opening 208 defined at an outer or upper end thereof. The rail 120 can define a centerline 227 of the rail cavity 228, which can be a bisector of the rear wall 224 and the front wall 226 in cross-section. The rail cavity 228 can be separated or divided into separate portions by a rail duct or duct 205, which can be secured to a surrounding portion of the rail 120 with fasteners 229. As shown, the rail duct 205 can be secured to the rear wall 224, the side walls 225*a,b*, and the front wall 226 with the fasteners 229, which can be screws. The rear wall 224 and any portion thereof can be substantially vertical (closer to a vertical orientation than to a horizontal direction) or vertical (aligned with the vertical orientation).

The appliance 100 and, more specifically, the cabinet 105 can comprise various other panels or ducts. The cabinet 105 can comprise a main cabinet duct or roof duct 206, which can be secured to an underside of the rail 120 and can extend in a horizontal direction front to rear and left to right across a roof of the appliance 100 defined by the interior surfaces 211,221. The cabinet 105 can comprise a cabinet fan assembly 207, which can be coupled to the roof duct 206 and can be configured to deliver cold air to the base cavity 218 during normal operation. The appliance 100 can comprise a control interface 273, which can define an input to the controller 272 (shown also in FIG. 4B), which again can be configured to control overall operation of the appliance 100 and, more specifically, cooling of the rail 120.

Figure 3B:
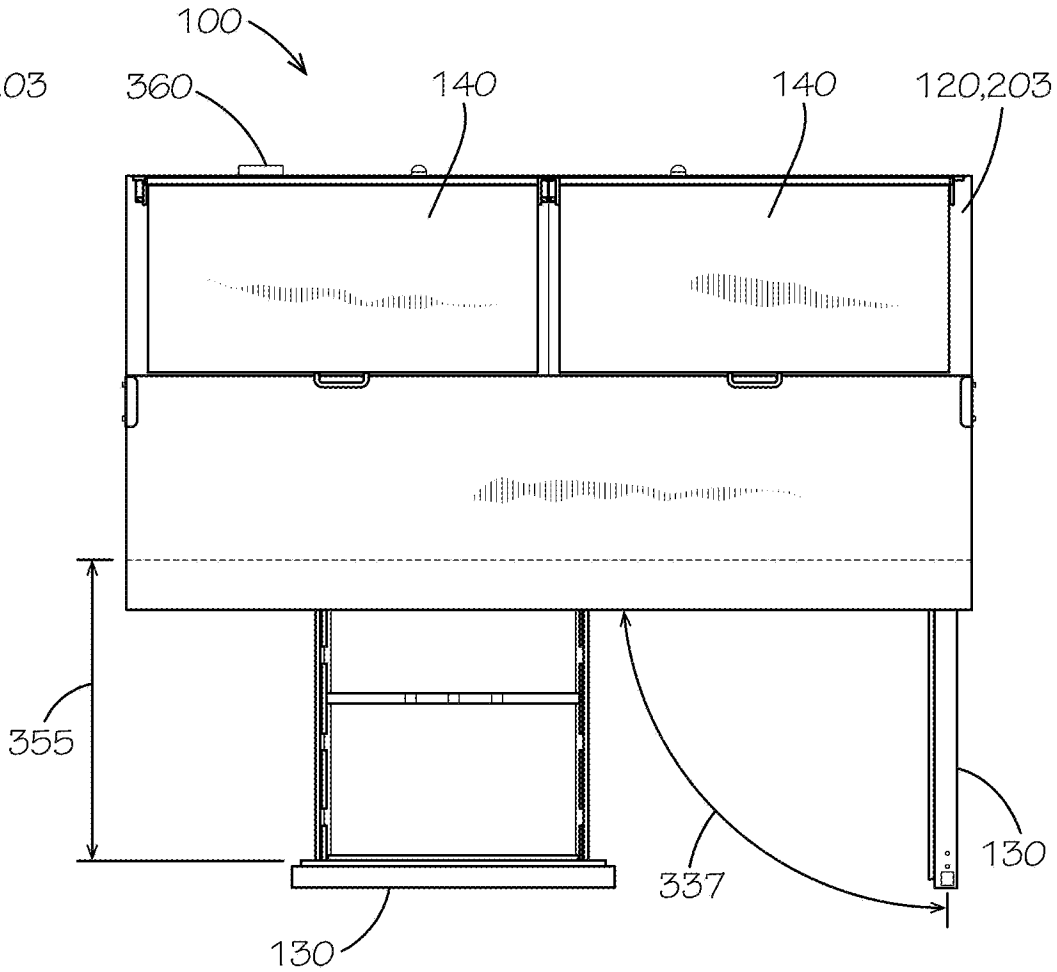
FIG. 3B is a top view of the appliance of FIG. 1B showing a door thereof swung open to 90 degrees and drawers thereof extended.
Figure 3A:
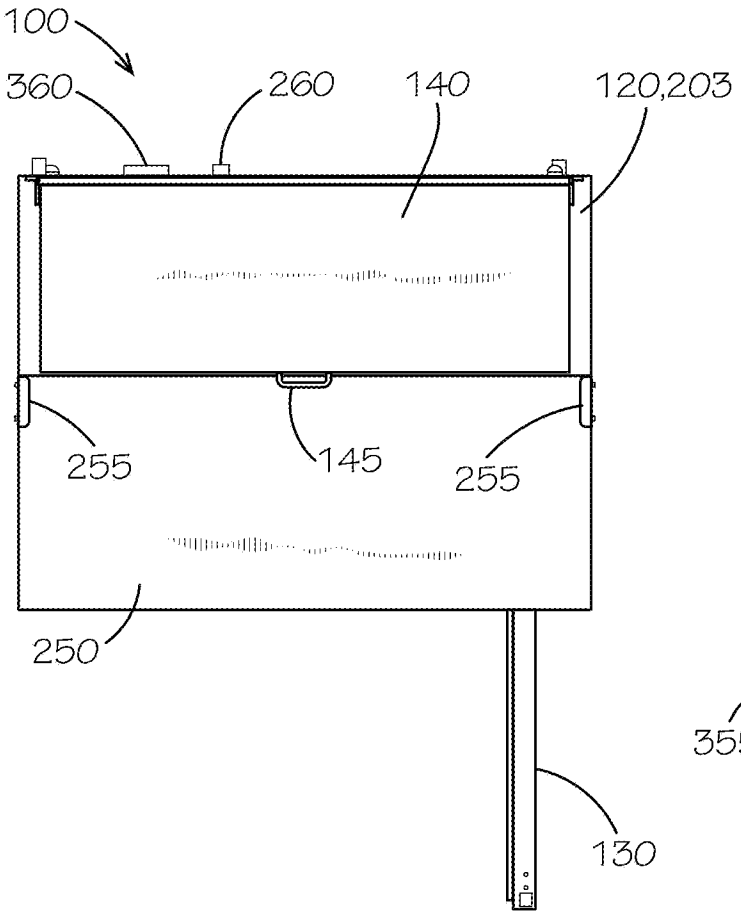
FIG. 3A is a top view of the appliance of FIG. 1A.

FIG. 3A is a top view of the appliance 100 of FIG. 1A, and FIG. 3B is a top view of the appliance 100 of FIG. 1B showing a door as one of the closure devices 130 swung open to a closure device angle 337 of 90 degrees and drawers, i.e., another of the closure devices 130 thereof, extended to an open position defining an extension distance 355. When configured as a door, the closure device 130 can be hinged on one side or another, i.e., left-hand swing or right-hand swing as shown. In some aspects, operation of the appliance 100 need not require a switch sensing whether the closure device 130 is open or closed. In some aspects, the appliance 100 can comprise such a switch to control internal lights (not shown) or other features of the appliance.

FIG. 4A is a partially exploded front perspective view of the appliance 100 of FIG. 1A showing the rail duct 205 of the appliance removed from the raised rail 120 of the appliance 100. Again, the appliance 100 can comprise the worktop portion 202 and the rail portion 203. The rail duct 205 can be installed in and removed from the rail cavity 228 through the opening 208 by attachment or removal, respectively, of the fasteners 229. The rail duct 205 can define a U-shaped tray in cross-section. As shown, one or more of the fasteners 229 for attachment of the rail duct 205 can be thumbscrews. More specifically, the rail duct 205 can be installed in or removed from the rail cavity 228 in a direction parallel to the centerline 227 (shown in FIG. 2C). The appliance 100 and, more specifically, the rail 120 can comprise a sensor 450, which can differentiate between when the closure device 140 is in an open position as shown and when the closure device 140 is in a closed position. As shown, the sensor 450 can be a light sensor configured to sense the presence of light and thus, indirectly, the absence of light. More specifically, the sensor 450 can be a light sensor as specified from Danfoss A/S (e.g., Part No. 080G3315).

The appliance 100 can comprise one or more storage components 410, each of which can receive stored product, e.g., food product in storage containers, thereupon. In some aspects, as shown, each of the storage components 410 can comprise or can be a shelf. In some aspects, each of the storage components 410 can comprise or can be a shelf slide or a set of shelf slides configured to receive shelves extending therebetween. In some aspects, each of the storage components 410 can comprise or can be a pan slide or a set of pan slides configured to receive storage pans (not shown) extending therebetween.

Figure 4B:
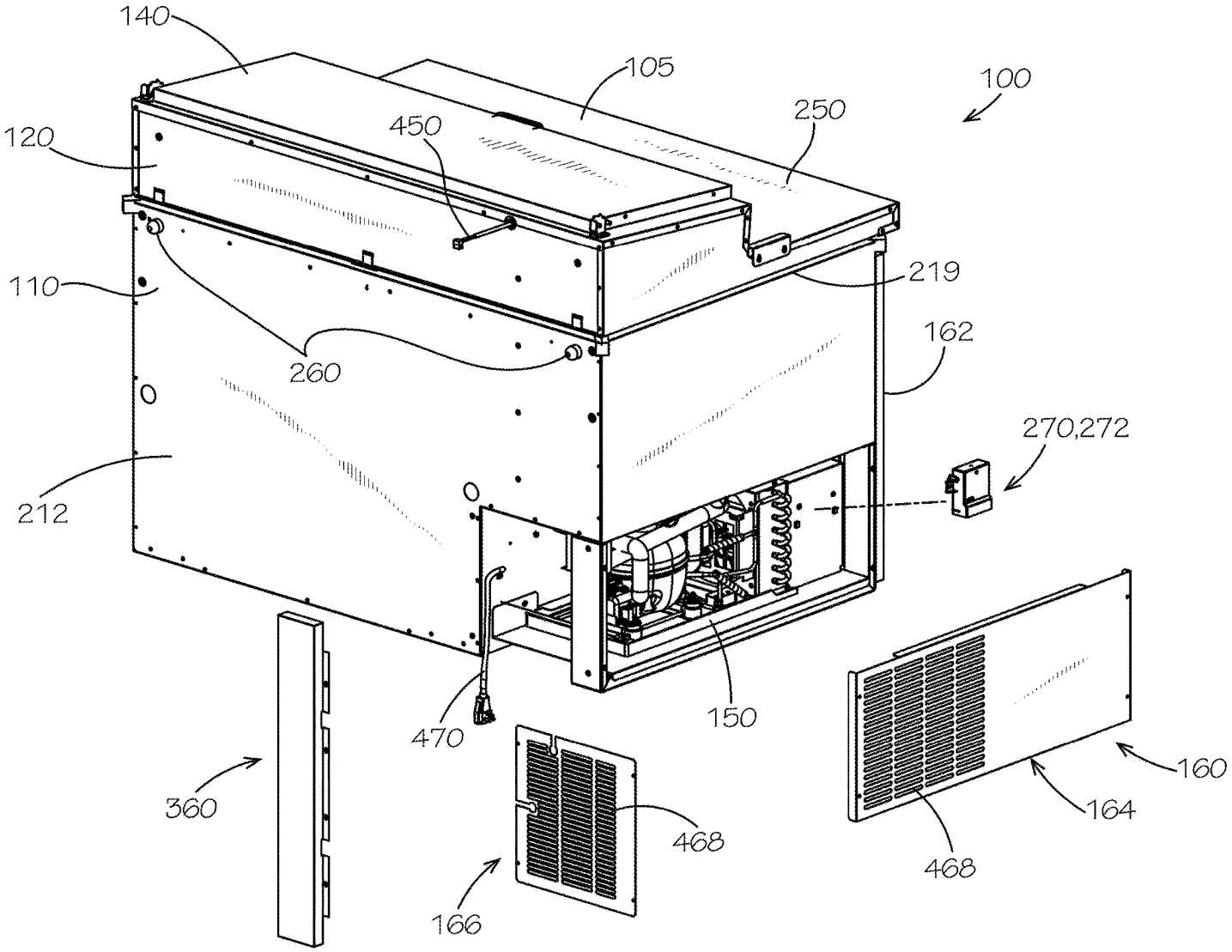
FIG. 4B is a partially exploded rear perspective view of the appliance of FIG. 1A showing various access panels removed and offset from the appliance.

FIG. 4B is a partially exploded rear perspective view of the appliance 100 of FIG. 1A showing various access panels 160 including the front access panel 162, the side access panel 164, and the rear access panel 166 removed and offset from the appliance 100. One or more of the access panels 160 can define openings 468, which can facilitate ventilation of, i.e., circulation of air to and from, the refrigeration system 150. The appliance 100 can comprise a wire chase or wire cover 360, which can cover wiring configured to supply power to and carrying signals from the sensor 450. The appliance 100 can comprise a power cord 470, which can be configured to supply power to the appliance 100 overall, including the refrigeration system 150. The appliance 100 can comprise the controller 272, which can again be a primary controller and can be configured to control overall operation of the appliance 100 including operation of the refrigeration system 150.

FIG. 4C is a front top perspective view of a rail duct 205 of the appliance 100 of FIG. 1A. The rail duct 205 can define an interior or inward-facing surface 421 and an exterior or outward-facing surface 422. The rail duct 205 can comprise a bottom panel or bottom wall 423, a rear panel or rear wall 424, one or more side flanges 425*a,b*, and a front panel or front wall 426. The side flanges 425*a,b* can be separated into two or more separate portions extending from the bottom wall 423, the rear wall 424, and the front wall 426 and can be angled with respect to the respective bottom wall 423, the rear wall 424, and the front wall 426. More specifically, the side flanges 425*a,b* or portions thereof can be angled at 90 degrees with respect to the respective bottom wall 423, the rear wall 424, and the front wall 426. The rail duct 205 can comprise panels or ledges 434,436, which can extend from the respective walls 424,426. The rail duct 205 can comprise panels or flanges 444,446, which can extend from the respective ledges 434,436. In some aspects, an installed condition in the rail 120, the ledges 434,436 can be offset or recessed below a top surface of the rail by 29 mm (approximately 1.1 inches) or by at least 29 mm. In some aspects, the ledges 434,436 can be recessed below a top surface of the rail by more or less.

The rail duct 205 can define openings 480 in each of the rear wall 424 and the front wall 426. A plurality of openings 480*a* can be defined in the rear wall 424, and a plurality of openings 480*b* can be defined in the front wall 426. More specifically, the openings 480*a,b* can comprise one or more air transmission openings 482*a,b*, respectively, which can be configured to allow transmission or flow of air from behind the rail duct 205 and into a rail storage cavity or pan storage cavity or cavity 428 defined at least in part by the rail duct 205. The openings 480*a,b* can further comprise one or more handle openings 484*a,b*, respectively, which can be configured to receive handles 490 and can also be configured to allow transmission or flow of air from behind the rail duct 205 and into the pan storage cavity 428. The openings 480*a,b* can further comprise one or more supplemental openings 486*a,b*, respectively, which can be configured to allow transmission or flow of air from behind the rail duct 205 and into the pan storage cavity 428 in supplemental or additional locations where additional cooling can facilitate proper maintenance of temperatures inside the rail 120. In some aspects, a first set of openings 480*a,b* can define a first pattern, and a second set of openings 480*a,b* can define a second pattern. Inside each "pattern," the openings 480*a,b* can define one or more common features such as, for example and without limitation, a common opening size and shape and a common center-to-center spacing. These common features can nonetheless vary between patterns. In some aspects, for example, a center-to-center spacing (e.g., the spacing 483) between adjacent openings 482*a* in the first set of openings 482*a* can be different than a center-to-center spacing (e.g., the spacing 485) between adjacent handle openings 484*a* in the second set of openings 484*a*.

A plurality of the air transmission openings 482*a,b* can be arranged in a pattern on the corresponding rear wall 424 or front wall 426 of the rail duct 205. In some aspects, as shown, the plurality of the air transmission openings 482*a,b* can be arranged in one or more horizontal rows extending along a longitudinal direction 403 of the rail duct 205 and, more generally, a longitudinal direction of the rail 120. More specifically, the plurality of the air transmission openings 482*a,b* can be aligned with each other along the longitudinal direction 403. In some aspects, adjacent air transmission openings 482*a,b* can be offset from each other by a horizontal spacing or first spacing or spacing 483, which can be measured center-to-center as shown. Adjacent rows of the plurality of the air transmission openings 482*a,b* can be repeated down the respective walls 424,426 in a direction parallel to the respective walls 424,426 and can be offset from each other by a vertical spacing or second spacing or spacing 488, which can be measured center-to-center as shown. The first spacing 483 and the second spacing 488 can be consistent across the plurality of the air transmission openings 482*a,b*. Adjacent horizontal rows of the plurality of the air transmission openings 482*a,b* can be staggered with respect to each other in the longitudinal direction 403. A center of one or more horizontal rows of the plurality of the air transmission openings 482*a,b* can be aligned with a centerline 1001 (shown in FIG. 10A for a different sized appliance 100) of the rail duct 205 when viewed from a front of the rail duct 205.

A plurality of the handle openings 484*a,b* can be arranged in a pattern on the corresponding rear wall 424 or front wall 426 of the rail duct 205. In some aspects, as shown, the plurality of the handle openings 484*a,b* can be arranged in one or more horizontal rows along the longitudinal direction 403 of the rail duct 205 and, more generally, the longitudinal direction of the rail 120. More specifically, the plurality of the handle openings 484*a,b* can be aligned with each other along the longitudinal direction 403. Adjacent handle openings 484*a,b* can be offset from each other by a horizontal spacing or spacing 485, which can match but, as shown, need not match the spacing 483. The spacing 485, which can be measured center-to-center as shown, can be consistent across the plurality of the handle openings 484*a,b*. A center of one or more horizontal rows of the plurality of the handle openings 484*a,b* can itself be aligned with the centerline 1001 of the rail duct 205 when viewed from a front of the rail duct 205.

A plurality of the supplemental openings 486*a,b* can be arranged in a pattern on the corresponding rear wall 424 or front wall 426 of the rail duct 205. In some aspects, as shown, the plurality of the supplemental openings 486*a,b* can be arranged in one or more vertical rows extending in a direction parallel to the corresponding rear wall 424 or front wall 426 of the rail duct 205. Adjacent supplemental openings 486*a,b* can extend down the respective walls 424,426 and can be offset from each other by a vertical spacing or first spacing or spacing 487. As shown, a first supplemental opening 486*a,b* of the supplemental openings 486*a,b* in a particular area of the rail duct 205 can be positioned proximate to a top end of the rear wall 424 or, more specifically, the ledges 434,436 and additional supplemental openings 486*a,b* can extend down the walls 424,426. Adjacent rows of the plurality of the supplemental openings 486*a,b* can be repeated across the respective walls 424,426 in a direction parallel to the longitudinal direction 403 and can be offset from each other by a horizontal spacing or second spacing (not shown). In some aspects, a distance 481 (shown in FIG. 11A) in the longitudinal direction 403 between a center of each of the plurality of the supplemental openings 486*a,b* and a nearest end of the rail duct 205 can be as close as possible to the nearest end considering, for example, minimum bend radii of the material used to form the rail duct 205. In some aspects, the center of each of the plurality of the supplemental openings 486*a,b* and a nearest end of the rail duct 205 can be adjusted as desired for more at less air flow.

In some aspects, for example and without limitation, the rail duct 205 of a one-section appliance 100 defining a width W (shown in FIG. 10) of 46 inches can define three horizontal rows of the transmission openings 482*a* totaling 25 openings 482*b* on the rear wall 424 (i.e., approximately 24 openings per meter of length of the rail duct 205) and can define five horizontal rows of the openings 482*b* totaling 41 openings 482*b* on the front wall 426 (i.e., approximately 39 openings/meter); the rail duct 205 of a two-section appliance 100 defining a width W of 60 inches can define three horizontal rows of the openings 482*a* totaling 29 openings 482*b* on the rear wall 424 (i.e., approximately 21 openings/meter) and can define five horizontal rows of the openings 482*b* totaling 51 openings 482*b* on the front wall 426 (i.e., approximately 36 openings/meter); the rail duct 205 of a two-section appliance 100 defining a width W of 67 inches can define three horizontal rows of the openings 482*a* totaling 35 openings 482*b* on the rear wall 424 (i.e., approximately 22 openings/meter) and can define five horizontal rows of the openings 482*b* totaling 61 openings 482*b* on the front wall 426 (i.e., approximately 38 openings/meter); and the rail duct 205 of a three-section appliance 100 defining a width W of 93 inches can define three horizontal rows of the openings 482*a* totaling 47 openings 482*b* on the rear wall 424 (i.e., approximately 22 openings/meter) and can define five horizontal rows of the openings 482*b* totaling 79 openings 482*b* on the front wall 426 (i.e., approximately 37 openings/meter).

An open area of each air transmission opening 482*a* can measure 3.6 to 3.7 $cm^2$. In some aspects, an open area of the plurality of the air transmission openings 482*a* extending in the longitudinal direction 403 across one meter of the rail duct 205 can measure a total of 74 to 88 $cm^2$ on the rear wall 424*a*. In some aspects, an open area of the plurality of the air transmission openings 482*a* extending in the longitudinal direction 403 across one meter of the rail duct 205 can measure a total of 130 to 144 $cm^2$ on the front wall 426*a*.

Fewer air transmission openings 482*a,b* can be defined in the rear wall 424*a* of the rail duct 205 to increase pressure drop across each opening 482*a* and across the rail from the plurality of the air transmission openings 482*a* at the rear wall 424*a* to the plurality of the air transmission openings 482*b* at the front wall 424*b*. Meanwhile, more air transmission openings 482*a,b* can be defined in the front wall 426*a* of the rail duct 205 to ensure that air is able to freely flow out of the pan storage cavity 428 through the plurality of the air transmission openings 482*b* and not be unnecessarily choked or restricted. In some aspects, either a quantity of the air transmission openings 482*b* of a total open area of the air transmission openings 482*b* per unit length (e.g., one meter) of the rail duct 205 can be 1.64 to 1.76 times (i.e., 164% to 176% of) a quantity of the air transmission openings 482*a* of a total open area of the air transmission openings 482*a* per the same unit length. In some aspects, an open area of the openings 480*a* in the rear wall 424 of the rail duct 205 can measure a total of 80 to 110 $cm^2$ across each meter of a length of the rail duct 205. In some aspects, the rail duct 205 can result in a pressure drop of 10 Pa to 15 Pa across the rail duct 205. In some aspects, the rail duct 205 can result in a pressure of drop of 10 Pa to 12 Pa across the rail duct 205.

In some aspects, for example and without limitation, the rail duct 205 of each appliance 100 can define one horizontal row of the handle openings 484*a* totaling two openings 484*b* on each of the rear wall 424 and the front wall 426; and an open area of each air handle opening 484*a* can measure 6.1 to 6.2 $cm^2$.

In some aspects, for example and without limitation, the rail duct 205 of a one-section appliance 100 defining a width W (shown in FIG. 10) of 46 inches can define 8 supplemental openings 486*a* at the left rear corner, 4 supplemental openings 486*a* at the right rear corner, 5 supplemental openings 486*a* at the left front corner, and 15 supplemental openings 486*a* at the right front corner; the rail duct 205 of a two-section appliance 100 defining a width W of 60 inches can define no supplemental openings 486*a* at the left rear corner, 8 supplemental openings 486*a* at the right rear corner, 8 supplemental openings 486*a* at the left front corner, and 15 supplemental openings 486*a* at the right front corner; the rail duct 205 of a two-section appliance 100 defining a width W of 67 inches can define 14 supplemental openings 486*a* at the left rear corner, no supplemental openings 486*a* at the right rear corner, 15 supplemental openings 486*a* at the left front corner, and 15 supplemental openings 486*a* at the right front corner; and the rail duct 205 of a three-section appliance 100 defining a width W of 93 inches can define 7 supplemental openings 486*a* at the left rear corner, no supplemental openings 486*a* at the right rear corner, 5 supplemental openings 486*a* at the left front corner, and 15 supplemental openings 486*a* at the right front corner. An open area of each air supplemental opening 482*a* can measure approximately 0.5 $cm^2$.

FIG. 4D is a perspective view of the handle 490 of the rail duct 205 of FIG. 4B. As shown, the handle 490 can be a bushing, which can be circular. The handle 490 can comprise a mounting flange 492, which can contact help maintain a position of the handle 490 in an axial direction of the handle 490 with respect to the rail duct 205. Each of the handles 490 can be received within one of the handle openings 484*a,b* defined in the rail duct 205. The handle 490 can define an opening 498 through which one or more fingers of a user can extend and thereby grip and manipulate a position of the rail duct 205 without necessarily touching a raw edge of the rail duct 205, which can be formed from a relatively thin piece (e.g., 20 to 24 gage defining a thickness of 0.6 to 1.0 mm) of a hard material such as metal. The handle 490 can be removed from the rail duct 205 and replaced for cleaning or replacement, and the rail duct 205 can itself be removed from the rail 120 for cleaning or replacement.

FIG. 4E is a sectional view of one of the air transmission openings 482*a* of the rail duct 205 of FIG. 4C taken along line 4D-4D of FIG. 4C. Each of the air transmission openings 482*a,b* can define a height 4821 and a depth 4822 and a length 4823 (shown in FIG. 4C). In some aspects, the height 4821 can be 10 mm, the depth 4822 can be 5.2 mm, and the length 4823 can be 75 mm. In some aspects, as shown, each of the air transmission openings 482*a,b* can be a louver. In some aspects, each of the air transmission openings 482*a,b* can be a slot.

Figure 5A:
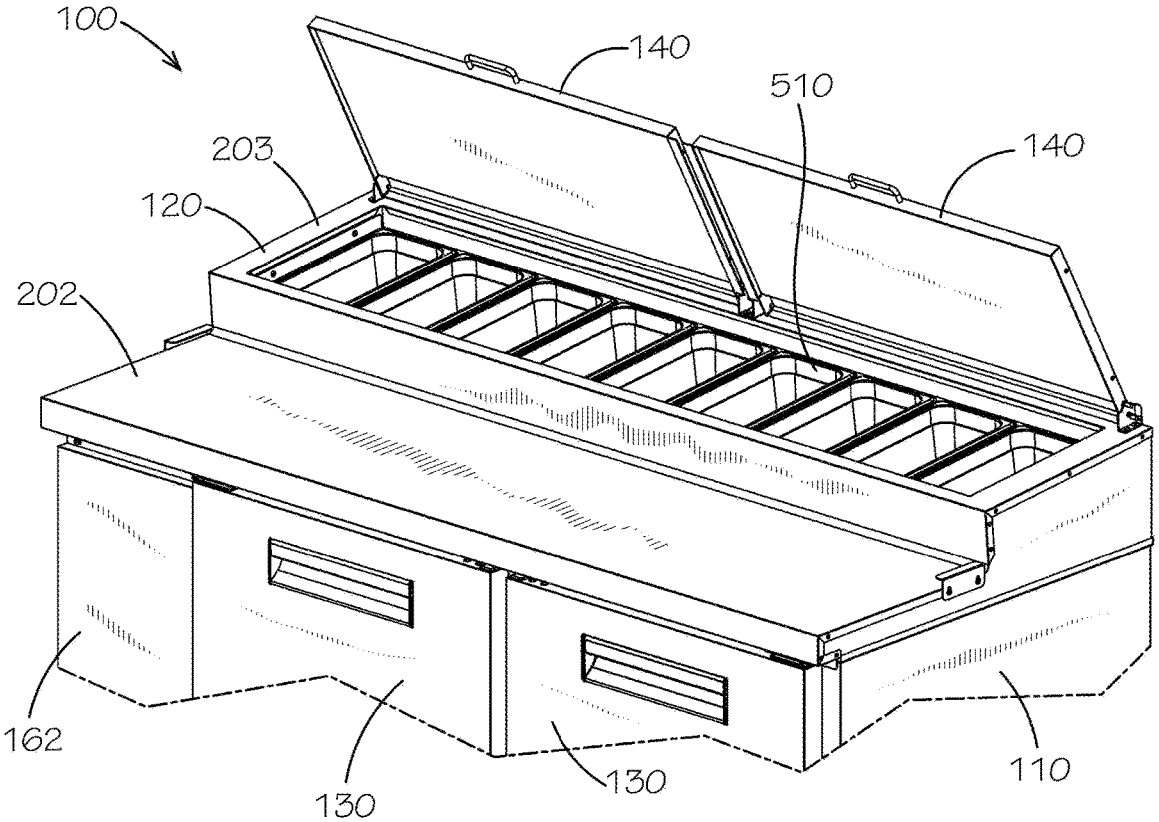
FIG. 5A is a perspective view of the appliance of FIG. 1B in accordance with another aspect of the current disclosure showing a plurality of pans in the raised rail and a lid of the raised rail in an open position.

FIG. 5A is a perspective view of the appliance 100 of FIG. 1B in accordance with another aspect of the current disclosure showing a plurality of food pans or pans 510 in the raised rail 120 and a closure device 140 of the raised rail in an open position. The plurality of pans 510 can comprise any desired combination of pans 510, which typically are fractional sizes of a full-size "hotel" pan and configured to hold stored product such as, for example and without limitation, food ingredients for both refrigerated storage, display, and dispensing during a commercial food preparation process such as making a pizza or a sandwich. A full-size hotel pan can be and typically is sized to fit within a rectangular opening measuring 12 inches by 20 inches. Common or standard fractional sizes of a pan 510 include ⅑, ⅙, ¼, ⅓, ½ regular or short, and ½ long sizes. Fractional pans 510 used in combination can be configured to fit within the same pan opening as one full-size pan 510. For example, three ⅓-size pans 510 are typically configured to fit within the same pan opening as the full-size pan 510. In some aspects, each of the pans 510 can measure approximately 4 inches deep. In some aspects, each of the pans 510 can measure approximately 6 inches deep. In some aspects, a depth of each of the pans 510 can be smaller or greater. A variety of sizes can be combined to hold different amounts of food ingredients in different amounts, and positions to facilitate flexibility while using the appliance 100 and at the same time allow thorough cleaning of all that touches the food ingredients by removal and cleaning of the pans 510 and even the rail duct 205 as well as any exposed surfaces of surrounding portions of the appliance 100. The pan storage cavity 428 (shown in FIG. 4C) can be configured to receive one or more of the food pans 510.

In some aspects, for example and without limitation, the pan storage cavity 428 of a one-section appliance 100 defining a width W (shown in FIG. 10) of 46 inches can be configured to receive six ⅓-size pans; the pan storage cavity 428 of a two-section appliance 100 defining a width W of 60 inches can be configured to receive eight ⅓-size pans; the pan storage cavity 428 of a two-section appliance 100 defining a width W of 67 inches can be configured to receive nine ⅓-size pans; and the pan storage cavity 428 of a three-section appliance 100 defining a width W of 93 inches can be configured to receive twelve ⅓-size pans.

Figure 5B:
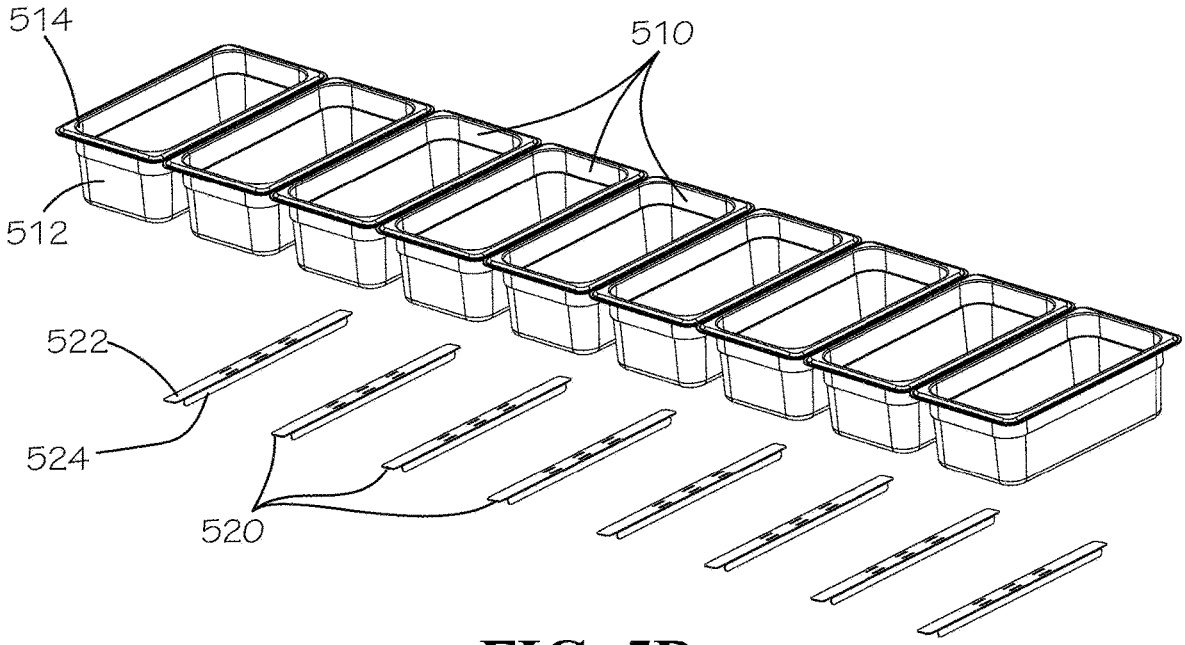
FIG. 5B is an exploded perspective view of the plurality of pans of FIG. 5A and a plurality of pan dividers positioned between the pans.

FIG. 5B is an exploded perspective view of the plurality of pans 510 of FIG. 5A and a plurality of pan dividers 520 positioned between adjacent pans 510 of the plurality of pans 510. Each of the pans 510 can comprise a pan body 512 and a flange 514, which can extend from the pan body 512. The pan body 512 of each of the pans 510 can be tapered in full or in part (e.g., just a lower portion thereof distal from the flange 514) to facilitate manufacturing and storage thereof. During use of the appliance 100, each of the pan dividers 520 and the pans 510 can be supported by the ledges 434,436 of the rail duct 205 (shown in FIG. 2C).

Each of the pan dividers 520 can comprise a support ledge 522 and one or more flanges 524, which can increase an ability of the pan divider 520 to resist deflection under various loads, which can be experienced not only during use but during cleaning and general handling. As shown, each of the pan dividers 520 can define openings (e.g., slots), which can be configured to receive transverse pan dividers (not shown) extending in a direction perpendicular to and between adjacent pan dividers 520 of the plurality of pan dividers 520. In some aspects, each of the pan dividers 520 can be configured to support the pans 510 by supporting various flanges 514 thereof, especially when smaller pans 510 are not fully supported by the 434,436 of the rail duct 205. In some aspects, the pan dividers 520 can be configured to reduce or protect against leakage of cool air from the pan storage cavity 428 (shown in FIG. 9A) defined below the pans 510 to an area above the pans 510 and more exposed to ambient room conditions. Each of the pan dividers 520 can be supported by the ledges 434,436 (shown in FIG. 4C) of the rail duct 205.

Figure 6A:
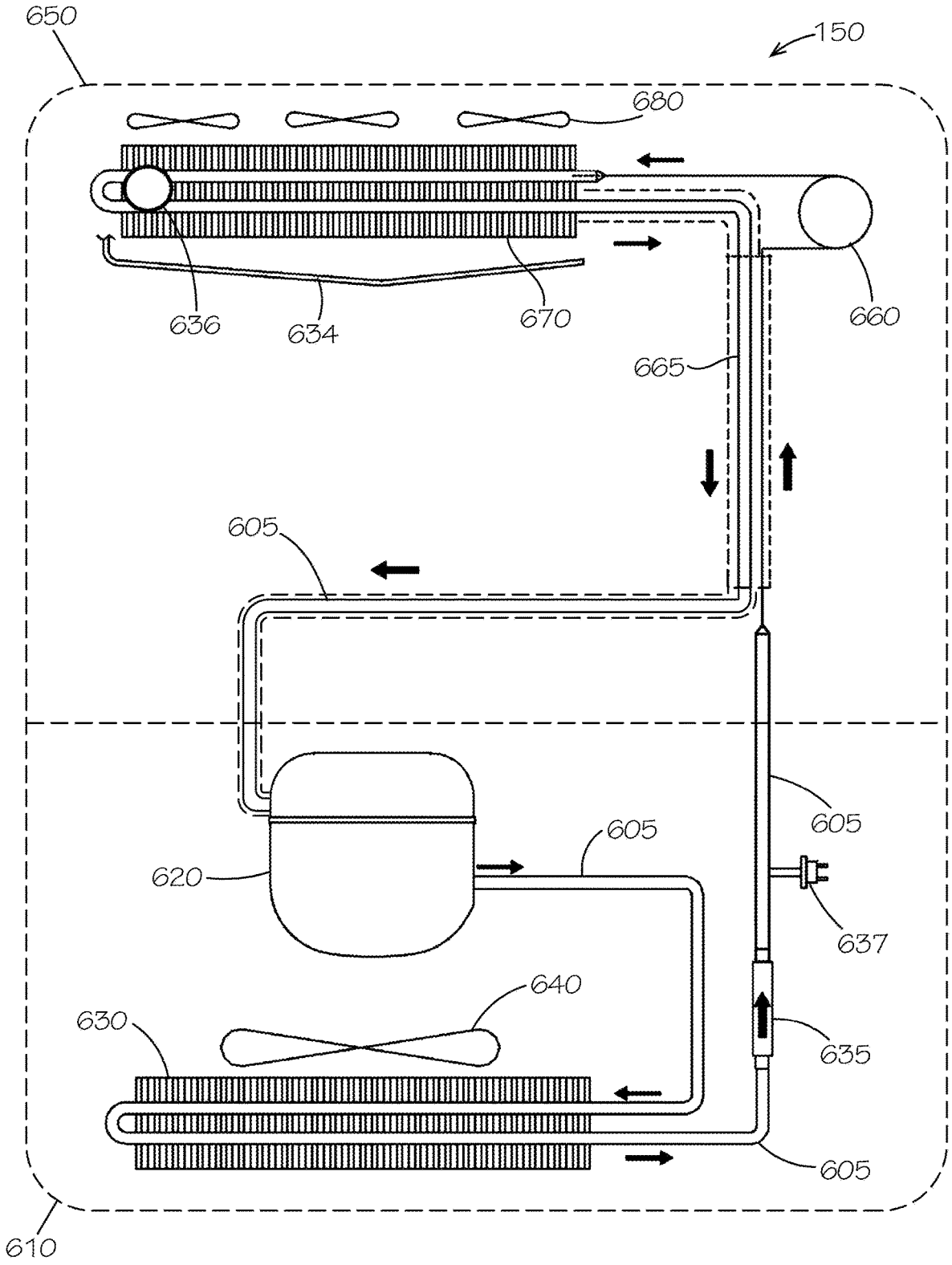
FIG. 6A is a schematic view of a refrigeration system of any of the appliances of FIGS. 1A-1C.

FIG. 6A is a schematic view of the refrigeration system 150 of any of the appliances 100 of FIGS. 1A-10. The refrigeration system 150 can comprise a condensing unit 610, an evaporating unit 650, and a refrigerant (not shown) received within each of the condensing unit 610 and the evaporating unit 650. The refrigeration system 150 can comprise tubing 605, which can join each of the components of the refrigeration system 150 configured to receive the refrigerant and can itself form at least a part of such components. The refrigerant can be configured to flow through each of the condensing unit 610 and the evaporating unit 650 and, ultimately, to remove heat from at least one of air and stored product received within the appliance 100.

The condensing unit 610 can comprise a compressor 620 and a condenser 630 in fluid communication with each other. The compressor 620 can be configured to transform a low pressure gas entering the compressor 620 into a high pressure hot gas exiting the compressor 620 by compression of the refrigerant, which can be a refrigerant such as R290, commonly known as propane. In some aspects, the refrigerant can be another gas able to facilitate heat transfer.

The condenser 630 can comprise tubing such as the tubing 605, which can be routed as desired, including in a serpentine fashion, to increase a surface area of the condenser 630 exposed to air flow and can by its shape and material facilitate heat transfer. In some aspects, the condenser 630 can further comprise fins, which can be coupled to the tubing and can further increase the surface area of the condenser 630 exposed to the air flow and can by its shape and material facilitate heat transfer.

The condensing unit 610 can further comprise a condenser fan 640, which can comprise a motor, a shaft coupled to the motor, and a fan blade coupled to the shaft. The condenser fan 640 can be configured to drive or blow air past or through the condenser 630 (and, less importantly, also the compressor 620) to remove heat therefrom (i.e., the condenser 630 can be configured to release heat into the air passing through the condenser 630). More specifically, As the condenser 630 is cooled by air driven by the condenser fan 640, the condenser 630 can transform the refrigerant therein from a high-pressure hot gas to a high-pressure liquid, thereby condensing the refrigerant.

The condensing unit 610 can comprise a filter-dryer 635, which can protect the refrigeration system 150 against contaminants and moisture. The condensing unit 610 can comprise a high-pressure safety switch 637, which can protect the refrigeration system 150 against high pressures by cutting off the compressor 620 and other components when a threshold high pressure is measured.

The evaporating unit 650 can be in fluid communication with the condensing unit 610. More specifically, the evaporating unit 650 can both receive the refrigerant from the condensing unit 610 and return the refrigerant to the condensing unit 610 in a continuous loop. The evaporating unit 650 can comprise a refrigerant metering device 660 and an evaporator 670 in fluid communication with each other.

The refrigerant metering device 660 can restrict or meter flow of the high-pressure liquid refrigerant from the condenser 630. The refrigerant metering device 660 can thereby transform the refrigerant from high-pressure lower temperature liquid to a low-pressure and low temperature liquid. In some aspects, the refrigerant metering device 660 can be a thermostatic expansion valve, sometimes referred to as a TXV or TEV. The TXV can be configured to dynamically adjust an orifice defined therein based on operation of the system and thereby adjust flow of the refrigerant through the TXV. More specifically, the TXV can be configured to accomplish such adjustment by placement of a bulb of the TXV on a suction line of the refrigeration system 150 (i.e., a section of the tubing 605 between the evaporator 670 and the compressor 620) and, in the process of sensing a temperature of the suction line with the bulb, causing a gas inside the bulb to effect opening and closing and, more generally, adjustment of the orifice. In some aspects, the refrigerant metering device 660 can be a capillary tube, which can define an internal diameter of, for example and without limitation, between 1.0 and 1.5 mm; and a length of, for example and without limitation, between 2000 and 2500 mm. While lacking certain features of the TXV, an inner diameter and length of the capillary tube can be set when building the refrigeration system 150 to sufficiently transform the properties of the refrigerant by the time the refrigerant enters the evaporator 670. In some aspects, the refrigeration system can comprise a suction line heat exchanger 665. More specifically, the refrigerant metering device 660, at least in the form of a capillary tube, can be brought within mating contact with the suction line over a length of each of the refrigerant metering device 660 and the suction line and thereby facilitate vaporization of any refrigerant in the suction line still in a liquid state after passage through the evaporator 670. The suction line heat exchanger 665 can protect the compressor 620 against "flooding" of the compressor with liquid refrigerant and in general can improve cooling performance of the refrigeration system 150.

More specifically, the evaporator 670 can comprise tubing such as the tubing 605, which can be routed as desired, including in a serpentine fashion, to increase a surface area of the evaporator 670 exposed to air flow and can by its shape and material facilitate heat transfer. In some aspects, the evaporator 670 can further comprise fins, which can be coupled to the tubing and can further increase the surface area of the evaporator 670 exposed to the air flow and can by its shape and material facilitate heat transfer.

The evaporating unit 650 can further comprise one or more evaporator fans 680, which can be configured to move air across the evaporator 670. Each of the evaporator fans 680 can comprise a motor, a shaft coupled to the motor, and a fan blade coupled to the shaft. Each of the evaporator fans 680 can be configured to drive or blow air past or through the evaporator 670 to absorb heat therefrom (i.e., the evaporator 670 can be configured to absorb heat from the air passing through the evaporator 670). As the evaporator 670 is cooled by air driven by the evaporator fans 680, the evaporator 670 can transform the refrigerant therein from a low-pressure low-temperature gas to a low-pressure higher-temperature gas, thereby evaporating the refrigerant. In some aspects, the evaporating unit 650 can be configured to supply cool air to an air plenum system of the appliance 100, which can be configured to cool the appliance 100. The air plenum system can comprise any of the cavities described elsewhere herein and configured to receive air flow.

The evaporating unit 650 can comprise a defrost thermistor or sensor 632 (shown in FIG. 6B), which can facilitate defrost of the evaporator 670 and thereby protect the refrigeration system 150 against the consequences of ice and/or frost on the evaporator 670, which can block air flow across the evaporator 670 and adversely impact heat transfer. The defrost thermistor 632 can come with the controller 272 and can be as specified from Danfoss A/S (e.g., Part No. 077F 08790). The evaporating unit 650 can comprise a defrost heater 634, which can protect the refrigeration system 150 against ice and/or frost on the evaporator 670 by applying heat to the evaporator 670 when a defrost cycle is initiated. More specifically, the defrost heater 634 can be an electric heater and can use conduction and/or radiation to apply heat to the evaporator 670. The evaporating unit 650 can comprise a defrost safety thermostat 636, which can protect the evaporator 670 and, more generally, the appliance 100 against overheating by prolonged operation of the defrost heater 634 that is not otherwise terminated. The evaporating unit 650 can comprise a drain collection device 638 (shown in FIG. 9A), which can further protect the refrigeration system 150 against ice and/or frost by directing moisture away from the evaporator 670 and from the evaporating unit 650 and can itself be heated as desired to protect against ice and/or frost on the drain collection device 638. In some aspects, the drain collection device 638 can be or can comprise a tray or pan.

Figure 6B:
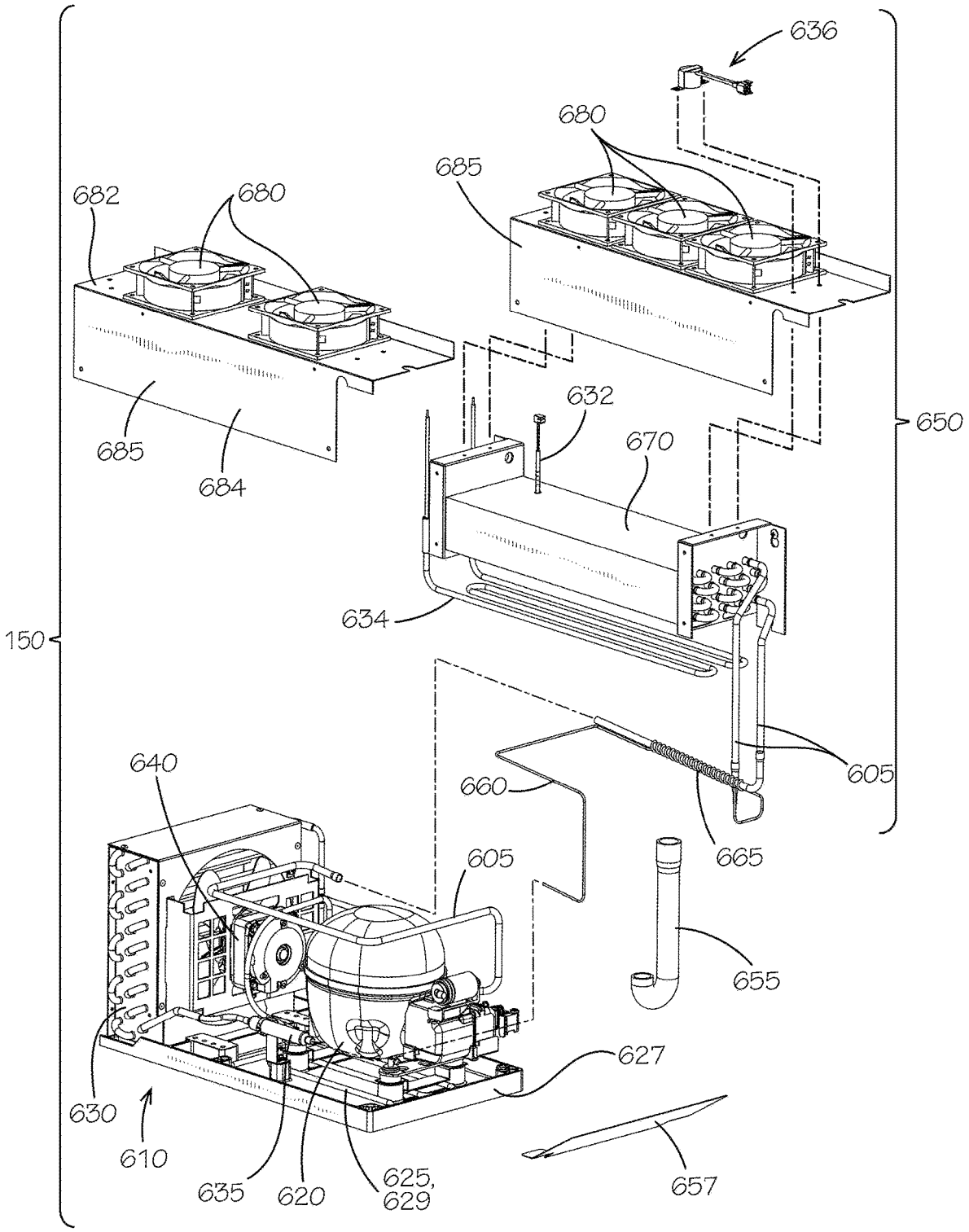
FIG. 6B is a perspective view of the refrigeration system of FIG. 6A.

FIG. 6B is a perspective view of the refrigeration system 150 of FIG. 6A. The condensing unit 610 can comprise the aforementioned components including the compressor 620 and the condenser 630. As shown, the condensing unit 610 can further comprise a condensate evaporating system 625. The condensate evaporating system 625 can comprise a collection device 627 configured to hold liquid condensate drawn from the evaporating unit 650. As shown, a drain tube 655 can capture the liquid condensate and direct same to the collection device 627 of the condensate evaporating system 625. In some aspects, a guide 657 can be secured to one of the condensing unit 610 and a surrounding structure of the refrigeration system 150 or, more generally, the appliance 100. The guide 657 can direct liquid condensate from the drain tube 655 to the collection device 627. In some aspects, the condensate evaporating system 625 can comprise a heating element 629. In some aspects, the heating element 629 can be a portion of the tubing 605 that is positioned between the compressor 620 and the condenser 630 and is filled with high-temperature gas during normal operation. In some aspects, the heating element 629 can be an electric heater or other heater. The heating element 629 can be received into the collection device 627.

In some aspects, the components of the condensing unit 610 can be assembled separately in a modular fashion, and the condensing unit 610 can be installed as an assembly. The condensing unit 610 for smaller versions of the appliance 100 such as, for example and without limitation, a one-section appliance 100 defining a width W (shown in FIG. 10) of 46 inches and a two-section appliance 100 defining a width W of 60 inches can be Model UM03130U having a compressor capacity of approximately ⅓ horsepower and a heat rejection capacity of 800 BTU/hour or more; and the condensing unit 610 for larger versions of the appliance 100 such as, for example and without limitation, a two-section appliance 100 defining a width W of 67 inches and a three-section appliance 100 defining a width W of 93 inches can be Model EMC3134U having a compressor capacity of approximately ½ horsepower and a heat rejection capacity of 900 to 1,000 BTU/hour or more, both products being available from Embraco LLC and/or Embraco North America of Duluth, Georgia, U.S.A.

The evaporating unit 650 can comprise an evaporator shroud 685, which can be configured to position and support the evaporator fans 680 and can direct air through the evaporator 670. More specifically, the evaporator shroud 685 can comprise a first panel 682, to which the evaporator fans 680 can be secured and which can define matching openings (not shown) therein for passage of air through the evaporator fans 680. The evaporator shroud 685 can comprise a second panel 684, which can fit close to or even flush with a side of the evaporator to prevent short cycling of air around the evaporator and/or contain heat applied to the evaporator 670 during a defrost cycle. A quantity of evaporator fans 680 can vary based on the air flow needed through the evaporator 670. For example and without limitation, the one-section appliance 100 defining a width W (shown in FIG. 10) of 46 inches and the two-section appliance 100 defining a width W of 60 inches can comprise a pair of evaporator fans 680; and the two-section appliance 100 defining a width W of 67 inches and the three-section appliance 100 defining a width W of 93 inches can comprise three evaporator fans 680. Each of the evaporator fans 680 can be sized based on the size of the appliance 100 but in some aspects can deliver at least or approximately 106 CFM. Each of the evaporator fans 680 can be a Model UF12A-series alternating current (AC) product measuring 120 mm square and 38 mm thick and available from Mechatronics Fan Group of Preston, Washington, U.S.A. Various fasteners (not shown) can assemble the components of the condensing unit 610 and the evaporating unit 650 together and to each other.

Figure 1C:
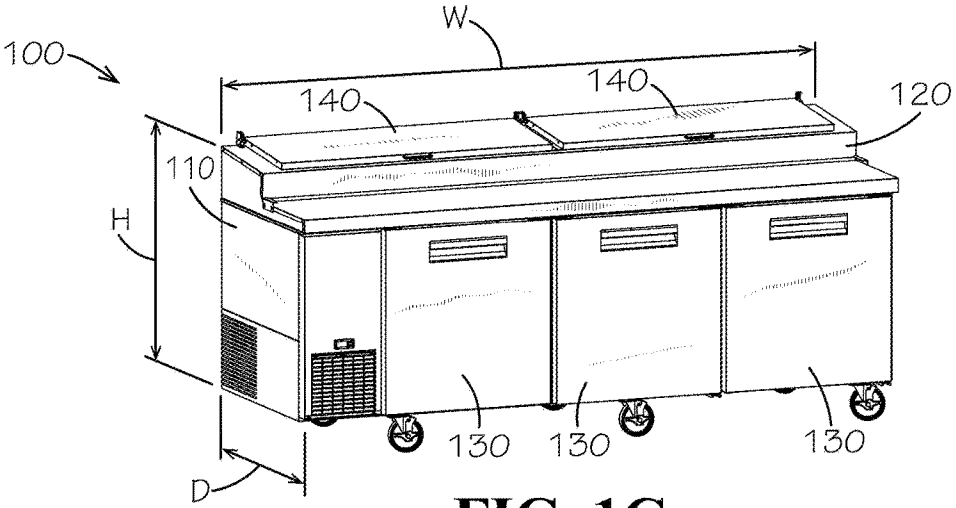
FIG. 1C is a perspective view of a three-section refrigerated preparation table appliance with a raised rail in accordance with another aspect of the current disclosure.
Figure 7:
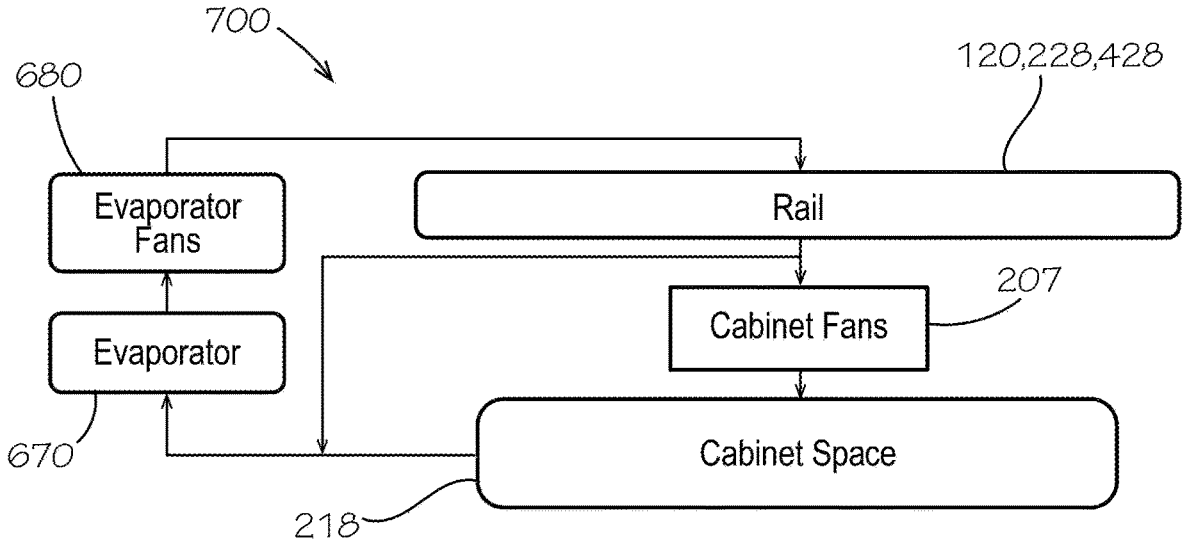
FIG. 7 is a schematic view of an airflow circuit of any of the appliances of FIGS. 1A-1C.

FIG. 7 is a schematic view of an airflow circuit 700 of any of the appliances 100 of FIGS. 1A-1C. As shown, air can be pulled from the base cavity 218 of the cabinet or base 110. The air can then be pulled through the evaporator 670 and through the evaporator fans 680 by the evaporator fans 680. The air can then be pulled through the rail cavity 228 and, more specifically, the pan storage cavity 428 defined by the rail 120. The air can then be also pulled from the rail 120 through the one or more cabinet fan assemblies 207 by the cabinet fan assemblies 207 into the base cavity 218 or can bypass the base cavity 218 and return to the evaporator 670. In some aspects, as shown, the evaporator fans 680 can be positioned above or on an outlet side of the evaporator 670 and can pull air through the evaporator 670. In some aspects, the evaporator fans 680 can be positioned below or on an inlet side of the evaporator 670 and can push air through the evaporator 670.

Figure 8:
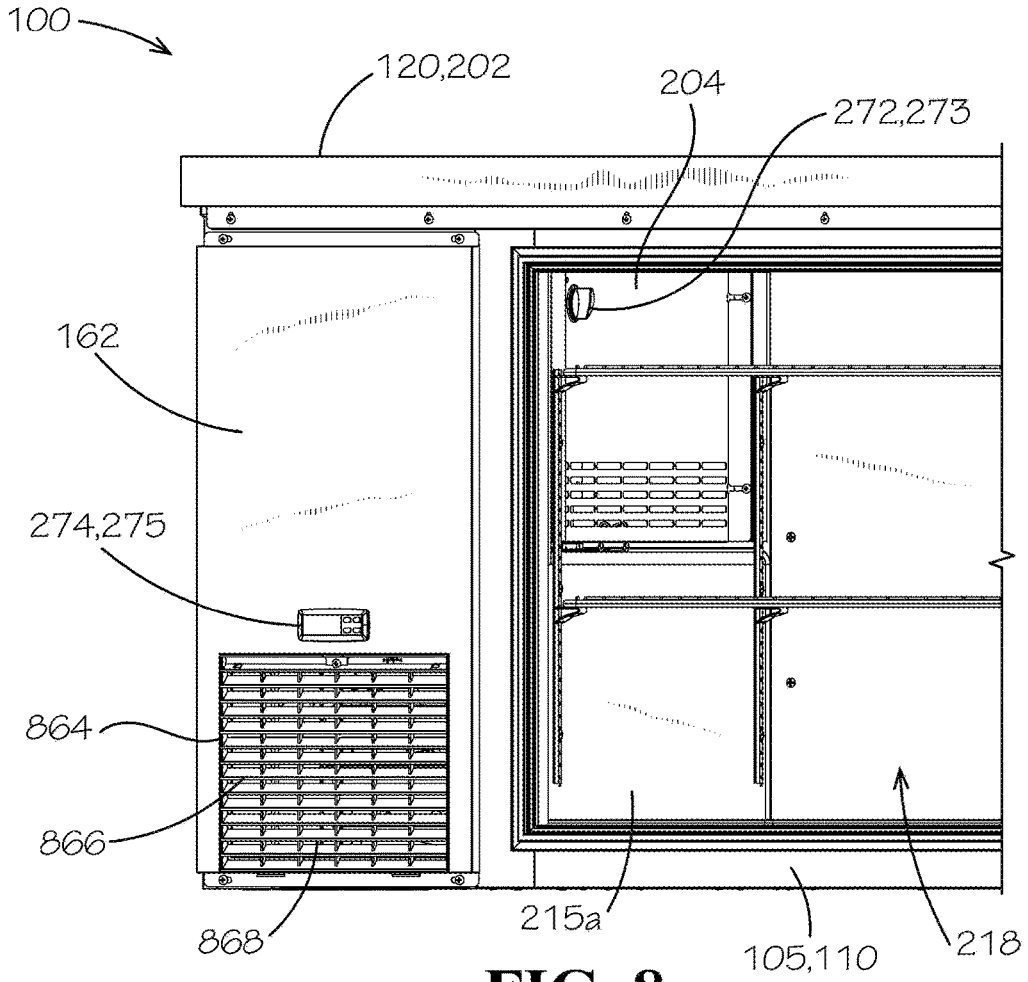
FIG. 8 is a detail front perspective view of a left side of a cabinet base of any of the appliances of FIGS. 1A-1C showing a primary controller configured to control an air temperature of the rail and a secondary controller configured to control an air temperature of an interior cavity of the cabinet.

FIG. 8 is a detail front perspective view of a left side of the cabinet 105 of any of the appliances 100 of FIGS. 1A-1C showing the control interface 273 of the primary controller 272 and the control interface 275 of the secondary controller 274. The control interface 273 of the primary controller 272 can be configured to control an air temperature of the rail portion 203 (shown in FIG. 2C) of the rail 120; and the control interface 275 of the secondary controller 274 can be configured to control an air temperature of an interior cavity such as the base cavity 218 of the base 110. In some aspects, as shown, the control interface 273 can comprise a dial control. In some aspects, the primary controller 272 can be a Model ERC113C-series product from Danfoss A/S of Nordborg, Denmark. In some aspects, the primary controller 272 can control operation of the compressor 620, the defrost system, the evaporator fans 680, and switching between "day" mode and "night" mode discussed below. In some aspects, the secondary controller 274 can be a Model E31B-series product from Ascon Technologic S.r.L. of Vigevano, Italy. In some aspects, the secondary controller 274 can control operation of the cabinet fans 1010.

The front access panel 162 can comprise an air inlet opening 868, through which the condenser fan 640 (shown in FIG. 6B) can draw air across the condenser 630 (shown in FIG. 6B). In some aspects, the air inlet opening 868 can be defined and/or covered by a grill 864. More specifically, the grill 864 can comprise a filter 866, which can be washable and/or replaceable with or without tools, depending on user requirements.

Figure 9A:
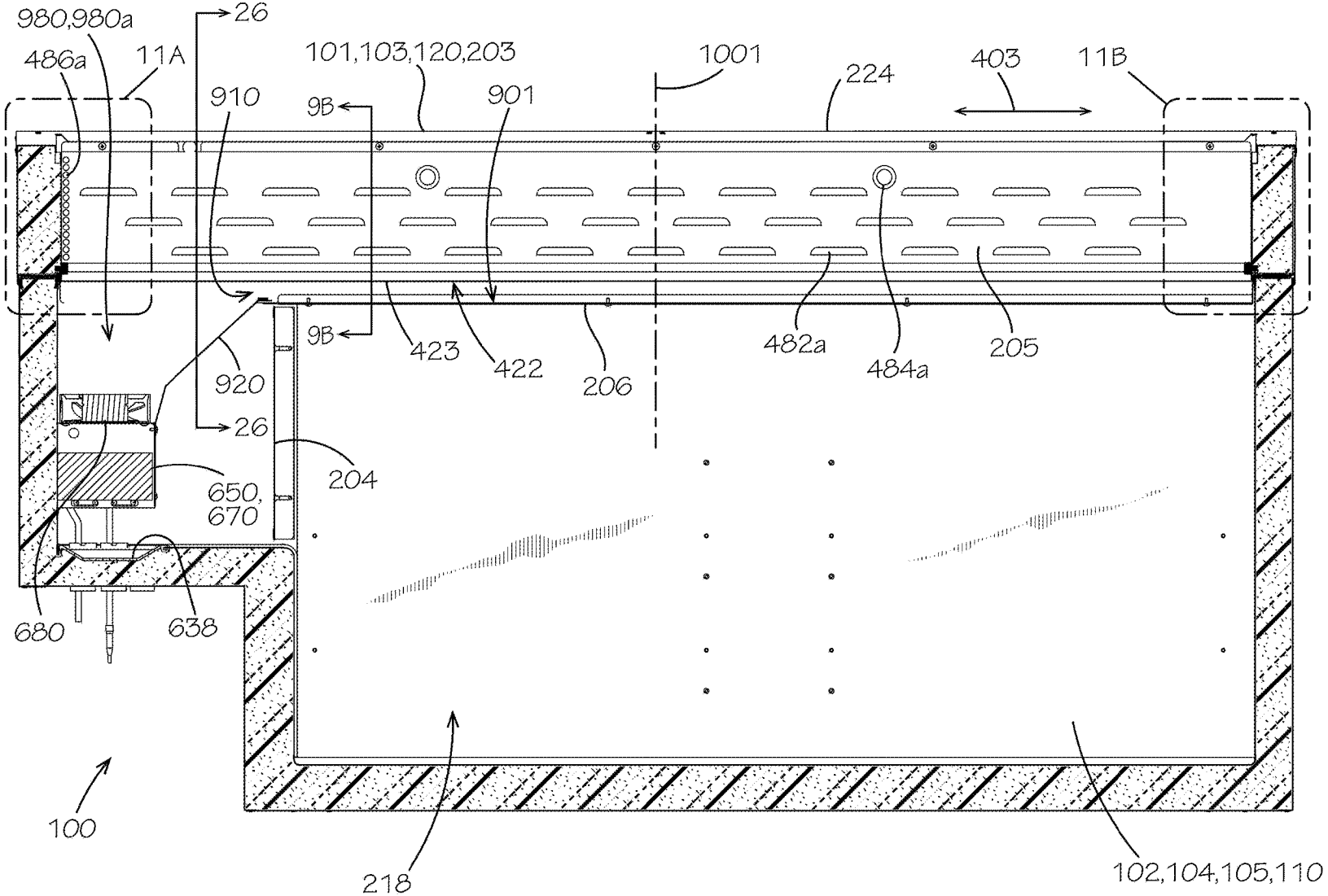
FIG. 9A is a sectional view of the appliance of FIG. 1B taken along line 9A-9A of FIG. 2C.
Figure 9B:
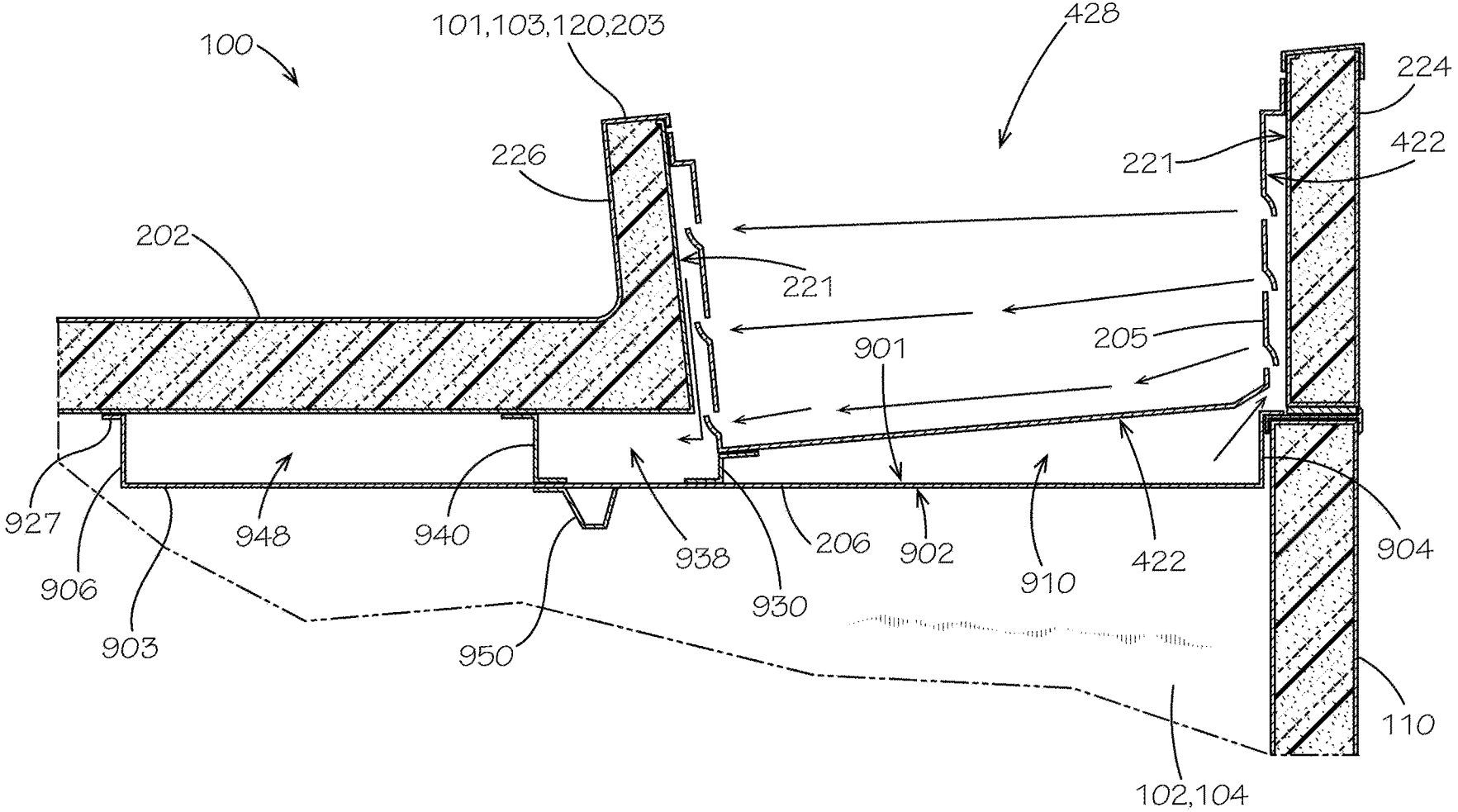
FIG. 9B is a detail sectional view of the appliance of FIG. 1B similar to that taken from detail 10B of FIG. 2C but taken along line 9B-9B of FIG. 2A and, as an alternate reference, along line 9B-9B of FIG. 9A in accordance with another aspect of the current disclosure and showing only geometry in the cut plane.

FIG. 9A is a sectional view of the appliance of FIG. 1B taken along line 9A-9A of FIG. 2B, and FIG. 9B is a detail sectional view of the appliance 100 of FIG. 1B similar to that taken from detail 10B of FIG. 2C but taken along line 9B-9B of FIG. 2A and, as an alternate reference, along line 9B-9B of FIG. 9A in accordance with another aspect of the current disclosure and showing only geometry in the cut plane. As will be described in further detail below, airflow alone through the appliance 100 and, more specifically, the first refrigerated portion 101 can distribute cold air throughout the pan storage cavity 428 and around each pan 510 (shown in FIG. 5A) and can properly maintain air and product temperatures throughout the first refrigerated portion 101.

The appliance 100 need not use "cold wall" construction to cool the rail portion 203 of the rail 120 properly as in appliances that are typically available. As such, the rail 120 and associated structures can define a non-cold-wall construction, which means that no walls of the first refrigerated compartment or first insulated enclosure 103 nor pan dividers nor ducts between adjacent pans 510 that are configured to be received within the pan storage cavity 428 contain any refrigerated tubing. In an appliance defining "cold wall" construction, either refrigerant or glycol is typically circulated through tubes, which are typically formed from copper and embedded inside the walls of the rail. Rails of such units typically have separate evaporators and sometimes have separate and distinct refrigeration circuits. In contrast, the appliance 100 need comprise only a single refrigeration system 150 and need comprise only a single evaporator 670 together with the one or more cabinet fan assemblies 207, which can be configured to regulate cooling of the cabinet through an air plenum on an as-needed basis. Such a construction can be significantly more expensive to build and less serviceable than the structures and methods disclosed herein.

Among designs by others using an air-cooled method, air is typically forced from the rail into the cabinet through an open duct regardless of cooling need (i.e., with no dynamic control), which can lead to food product freezing in a cabinet that ordinarily should be maintained above freezing temperatures. In addition, the rail ducts are typically fixed, i.e., not removable, which is an obstacle to regular and/or thorough cleaning. Using one or more of the improvements disclosed herein, however, the rail and cabinet temperatures can be adjusted and controlled automatically and independently.

The appliance 100 and, more specifically, the first refrigerated portion 101 (which can be defined at least in part by the rail 120) and the second refrigerated portion 102 (which can be defined at least in part by the base 110) can define an intake air cavity 910 therebetween. More specifically, the intake air cavity 910 can be defined between a top surface 901 of the roof duct 206 and the outward-facing surface 422 defined by the bottom wall 423 of the rail duct 205. The roof duct 206 can further define a bottom surface 902. The intake air cavity 910 can be further defined between the interior surface 221 (shown in FIG. 9B) of the rear wall 224 (shown also in FIG. 9B) of the first refrigerated compartment 103 and the outward-facing surface 422 defined by the rear wall 424 of the rail duct 205. As shown, the intake air cavity 910 can be in fluid communication with an evaporator cavity 980, which can be defined by the base 110 of the cabinet 105 and can house the evaporating unit 650 (shown in FIG. 6A) of the refrigeration system 150 (shown in FIG. 6A) and can be configured to receive air supplied by the evaporating unit 650. An inlet duct 920 can separate a supply side 980*a* of the evaporator cavity 980 from a return side 980*b* of the evaporator cavity 980. The return air duct 204 can separate the evaporator cavity 980 from the base cavity 218.

As shown in FIG. 9B, a rail inlet divider or first divider 930 of the rail 120 and, more generally, the appliance 100 can separate the intake air cavity 910 from a communication air cavity 938 configured to receive air that has circulated already through the first refrigerated compartment 103, which can be defined by the rail 120. More specifically, the first divider 930 can separate the intake air cavity 910 from the communication air cavity 938 along an entire length of the roof duct 206. The roof duct 206 itself can comprise a bottom panel 903, a rear panel 904, a front panel 906, and side panels 905*a,b* (shown in FIG. 10A).

Figure 12B:
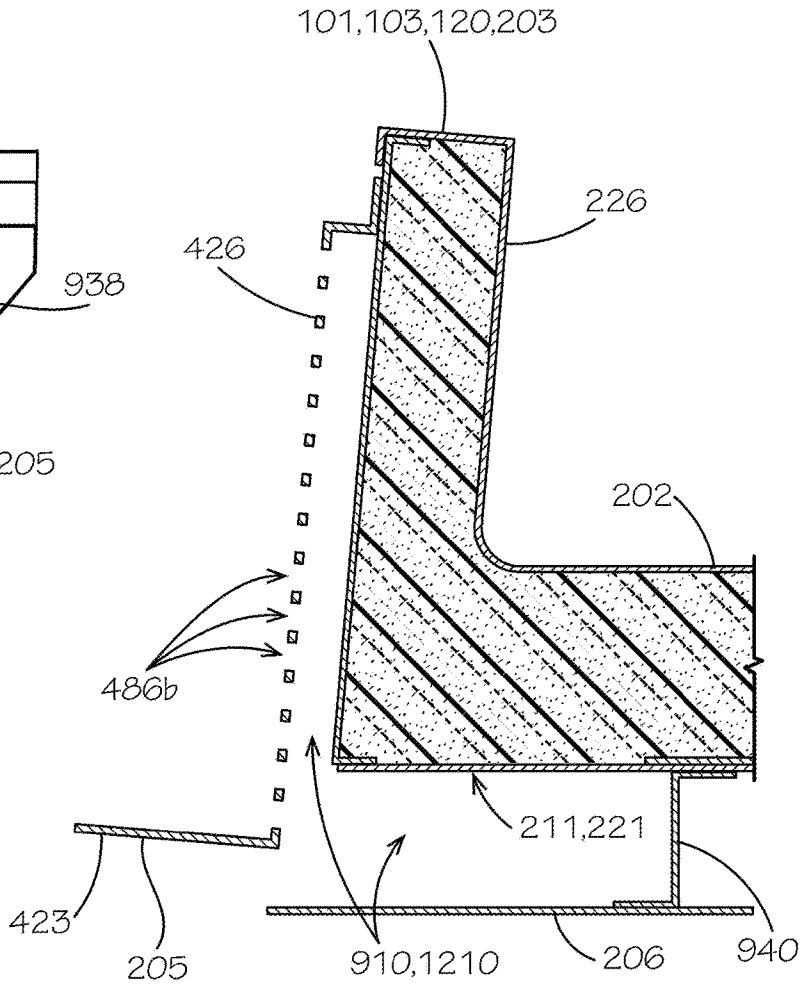
FIG. 12B is a detail sectional view of the left end of the raised rail of the appliance of FIG. 1B taken along line 12B-12B of FIG. 12A.
Figure 12A:
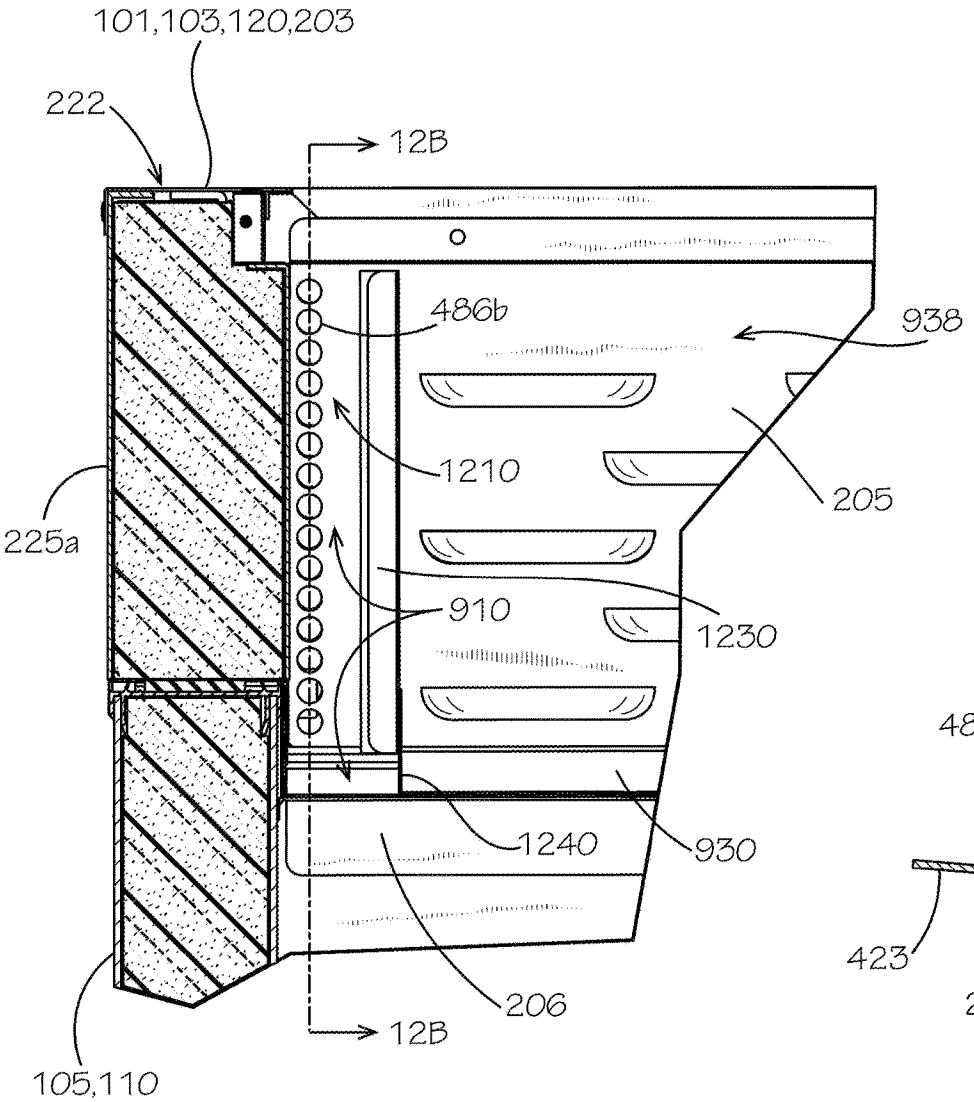
FIG. 12A is a detail sectional view of the left end of the raised rail of the appliance of FIG. 1B taken along line 12A-12A of FIG. 2C.

With the first divider 930 positioned as shown and sealing a gap between the rail duct 205 and the roof duct 206, air circulating from the evaporator cavity 980 into the intake air cavity 910 can be encouraged, with the exception of geometry shown in FIGS. 12A and 12B where cooling needs indicate, to continue in the longitudinal direction 403 of the rail duct 205 (shown in FIG. 9A) down a length of the first refrigerated compartment 103. Along the way and upon reaching the far end of the intake air cavity 910 distal from the evaporator cavity 980, the intake air cavity 910 can naturally direct all air to the rear and up between the rear wall 424 of the rail duct 205 and the rear wall 224 of the rail 120. The rail duct 205 can then be configured to receive such cool air through the openings 480*a* such as, for example and without limitation, one or more of the air transmission openings 482*a*, the handle openings 484*a*, and the supplemental openings 486*a* defined in the rear wall 424 for cooling of the first refrigerated compartment 103. Thus, below the rail duct 205, the intake air cavity 910 can be an air plenum and can be configured to pressurize the air from the evaporator cavity 980 and evenly distribute the air throughout the first refrigerated compartment 103, which again can be defined by the rail 120.

The air can flow through the openings 480*a* and, in one corner of the rail due to geometric considerations, can flow through the supplemental openings 486*b* shown in FIGS. 12A and 12B and then into the rail cavity 228. The air can circulate through the rail cavity 228 and around the plurality of pans 510 (shown in FIG. 5A) positioned therein. The air can then flow through the openings 480*b* and into the communication air cavity 938 in a direction towards the base cavity 218. Again, the openings 480*a,b* can be sized and positioned to evenly distribute air in the pan storage cavity 428 such that each pan 510 receives a similar amount of air flow and can be maintained at temperatures that are within a predetermined range.

The properties (e.g., size, locations, and quantities) of the openings 480, including supplemental openings 486*a*, can be defined in the rail duct 205 as shown to facilitate maintenance of proper temperatures inside the first refrigerated compartment 103 of the first refrigerated portion 101, which can be defined by the rail 120. These properties can and were optimized based on simulation of various structures using manufacturing considerations (e.g., the availability of standard tooling), simulation (e.g., computational fluid mechanics or CFM), and actual testing of the appliance. Various other exemplary dimensions and characteristics of the appliance 100 were based at least in part on spatial constraints (e.g., dimensions of both the base 110 and the rail 120 being based at least in part on the size of fractional hotel pans 510 shown in FIG. 5A, a height of the roof duct 206 being based on at least in part on a thickness or height of a cabinet fan 1010 shown in FIG. 10B, and various other dimensions based on customer requirements and supplier part specifications).

The combination of openings 480 can be optimized for each size model and as disclosed herein are based on conditions set by NSF/ANSI (National Sanitation Foundation/American National Standards Institute) Standard 7 for Commercial Refrigerators and Freezers, which specifies in part four-inch-deep half-size pans containing a simulated food material (a special methylcellulose mixture) and an ambient temperature of 86° F. (30° C.). Under the NSF/ANSI Standard 7 test conditions, temperatures measured at certain points inside the pans 510 (shown in FIG. 5A) must remain within a range of 0.6° C. to 5.0° C. over a full four-hour testing period, and lagged temperatures (i.e., temperatures measured by thermocouples placed inside special weighted lags) placed in precise locations inside the base cavity 218 must remain within a range of 0° C. to 4.4° C. over the same testing period.

In different operating conditions (e.g., deeper pans, a different ambient temperature, air circulation inside room, and/or properties of actual food product stored in the appliance 100 and, more specifically, the rail 120) and even under otherwise compliant NSF/ANSI Standard 7 test conditions, a different combination of openings and other settings can be sufficient to main temperatures at levels satisfactory to a user of the appliance 100 in the different operating conditions. Moreover, other dimensions of the appliance 100 including the size and position of the rail duct 205 and, more generally, the configuration of the rail 120 and various ducting components are similarly optimized based on conditions generally set by NSF/ANSI Standard 7 but can generally also be modified based on different operating conditions. To the degree that not a single range of conditions is neither required nor present in actual use of the appliance 100, and to the degree that NSF/ANSI Standard 7 conditions are more exacting than some users require, various combinations are conceivable where user requirements allow for different conditions; and the combinations shown are therefore intended to be exemplary. In some aspects, the modifications that would be appropriate for a change in conditions will be understood by one who is skilled in the art. In some aspects, the appliance 100 can comply with the safety requirements—particular electrical safety requirements—of UL 471 for Commercial Refrigerators and Freezers.

Across at least a portion of the roof duct 206, a return divider or second divider 940 of the rail 120 and, more generally, the appliance 100 can separate the communication air cavity 938 from a return air cavity 948 and can thereby discourage or prevent "short cycling" of air that has circulated into and out of the pan storage cavity 428 through the rail duct 205. Instead, such air can be directed by the second divider 940 towards the one or more cabinet fan assemblies 207. Depending on the cooling needs of the base 110 and the base cavity 218, the air can then circulate through the base cavity 218 and can then return to the evaporator cavity 980, or the air can bypass the base cavity 218 and return directly to the evaporator cavity 980. A conduit 950 can house at least a portion of wiring extending from the cabinet fan assemblies 207 to the controls system 270 (shown in FIG. 2A) and through the base cavity 218. More specifically, the conduit 950 can define a closed shape after assembly and can define one or more panels, which can be angled with respect to each other.

FIG. 10A is a sectional view of the appliance 100 of FIG. 1B taken along line 10A-10A of FIG. 2B. As shown, the second divider 940 can extend partly across the roof duct 206 in the longitudinal direction 403 and, more generally, the cabinet 105, to reduce or prevent short cycling air that has already passed through the pan storage cavity 428 (shown in FIG. 9B) and is on its way toward the base cavity 218. In some aspects, more specifically, the second divider 940 can extend up to the first cabinet fan assembly 207 to ensure that air that has already passed through the pan storage cavity 428 closer to the evaporator cavity 980 is available to the cabinet fan assembly 207 closest to the evaporator cavity 980. In some aspects, one or more supplemental dividers 940*a,b* can be shaped similarly as the second divider 940 and can be secure a portion of the roof duct 206 to at least one of the interior surfaces 211,221. Between the one or more supplemental dividers 940*a,b* and between the one or more supplemental dividers 940*a,b* and the second divider 940, air can freely flow from the communication air cavity 938 to the return air cavity 948. Various fasteners (not shown) can assemble the dividers 930,940 to surrounding structures such as the roof duct 206. In some aspects, the dividers 930,940 can be welded (e.g., with spot welds) to the roof duct 206. In some aspects, a strip of insulation or a gasket material can be positioned on top of either of the dividers 930,940 and the mating structure to reduce or prevent air leakage through the connection.

FIG. 10B is a detail sectional view of the appliance 100 of FIG. 1B taken from detail 10B of FIG. 2C but taken along line 9B-9B of FIG. 1B and, as an alternate reference, along line 10B-10B of FIG. 10A in accordance with another aspect of the current disclosure and showing only geometry in the cut plane. As shown, the air that has already passed through the pan storage cavity 428 can also be freely received, as cooling needs dictate, into a cabinet opening 1080 defined in the roof duct 206 and through the cabinet fan 1010 of the cabinet fan assembly 207. The cabinet fan 1010 of each cabinet fan assembly 207 can be controlled by a separate thermostat such as a cabinet thermistor 1540 (shown in FIG. 15) in communication the secondary controller 274 (shown in FIG. 2A) or by a second temperature sensor (e.g., cabinet thermistor 1540) extending from the primary controller 272 (shown in FIG. 4B). The cabinet fan 1010 can feed cold rail air through a cabinet fan enclosure 1020, which can evenly distribute air into the base cavity 218. More specifically, the cabinet fan 1010 can feed cold rail air through openings 1028 defined in the cabinet fan enclosure 1020. A plurality of the openings 1028 can be distributed across one or more walls of the cabinet fan enclosure 1020. In some aspects, the cabinet fan enclosure 1020 can comprise a bottom wall 1023, a rear wall 1024, side walls 1025*a,b* (both shown in FIG. 10A), a front wall 1026, and one or more mounting flanges 1027. As shown, the openings 1028 can be defined in the rear wall 1024.

A quantity of cabinet fans 1010 can vary based on the air flow needed through the cabinet fan assemblies 207. For example and without limitation, the one-section appliance 100 defining a width W (shown in FIG. 10) of 46 inches and the two-section appliance 100 defining a width W of 60 inches can comprise a single cabinet fan assembly 207 comprising a single cabinet fan 1010; and the two-section appliance 100 defining a width W of 67 inches and the three-section appliance 100 defining a width W of 93 inches can comprise a pair of cabinet fan assemblies 207, each comprising a cabinet fan 1010. Each of the cabinet fans 1010 can be sized based on the characteristics of the particular appliance 100 and the conditions of use but in some aspects as shown and tested can deliver at least or approximately 21 CFM. Each of the cabinet fans 1010 can be a Model UF90DPB-series alternating current (AC) product measuring 120 mm square and 37 mm thick and available from Mechatronics Fan Group of Preston, Washington, U.S.A. Various fasteners (not shown) can assemble the components of the cabinet fan assemblies 207 together and to surrounding structures. On the unit shown, the cabinet fans 1010 can be positioned as shown. On a larger three-section unit measuring 93 inches wide, the cabinet fan 1010 can be positioned behind the divider 112 (shown in FIG. 2). In some aspects, the cabinet fan 1010 can be positioned symmetrically inside the base cavity 218. As shown, the cabinet fan 1010 can be positioned in front of the front wall 226 of the rail 120. As also shown, the cabinet fan 1010 can drive air into the base cavity 218 in a direction away from the main openings 118 and away from the closure devices 130 to reduce the risk of increased air leakage through the main openings 118.

FIG. 100 is a sectional view of the appliance 100 of FIG. 1B taken along line 100-100 of FIG. 2B. As shown in the current view taken closer to a front of the appliance 100, a divider or shroud 1030 can separate the supply side 980*a* (shown in FIG. 10A) from the return side 980*b* of the evaporator cavity 980. In some aspects, a strip of insulation or a gasket material can be positioned on top of or around some or all of a perimeter of the shroud 1030 and between the shroud 1030 and the mating structure (e.g., one or more surfaces of the evaporator cavity 980 and/or the roof duct 206) to reduce or prevent air leakage through the connection.

Figure 11B:
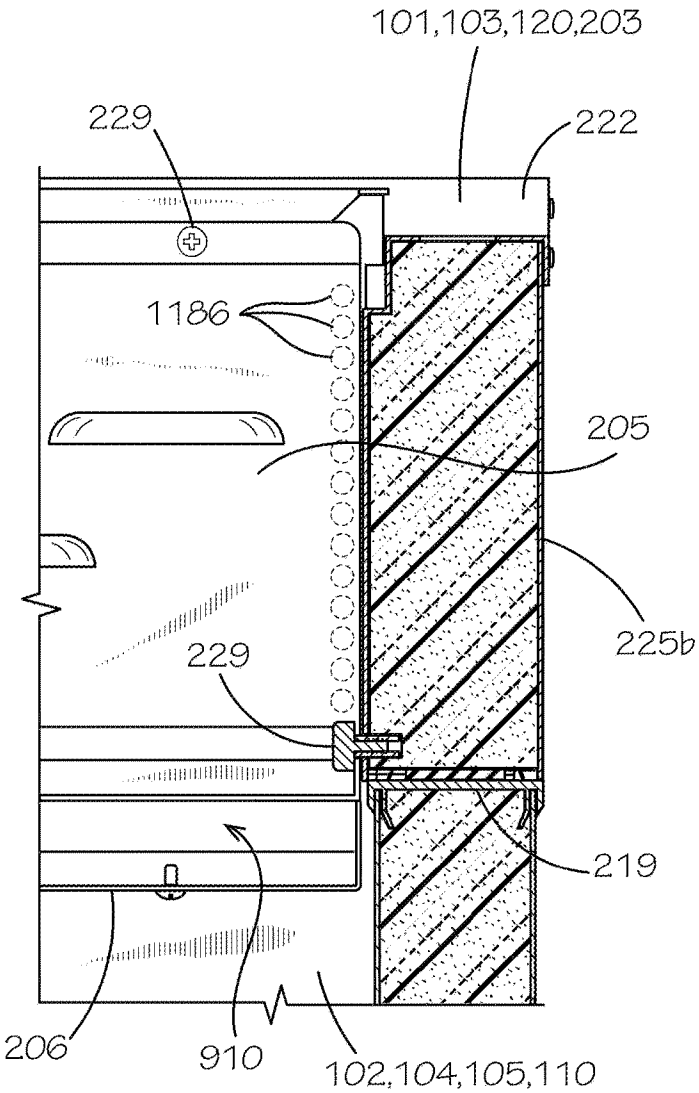
FIG. 11B is a detail sectional view of a right end of the raised rail of the appliance of FIG. 1B taken from detail 11B of FIG. 10A.
Figure 11A:
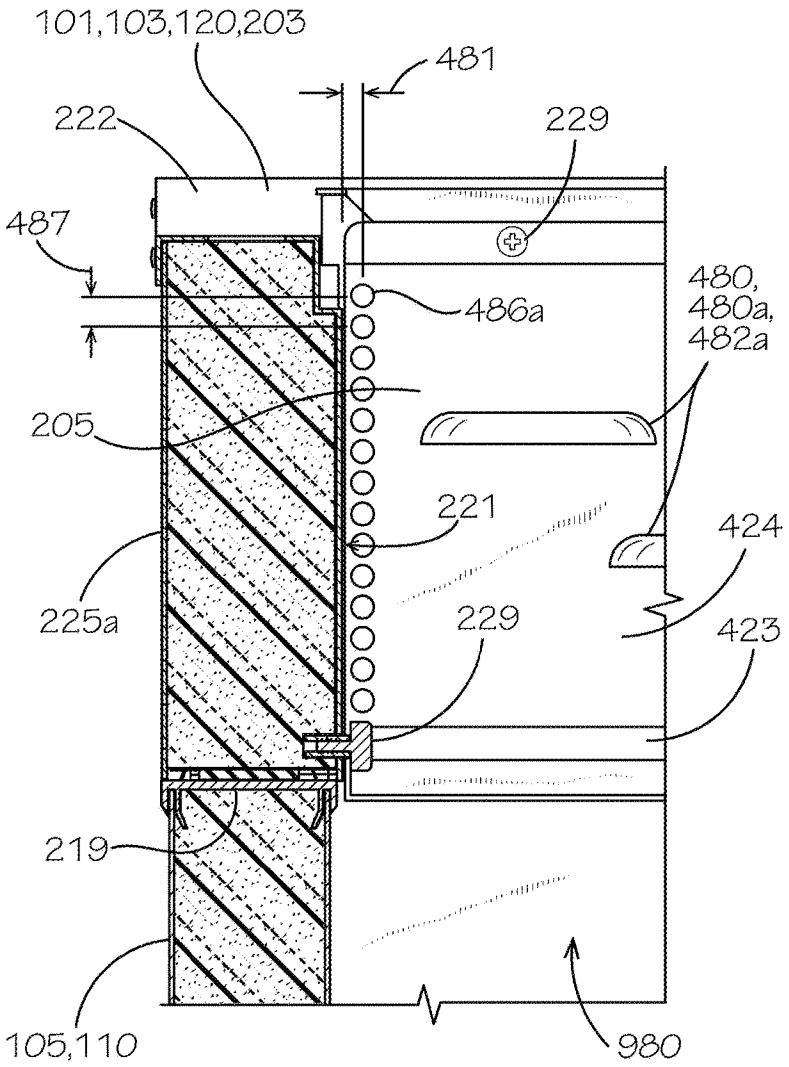
FIG. 11A is a detail sectional view of a left end of the raised rail of the appliance of FIG. 1B taken from detail 11A of FIG. 10A.

FIG. 11A is a detail sectional view of a left end of the raised rail 120 of the appliance 100 of FIG. 1B taken from detail 11A of FIG. 9A. As shown in greater detail, the thermal break 219 can comprise one or more of several sealing structures including a bellows-style compressible portion, a rigid polymer extrusion and a compressible gasket. In some aspects, the various portions of the thermal break 219 can be formed integrally as a single component. In some aspects, the various portions of the thermal break 219 can be formed as separate components. As shown, the rail duct 205 can be configured to be removable upon removal of the fasteners 229. In some aspects, a diameter D of each of the supplemental openings 486*a* can be 8 mm or at least 8 mm. In some aspects, each of the supplemental openings 486*a* can be elongated and can defined a width equal to the diameter D.

FIG. 11B is a detail sectional view of a right end of the raised rail 120 of the appliance 100 of FIG. 1B taken from detail 11B of FIG. 10A. As shown, the supplemental openings 486*a* need not be defined in every corner or surface of the rail duct 205 where supplemental cooling is not necessary to maintain the target conditions during use. In some aspects, the supplemental openings 486*a* or other openings 480 can be added or removed (or covered) at opening positions 1186 to facilitate cooling under different conditions (for example, by creating a full set of the supplemental openings 486*a* at each of the opening positions 1186, leaving open certain openings by default and simply covering up the rest, but not permanently).

FIG. 12A is a detail sectional view of the left end of the raised rail 120 of the appliance 100 of FIG. 1B taken along line 12A-12A of FIG. 2C. Facing towards the rear from inside a vertical leg or vertical portion of the communication air cavity 938 (shown in FIG. 12B), a divider 1230 can define a corner intake air cavity 1210, which can be present in only a left front corner of the first refrigerated portion 101 to facilitate cooling there. More specifically, the divider 1230 can separate the intake air cavity 910 from the communication air cavity 938. Otherwise, the intake air cavity 910 can be defined only under and behind the rail duct 205. In addition, at the corner shown in FIG. 12A the first divider 930 can be not present, and it can terminate in the longitudinal direction proximate to or at a position of the divider 1230 as shown and can at that same position block passage of air into the communication air cavity 938 proximate to the first divider 930 and the roof duct 206. In some aspects, a separate divider 1240 can extend from the front to the rear and can separate the corner intake air cavity 1210 from the communication air cavity 938.

FIG. 12B is a detail sectional view of the left end of the raised rail 120 of the appliance 100 of FIG. 1B taken along line 12B-12B of FIG. 12A. The dimensions of the corner intake air cavity 1210 of the intake air cavity 910 as shown can be based on manufacturability considerations (e.g., existing front-to-rear placement of the second divider 940 for separate reasons) and need not be so defined for adequate performance.

Figure 13B:
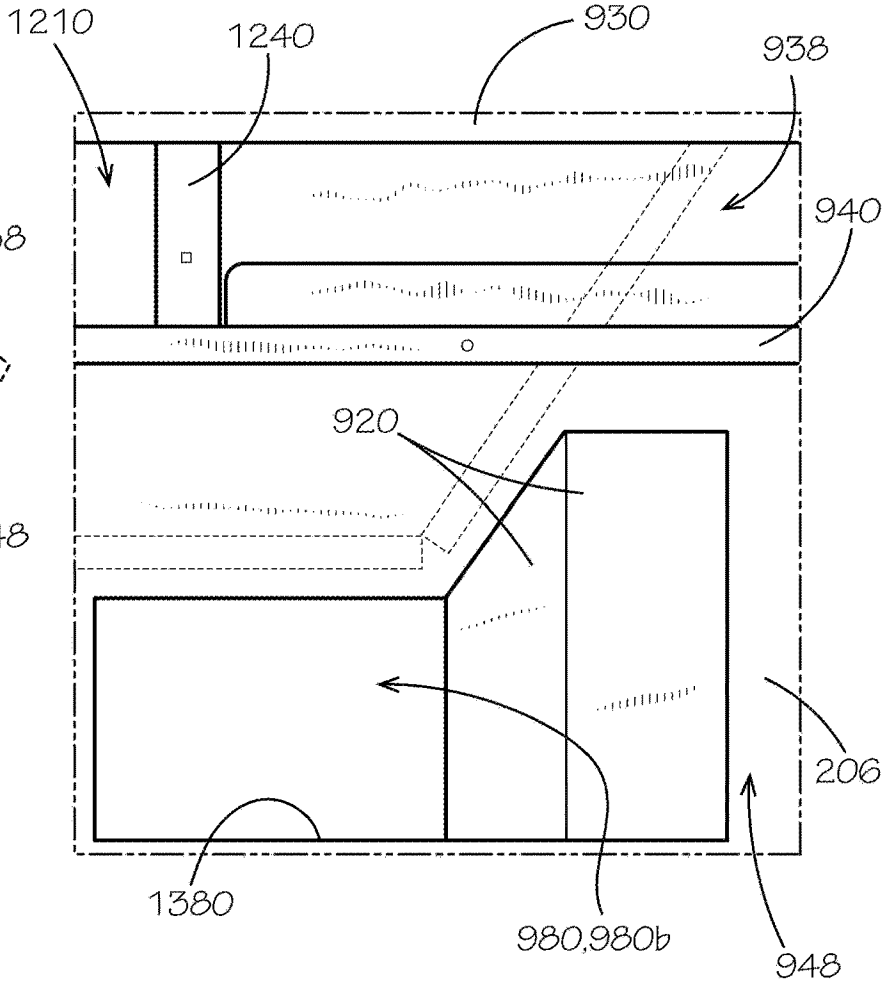
FIG. 13B is a top cutaway view of the return air opening of the left end of the cabinet of FIG. 13A with at least a portion of the worktop portion of the rail removed for clarity.
Figure 13A:
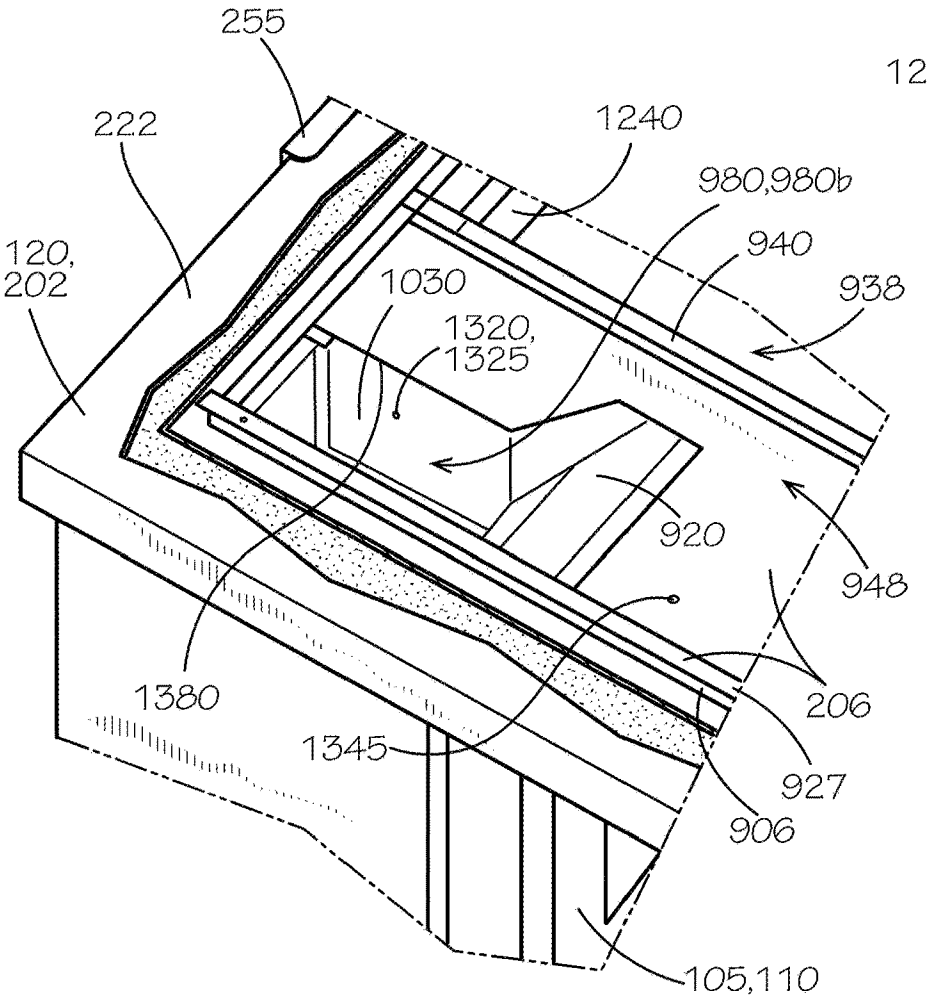
FIG. 13A is a top perspective partially cutaway view of a left end of a cabinet of the appliance of FIG. 1B with a portion of worktop portion of the rail removed for clarity.

FIG. 13A is a top perspective partially cutaway view of a left end of a cabinet 105 of the appliance 100 of FIG. 1B and FIG. 13B is a top cutaway view of the return air opening of the left end of the cabinet 105 of FIG. 13A, each with at least a portion of the worktop portion 202 of the rail 120 removed for clarity The roof duct 206 can define a return air opening 1380, which can allow passage of air from the return air cavity 948 to the evaporator cavity 980 and specifically the return side 980*b* thereof. In some aspects, the return air opening 1380 can define any polygonal or other closed shape. In some aspects, the return air opening 1380 can define a plurality of openings (e.g., slots), but fewer openings can facilitate less restriction to air flow.

A rail thermistor or rail sensor or sensor 1320, which can be a first control input or first sensor, can be mounted to the shroud 1030 in a mounting location 1325. The rail thermistor 1320 can come with the controller 272 and can be as specified from Danfoss A/S (e.g., Part No. 077F 08767). In some aspects, the rail thermistor 1320 can be mounted to any other interior structure of the return air cavity 948 or the return side 980*b* of the evaporator cavity 980. In some aspects, the rail thermistor 1320 can be mounted with a wire tie (not shown), which can be configured to firmly hold the rail thermistor 1320 and prevent it from touching any surrounding metal or other interior surface. More specifically, a barbed attachment of a mounting portion of the wire tie can be received into a hole in the mounting surface, and a securing portion of the wire tie can receive and adjustably tighten around the rail thermistor 1320. For example and without limitation, the wire tie can be P/N PLT2D-M available from Vallen Distribution. The rail thermistor 1320 can be in electrical communication with the controller 272 (shown in FIG. 4B).

The cabinet thermistor or cabinet sensor or control input or sensor 1540 (shown in FIG. 15), which can be a second control input or second sensor, can be mounted to an underside of the roof duct 206 in a mounting location 1345. The cabinet thermistor 1540 can come with the secondary controller 274 (shown in FIG. 2A) and can be as specified from Ascon Technologic S.r.L. (e.g., Part No. NTC-TPEGY-A1). In some aspects, the cabinet thermistor 1540 can be mounted to any other interior structure of the base cavity 218 that will not interfere with operation of the appliance 100. In some aspects, the cabinet thermistor 1540 can be mounted with a wire tie configured to firmly hold the cabinet thermistor 1540 and prevent it from touching any surrounding metal or other interior surface. More specifically, a barbed attachment of a mounting portion of the wire tie can be received into a hole in the mounting surface, and a securing portion of the wire tie can receive and adjustably tighten around the cabinet thermistor 1540. For example and without limitation, the wire tie can be a wire tie as noted above. The cabinet thermistor 1540 can be in electrical communication with the secondary controller 274 (shown in FIG. 2A) or, in the case of a single controller controlling both cabinet and rail air temperatures, the controller 272.

Figure 14:
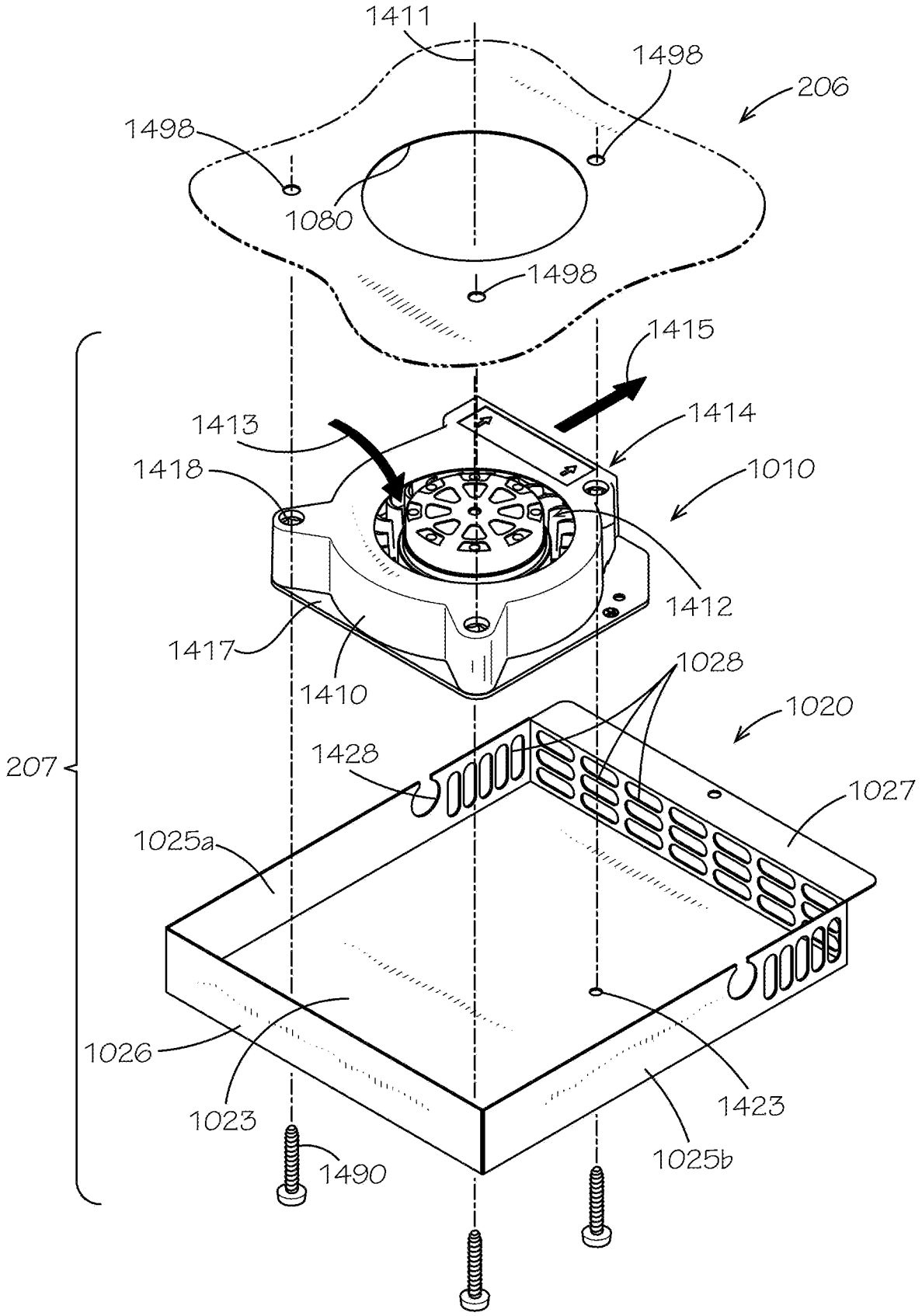
FIG. 14 is a top exploded perspective view of a cabinet fan assembly of the appliance of FIG. 1B.

FIG. 14 is a top exploded perspective view of the cabinet fan assembly 207 of the appliance 100 of FIG. 1B and can be representative of the cabinet fan assembly 207 used on any of the appliances 100 disclosed herein. The cabinet fan 1010 can comprise a body 1410, which can comprise a mounting flange 1417 and can define mounting holes 1418. The cabinet fan 1010 can define an air inlet or inlet 1412, which can be configured to receive intake air 1413 in a direction parallel to an axis 1411 of the cabinet fan 1010, i.e., in an axial direction with respect to the axis 1411. The cabinet fan 1010 can define an air outlet or outlet 1414, which can be configured to expel exhaust air 1415 in a direction perpendicular to the axis 1411, i.e., in a radial direction with respect to the axis 1411. The cabinet fan 1010 can thus be a blower fan in which the direction of air flow changes between the inlet 1412 and the outlet 1414. This arrangement can save cabinet space by interfering less with space in the base cavity 218 that could otherwise be used for storage.

The inlet 1412 of the cabinet fan 1010 can be aligned with the cabinet opening 1080 in the roof duct 206. In some aspects, as shown, the cabinet fan 1010 can be mounted to the cabinet fan enclosure 1020 and the cabinet fan enclosure 1020 can be secured to the roof duct 206. More specifically, one or more fasteners 1490 can extend through holes 1423 defined in the cabinet fan enclosure and can engage the roof duct 206 (e.g., with threaded inserts installed therein). In some aspects, as shown, the cabinet fan enclosure 1020 can further define an opening 1428 for receipt of a lead wire connecting the cabinet fan 1010 to a cabinet fan relay or switch 1810 (shown and identified in FIG. 18A as the "switch"). The cabinet fan switch 1810 can be Model AZ2280-series power relay available from American Zettler, Inc. of Aliso Viejo, California, U.S.A. More specifically, the cabinet fan switch 1810 can be a normally open single pole single throw (SPST) relay rated for 120 VAC and can be identified by Order No. AZ2280-1A-120AF. A wire bushing or strain relief fitting (not shown) can be received inside the opening 1428 and can facilitate protection of such wiring. In some aspects, the cabinet fan switch 1810 can be mounted on the return side 980*b* of the evaporator cavity 980.

Figure 15:
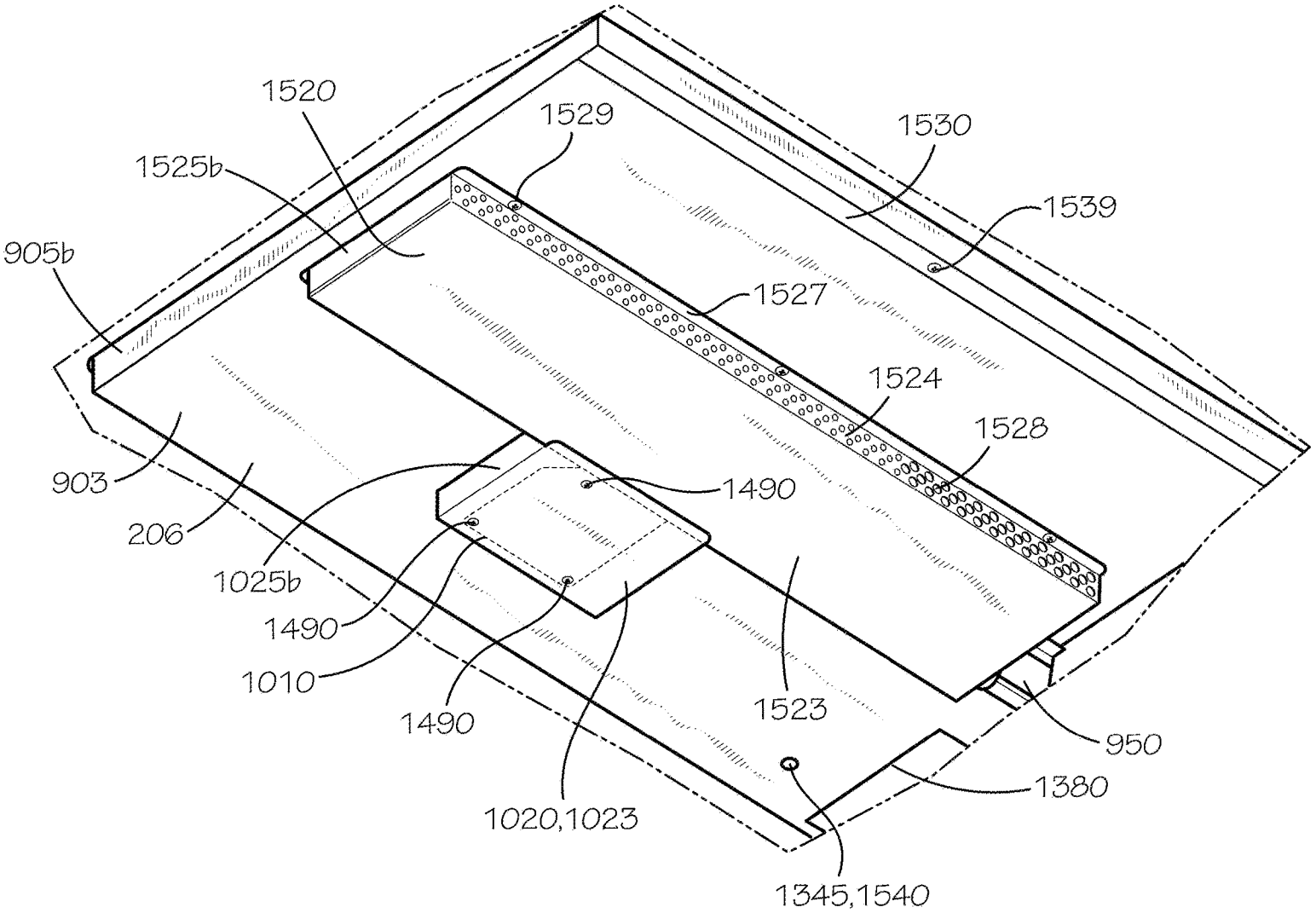
FIG. 15 is a bottom perspective view of a cabinet fan assembly of the appliance of FIG. 1A.

FIG. 15 is a bottom perspective view of the cabinet fan assembly 207 of the appliance 100 of FIG. 1A. In some aspects, including on smaller models such as that shown, a single instance of the cabinet fan assembly 207 can draw air from inside the roof duct 206, including at least in part the return air cavity 948, and can direct such air into an air distribution duct 1520. In some aspects, as shown, the air distribution duct 1520 can be separate and distinct from the cabinet fan enclosure 1020. In some aspects, the air distribution duct 1520 and the cabinet fan enclosure 1020 can be formed together and can in some aspects be monolithic in construction, with or without welding to close up any resulting gaps. The cabinet fan enclosure 1020 need not comprise the rear wall 1024 nor the openings 1028.

The air distribution duct 1520 can comprise a bottom panel 1523, a rear wall 1524, side walls 1525*a,b* (1525*a* not shown but opposite that of 1525*b*), a front wall (not shown), and one or more mounting flanges 1527. A plurality of openings 1528 can be distributed across one or more walls of the air distribution duct 1520. As shown, the openings 1528 can be defined in the rear wall 1524. The air distribution duct 1520 can be secured to the roof duct 206 or another surrounding structure of the cabinet 105 (shown in FIG. 2C) with one or more fasteners 1529.

In some aspects, the roof duct 206 can be received within and supported by a bracket 1530, which can be secured to a portion of the cabinet 105 proximate to the rear wall 214 of the base 110 and/or the rear wall 224 of the rail 120. In some aspects, the roof duct 206 can be directly secured to and supported by the cabinet 105 without the bracket 1530. In some aspects, the bracket 1530 can define a C-shape in cross-section. In some aspects, the bracket 1530 can define a Z-shape in cross-section, where the Z-shape can be interpreted loosely as comprising a main panel with two legs extending at approximately 90 degrees to the vertical panel and in opposite directions from each other (as can be the case for the divider 940, as shown in FIGS. 9B and 12B). The roof duct 206 can be secured to the bracket 1530 with a fastener 1539.

Figure 16A:
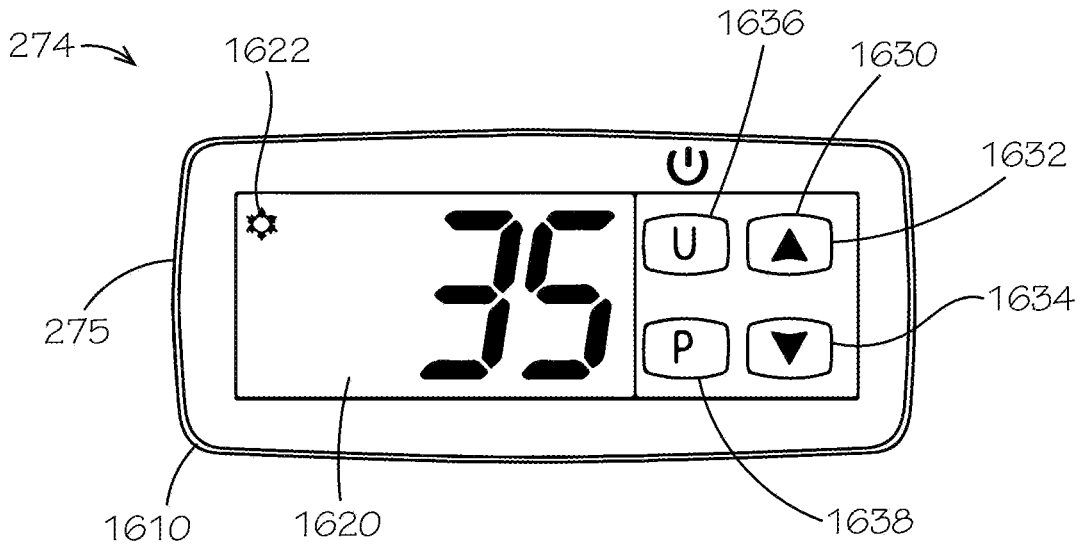
FIG. 16A is a side view of a control interface of the secondary controller of FIG. 8.

The roof duct 206 itself can again comprise the bottom panel 903, the rear panel 904 (shown in FIG. 9B), the front panel 906 (shown in FIG. 9B), and the side panels 905*a,b* (shown in FIG. 10A). The conduit 950 can cover and direct wiring from the cabinet fan 1010 and/or the air distribution duct 1520. As shown, between the cabinet fan assembly 207 and in some aspects proximate to the return air opening 1380, the cabinet thermistor 1540 can be secured to the roof duct 206 or an adjacent structure at the mounting location 1345. FIG. 16A is a side view of the control interface 275 of the secondary controller 274 of FIG. 8. The control interface 275 can comprise a body 1610, which can comprise or define a display 1620. The body 1610 or a portion thereof can be received within or otherwise secured to the appliance 100 and, more specifically, the front access panel 162 (shown in FIG. 2A) for use by a user or service technician. In some aspects, a deflector (not shown) can be positioned above or around either or both of the primary controller 272 and the secondary controller 274 to deflect liquid and other contamination away from same during use, cleaning, or other use of the appliance 100. In some aspects, the deflector can be formed from thin sheetmetal and can define a cutout sized to receive the body 1610. The display 1620 can be configured to display a temperature or a temperature setpoint corresponding to that measured, monitored, or controlled with the cabinet thermistor 1540 (shown in FIG. 15), which can again be positioned inside the base cavity 218 (shown in FIG. 2C) of the base 110 (shown in FIG. 2C).

The control interface 275 can comprise one or more buttons 1630 configured to be manipulated by a user to change the setpoint or access one or more other functions. The control interface 275 can comprise an UP button 1632 and a DOWN button 1634, which can be configured to change the temperature setpoint of the secondary controller 274. The control interface 275 can comprise a "U" button 1636 and a "P" button 1638, which can be configured to change the temperature display scale of the secondary controller 274 from Celsius to Fahrenheit or, more generally, between any two temperature scales. During operation of the cabinet fans 1010, a cabinet fan icon 1622 can be displayed on the display 1620. In some aspects, other icons such as, for example and without limitation, an alarm icon, can be displayed on the display 1620 to prompt user attention and action when, for example and without limitation, the measurement by the cabinet thermistor 1540 exceeds the setpoint by a threshold figure, which can be predetermined. In some aspects, other alarms such as a low temperature alarm or a cabinet thermistor malfunction alarm can alert the user to take action. The default setting of the control interface 275 of the secondary controller 274 can be 35° F. (1.7° C.) and can permit the appliance to maintain proper temperatures in conditions required by NSF/ANSI Standard 7.

Figure 16B:
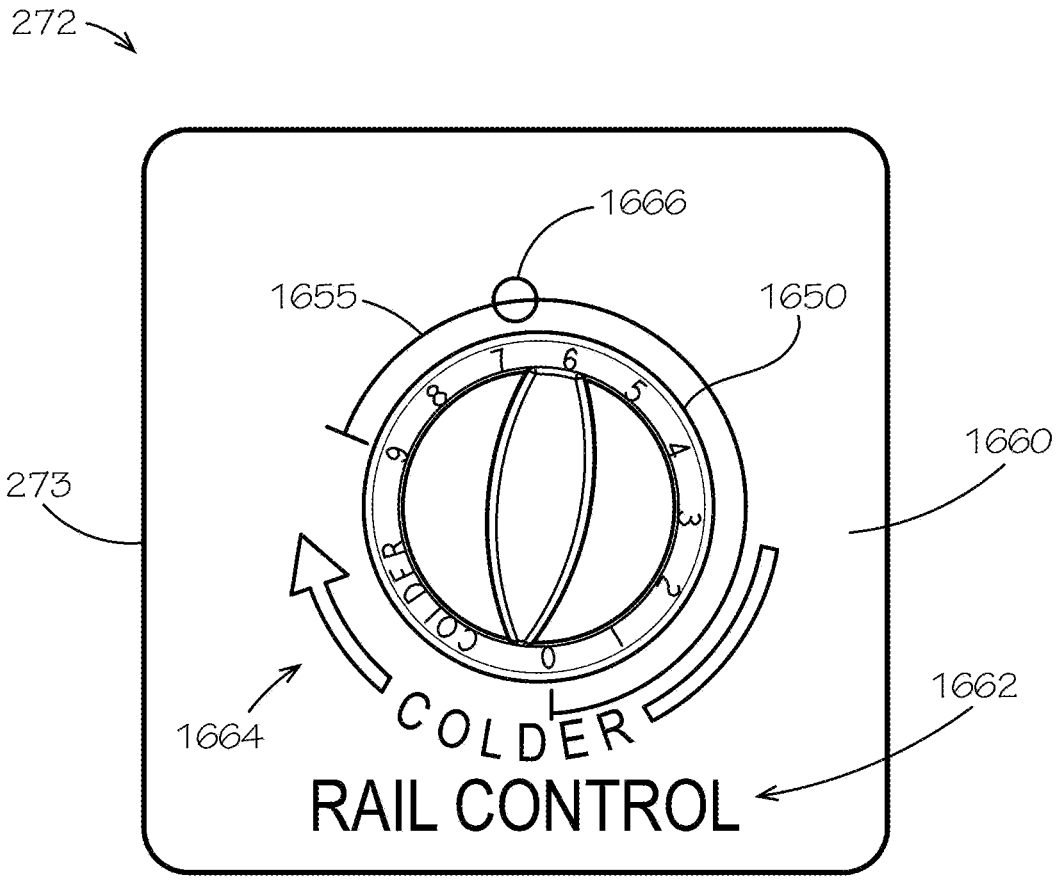
FIG. 16B is a side view of a control interface of the primary controller of FIGS. 4B and 8.

FIG. 16B is a side view of the control interface 273 of the primary controller 272 of FIGS. 4B and 8. The control interface 273, which can comprise a dial control, can comprise a body (not shown), a shaft (not shown) extending from the body, a knob 1650, and a lead wire configured to be in electrical communication with the primary controller 272. A spindle can comprise the body, the shaft, and the lead wire and is available as Model No. RSP 01 from Danfoss A/S The knob 1650 can define dial settings 1655, which can comprise numbers or words or other symbols of sufficient meaning to a user. A plate or base 1660 can define various pieces of information that can be useful to a user. A control identifier 1662 can indicate for a user what the control interface 273 is configured to control, i.e., the first refrigerated compartment 103 or the rail 120. A direction indicator 1664 can indicate for a user which direction to rotate the knob 1650 to obtain a particular result (e.g., colder or warmer temperatures). A reference mark or mark 1666 can be configured to indicate to a user the current setting of the controller 272 by the user confirming which dial setting is aligned with the mark 1666. The mark 1666 can be a hole defined in the base 1660.

As noted above with respect to FIG. 4B, the controller 272 itself can be mounted elsewhere and requires no access by a typical user and requires no display, but a remote display (not shown) such as, for example and without limitation, Model No. RDI 107 available from Danfoss A/S, can replace the dial control shown and/or form a separate connection with the controller 272. The rail air temperatures are, by default, below freezing in order to maintain stored product in the rail at NSF-compliant temperatures, and such data can be confusing for at least some users. In some aspects in which the remote display is used, the user can view and adjust the rail temperature setpoint as desired instead of with the dial control.

Figures 16C, 17:
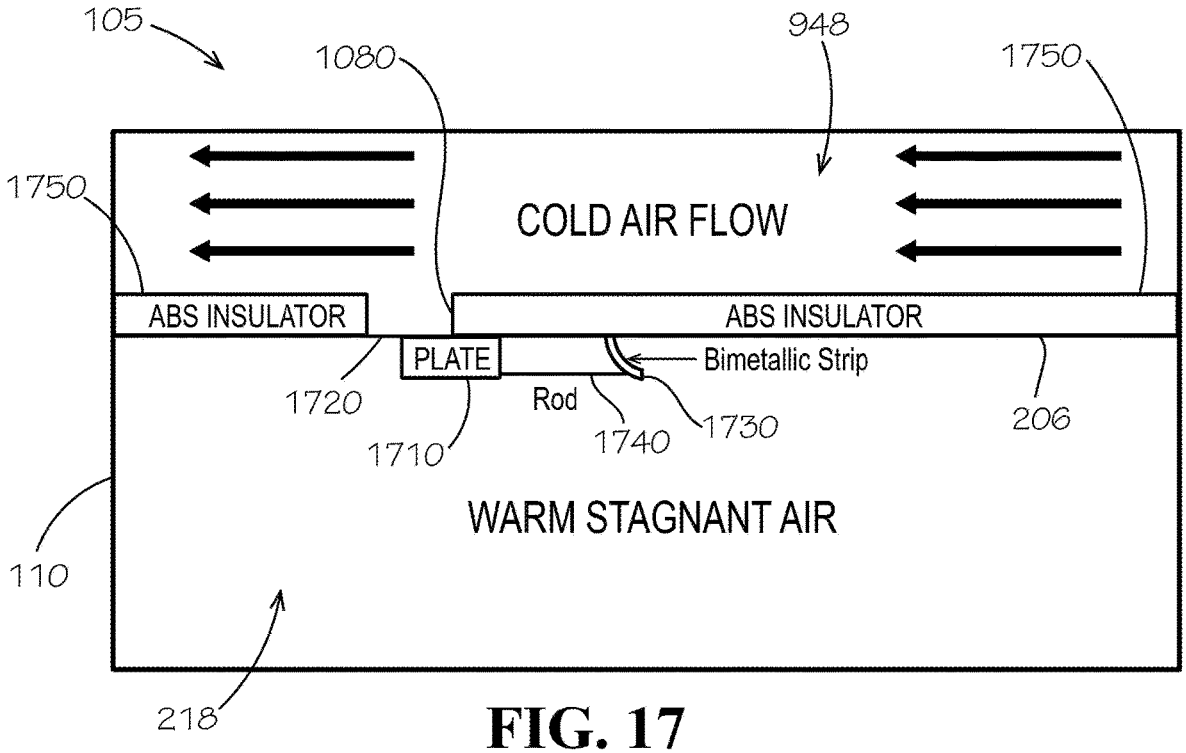
FIG. 16C is a table of rail temperature settings of the primary controller of any of the appliances of FIGS. 1A-1C.
FIG. 17 is simplified detail sectional view of a sectional view of the appliance of FIG. 1B comprising a bimetallic air damper in accordance with another aspect of the current disclosure.

FIG. 16C is a table 1600 of rail temperature settings of the primary controller 272 of any of the appliances 100 of FIGS. 1A-1C, which temperature settings can correspond to the dial settings 1655 as shown. The dial setting 1655 can result in different rail temperature settings depending on the mode of operation. The appliance 100 can operate in normal or "day" mode, or the appliance 100 can operate in offset or "night" mode. The default setting of the control interface 273 of the primary controller 272 can be the dial setting 1655 corresponding to a position "5". This can correspond to 27° F. (−2.8° C.) and can permit the appliance to maintain proper temperatures in conditions required by NSF/ANSI Standard 7. Moreover, a position "9" on the control interface 273 can correspond to 18° F. (−7.8° C.) in normal or "day" mode, and a position "1" on the control interface 273 can correspond to 36° F. (2.2° C.) in normal or "day" mode. With the appliance 100 in night mode, which will be discussed in greater detail below and can occur automatically upon the sensor 450 (shown in FIG. 4A) sensing that the closure device 140 has moved to the closed position, the primary controller 272 can simply add an offset of +8° F. to each dial setting. When the dial setting 1655 is set to the position "5," for example, a switch to night mode will automatically raise the rail temperature setpoint 8° F. from 27° F. to 35° F.

Under NSF or near-NSF conditions, the rail setpoint temperature and, more specifically, the dial setting 1655 can be adjusted and the appliance 100 still maintain proper temperatures. In higher ambient or lower ambient temperatures, the dial setting 1655 can be adjusted further. Even when at a low end of acceptable ambient temperature range, adjustment of the dial setting 1655 to its warmest setting (corresponding to position "1") can still permit the rail to maintain proper temperatures (i.e., not too cold in a cold ambient environment); and even when at a high end of the acceptable ambient temperature range, adjustment of the dial setting 1655 to its coldest setting (corresponding to position "9") can likewise still permit the rail to maintain proper temperatures (i.e., not too warm in a warm ambient environment). The user can follow the built in control settings and adjust them up or down as needed depending on actual conditions as they evolve. When position "0" is selected, power for the rail 120 can be automatically turned OFF, i.e., the position "0" can function as a power switch. However, the display for the secondary controller 274 can remain ON and can continue to display the cabinet temperature. A power button on the secondary controller 274 can turn OFF the power to the cabinet fans 1010 and the control interface 275.

FIG. 17 is simplified detail sectional view of a sectional view of the appliance 100 of FIG. 1B comprising a bimetallic air damper in accordance with another aspect of the current disclosure. A plate 1710 can be slideably secured to a bottom surface of the roof duct 206. The plate 1710 can be configured to slide across the cabinet opening 1080 from a closed position to an open position. More specifically, the plate 1710 can be configured to slide across the opening on low-friction sliders 1720. A bimetallic strip 1730 can be connected to the plate 1710 with a member 1740, which can be a rod or wire and can have negligible expansion or contraction in a specified temperature range of use. An insulator 1750 can be formed from an insulating material such as, for example and without limitation, a polymer material and, more specifically, acrylonitrile butadiene styrene (ABS). The insulator 1750 can reduce the risk that the bimetallic strip 1730, with its close proximity to the return air cavity 948 due to its being mounted exemplarily on the roof duct 206, and the surrounding air inside the base cavity 218 is unduly influenced by such proximity. Rather, the bimetallic strip 1730 can be influenced only by or primarily by passage of air through the opening 1080. When the bimetallic strip 1730 recognizes that a temperature of the relatively warm and stagnant air in the base cavity 218 is greater than 4° C., for example, the plate 1710 can be pulled away from the cabinet opening 1080, thereby removing the obstruction and allowing colder air to flow from the return air cavity 948 into the base cavity 218. In contrast, when the bimetallic strip 1730 recognizes that a temperature of the relatively warm stagnant air base cavity is less than 1° C., for example, the plate 1710 can be pushed over the cabinet opening 1080, thereby obstructing flow and preventing colder air from flowing from the return air cavity 948 into the base cavity 218. The specifications of the bimetallic strip 1730 can be adjusted to produce different cabinet temperature setpoint ranges.

Figure 18A:
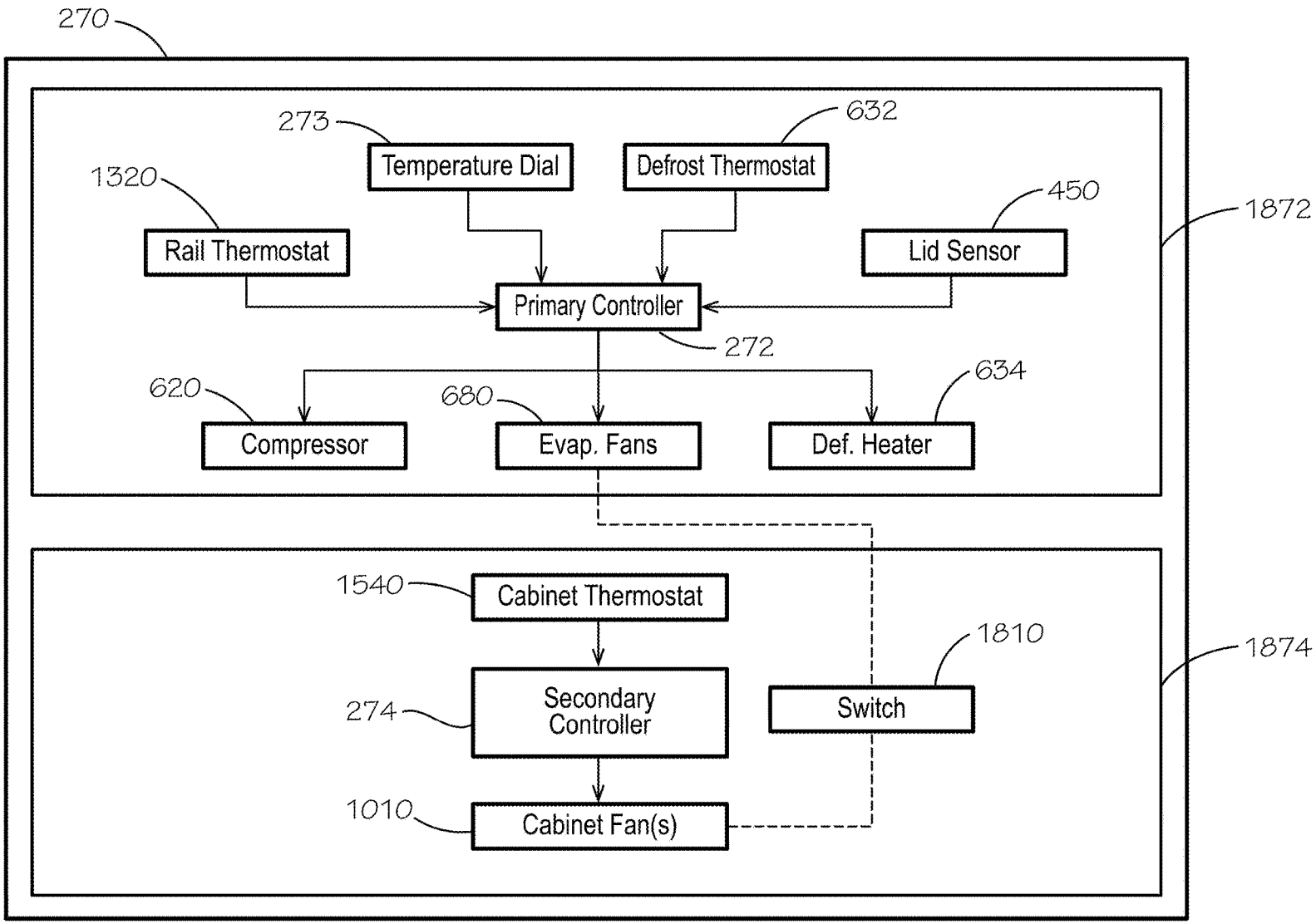
FIG. 18A is a schematic representation, in the form of a block diagram, showing the inputs and outputs to the primary controller and a secondary controller of the controls system of the appliance of FIG. 1A.

FIG. 18A is a schematic representation, in the form of a block diagram, showing the inputs and outputs to the primary controller 272 and a secondary controller 274 of the controls system 270 of the appliance 100 of FIG. 1A. As noted separately, the two controllers 272,274 can accommodate the different refrigeration capacities and different temperature setpoints needed in the separate refrigerated spaces, namely, the first refrigerated portion 101 comprising the first refrigerated compartment 103 and defining the rail cavity 228 and the second refrigerated portion 102 comprising the second refrigerated compartment 104 and defining the base cavity 218. The primary controller 272 can comprise a multi-input, multi-output printed circuit board (PCB). More specifically, the primary controller 272 can receive as inputs signals from the rail thermostat or rail thermistor 1320, the temperature dial or control interface 273, the defrost thermostat or defrost thermistor 632 (during defrost), and the sensor 450; and the primary controller 272 can provide as outputs signals to the condensing unit 610 (shown in FIG. 6A and represented by the compressor 620, with which the condenser fan 640 is wired in parallel), the evaporator fans 680, and the defrost heater 634. The user determined temperature setpoint can help the primary controller 272 determine exactly when to provide certain outputs based on the inputs. The primary controller 272 and its inputs and outputs can form a primary controller system 1872.

The secondary controller 274 can be a single-input, single-output PCB. More specifically, the secondary controller 274 can receive as an input a signals from the cabinet thermostat or thermistor 1540 and can provide as an output a signal to independently operate the cabinet fans 1010. The cabinet fan can turn ON when needed to draw the colder air from the rail 120 through an air plenum and into the base cavity 218 based on input from the cabinet thermistor 1540. Without separate sensors (e.g., the rail thermistor 1320 and the cabinet thermistor 1540), too much cold air from the rail 120 can flow directly into the base cavity 218, which can cause freezing of food product stored therein. In some aspects, a "switch" (e.g., the cabinet fan switch 1810) can connect the primary controller and the cabinet fans 1010 such that the cabinet fans do not start when the appliance 100 is in defrost mode to thereby avoid circulating warm air heated by the defrost heater 634 into the base cavity 218. With the cabinet fan switch 1810 is not necessary for the primary controller 272 and the secondary controller 274 to communicate with each other in the process. The secondary controller 274 and its input and output can form a secondary controller system 1874.

Figure 18B:
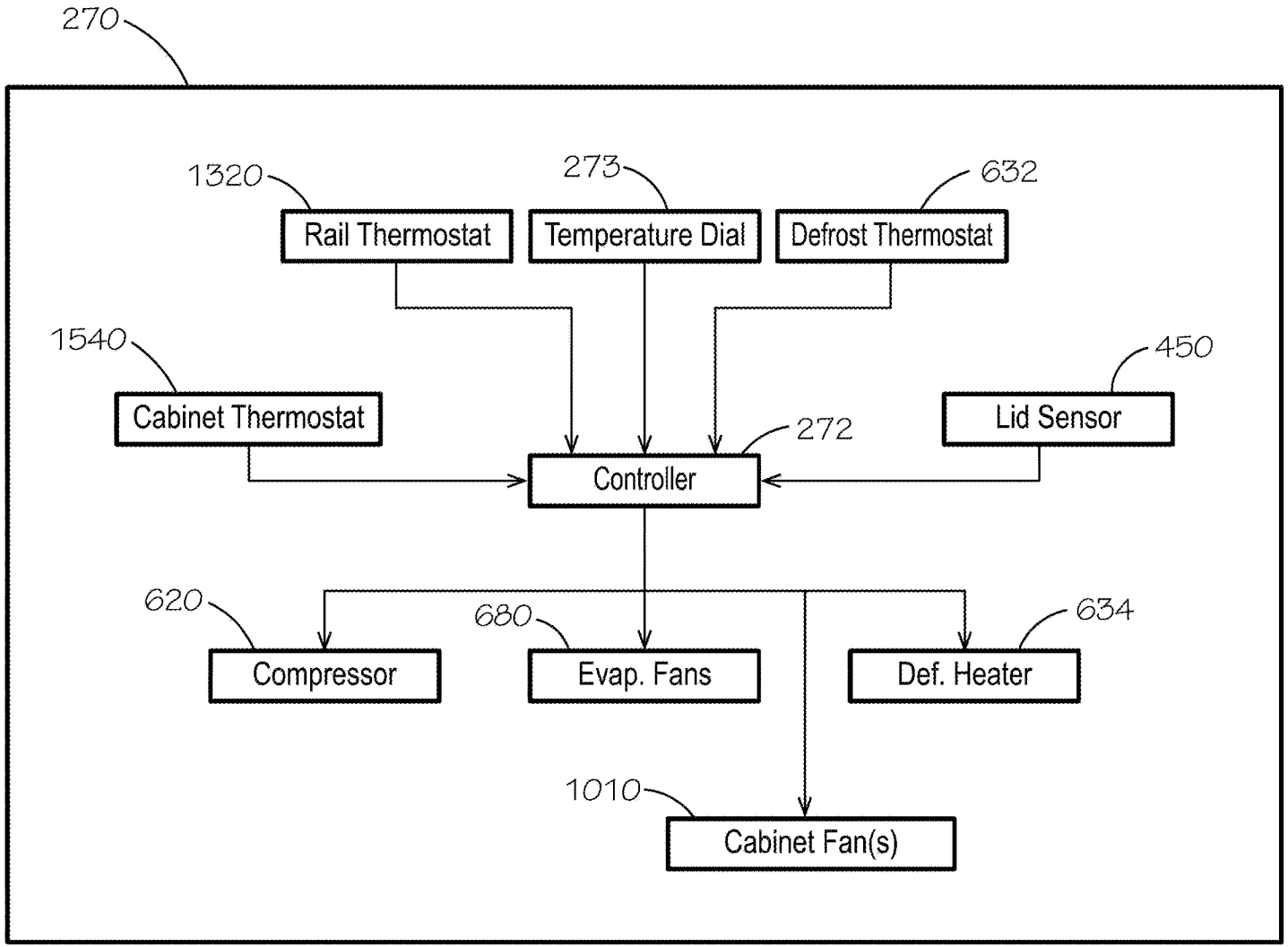
FIG. 18B is a schematic representation, in the form of a block diagram, showing the inputs and outputs to a single controller of the controls system of the appliance of FIG. 1A in accordance with another aspect of the current disclosure.

FIG. 18B is a schematic representation, in the form of a block diagram, showing the inputs and outputs to a single controller 272 of the controls system 270 of the appliance 100 of FIG. 1A in accordance with another aspect of the current disclosure. The controller 272 can still comprise a multi-input, multi-output printed circuit board (PCB). More specifically, the controller 272 can receive as inputs signals from the rail thermostat or rail thermistor 1320, the temperature dial or control interface 273, the defrost thermostat or defrost thermistor 632 (during defrost), the sensor 450, and the cabinet thermostat or cabinet thermistor 1540; and the controller 272 can provide as outputs signals to the condensing unit 610 (shown in FIG. 6A and, again, represented by the compressor 620, with which the condenser fan 640 is wired in parallel), the evaporator fans 680, the defrost system, and the cabinet fans 1010. In some aspects in which the controller 272 includes an additional input, the controller 272 could be connected to and operate a remote display.

Figure 19A:
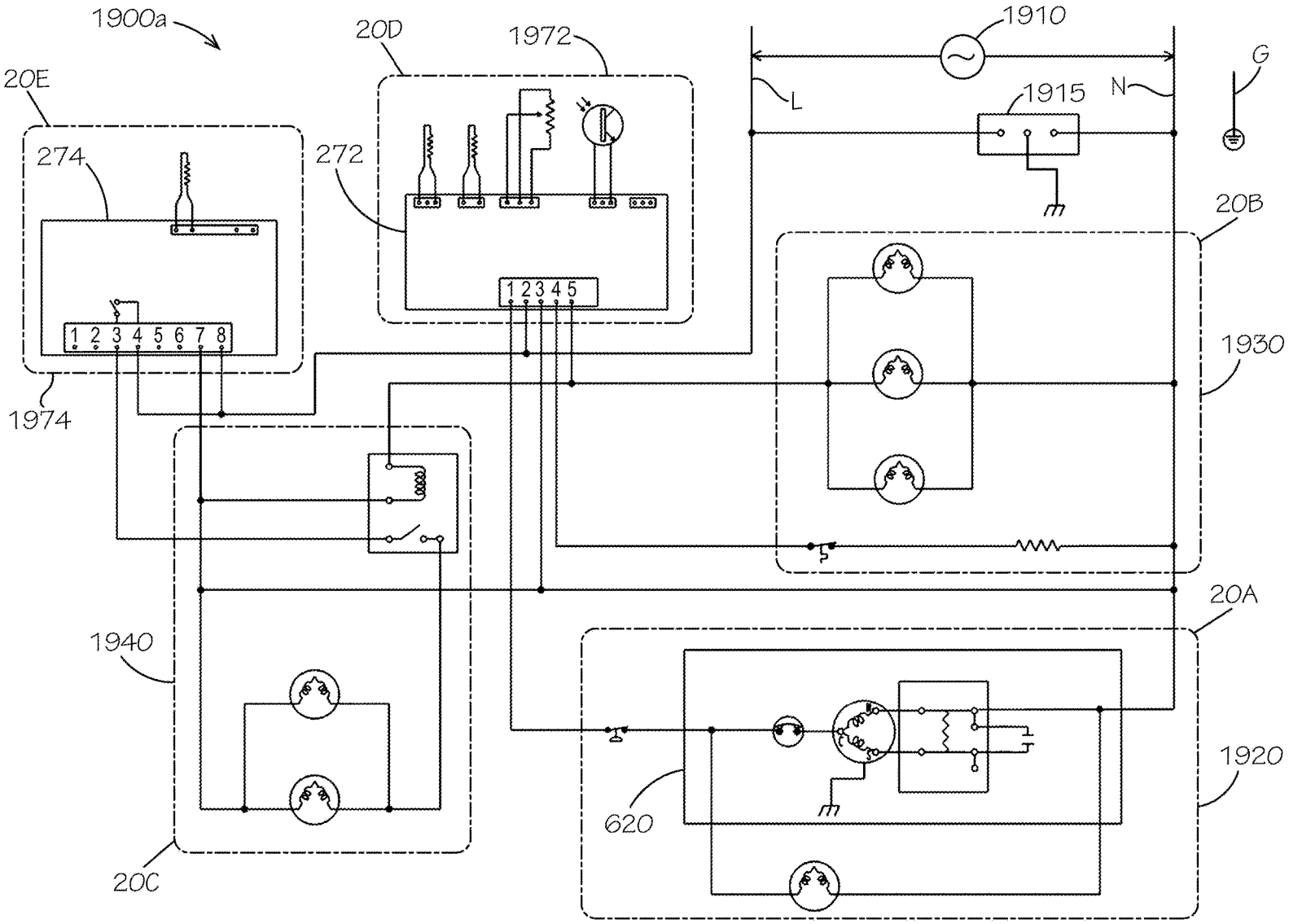
FIG. 19A is an electrical schematic of an electrical circuit of the appliance of FIG. 1A.

FIG. 19A is an electrical schematic 1900*a* of an electrical circuit of the appliance 100 of FIG. 1A. The electrical schematic 1900*a* can comprise a power supply or power source 1910. More specifically, the power source 1910 can be a 1-phase AC power source measuring 115 VAC and 60 Hertz. In some aspects, the power source 1910 can be accessed through a line wire L, a neutral wire N, and a ground wire G of the power cord 470 (shown in FIG. 4B). The electrical schematic 1900*a* can further comprise a plug harness 1915, to which the power cord 470 can be hard-wired. The line wire L, the neutral wire N, and the ground wire G can be connected, directly or indirectly, to each of the other portions and components of the electrical schematic.

The electrical schematic 1900*a* can comprise a condensing unit portion 1920, an evaporating unit portion 1930, and a cabinet cooling portion 1940, which will be described below. In some aspects, as shown, the electrical schematic 1900*a* can comprise a primary controller portion or controller portion 1972 and a secondary controller portion 1974, each of which can be in electrical communication with and thus be powered by the power source 1910. More specifically, the secondary controller 274 of the secondary controller portion 1974 can control the cabinet fans 1010; and the primary controller 272 of the primary controller portion 1972 can control all other outputs of the electrical schematic 1900*a*, which can encompass the controls system 270 (shown in FIG. 2A). As shown, the plug harness 1915 and the compressor 620 can be grounded, but other components can also be grounded, even if not shown as such. The primary controller 272 can supply 115 VAC to each of the outputs and can power each of the inputs with 5 VAC. Similarly, the secondary controller 274 can supply 115 VAC to each of the outputs and can power each of the inputs with 5 VAC.

Figure 19B:
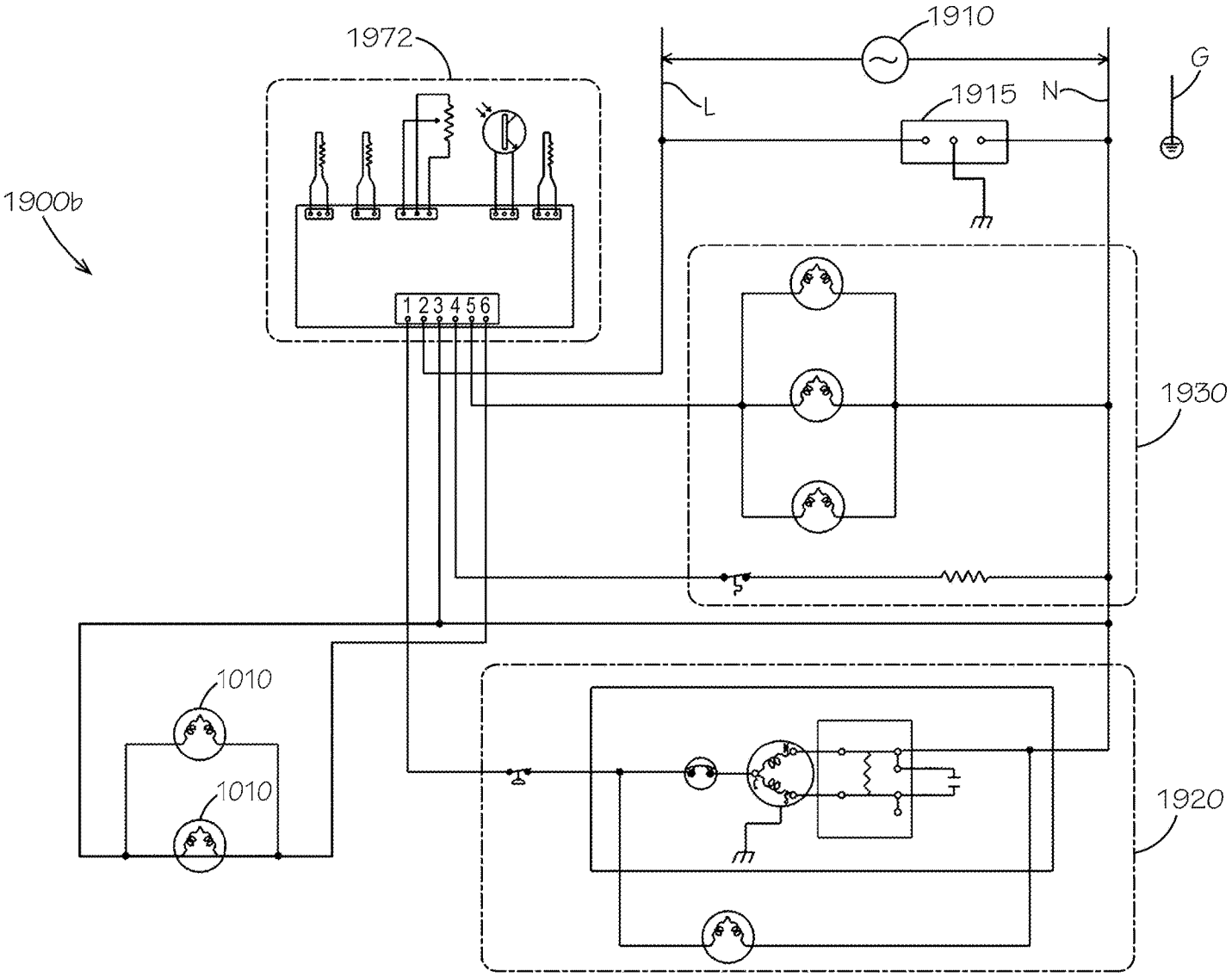
FIG. 19B is an electrical schematic of an electrical circuit of the appliance of FIG. 1A comprising a single controller in accordance with another aspect of the current disclosure.

FIG. 19B is an electrical schematic 1900*b* of an electrical circuit of the appliance 100 of FIG. 1A comprising a single controller 272 in accordance with another aspect of the current disclosure. The electrical schematic 1900*b* can comprise the condensing unit portion 1920, the evaporating unit portion 1930, which will be described below. In some aspects, as shown, the electrical schematic 1900*b* can comprise only the controller portion 1972, which can again be powered by the power source 1910. More specifically, the controller 272 of the controller portion 1972 can control all outputs of the electrical schematic 1900*b*. As such, in some aspects, the controller 272 can control the cabinet fans 1010 through an additional terminal connection. More specifically, the cabinet fans 1010 can be in electrical communication with the line wire L through terminal 6 of the primary controller 272 and can be in electrical communication with the neutral wire N. Again, the plug harness 1915 and the compressor 620 can be grounded, but other components can also be grounded, even if not shown as such.

Figure 20A:
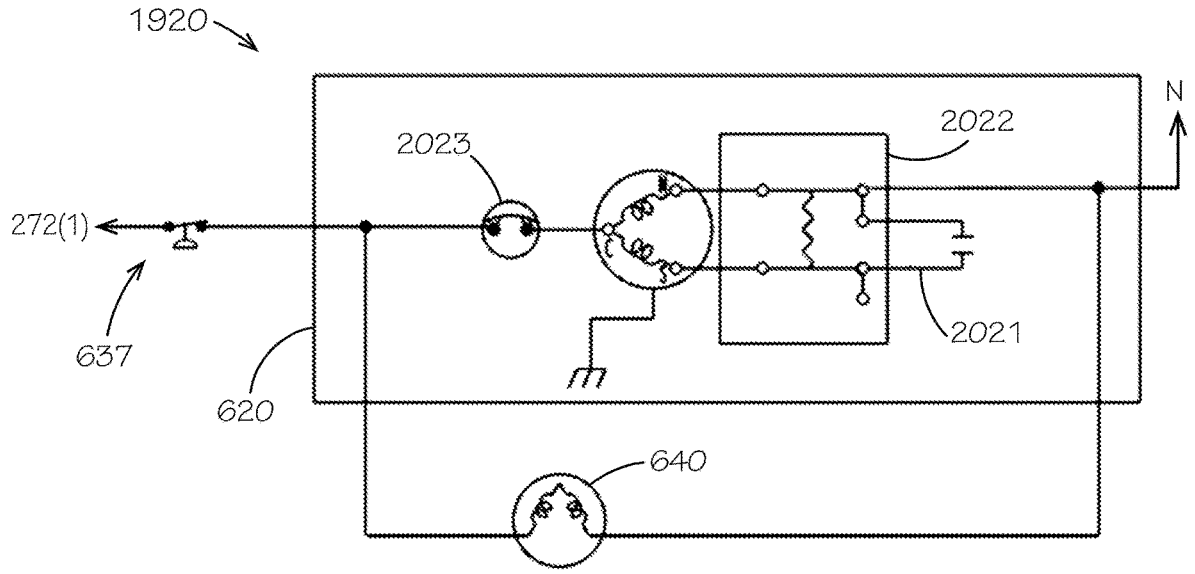
FIG. 20A is a condensing unit portion of the electrical schematic of FIG. 19A taken from detail 20A of FIG. 19A.

FIG. 20A is the condensing unit portion 1920 of the electrical schematic 1900*a* of FIG. 19A taken from detail 20A of FIG. 19A. As shown, the compressor 620 can comprise a run capacitor 2021, a start relay 2022, and an overload 2023, which can be an external overload. The condenser fan 640 can be wired in parallel with the compressor 620. The condensing unit portion 1920 can be in electrical communication with the line wire L through terminal 1 of the primary controller 272 and can be in electrical communication with the neutral wire N. Again, the compressor 620 can be grounded as shown.

Figure 20B:
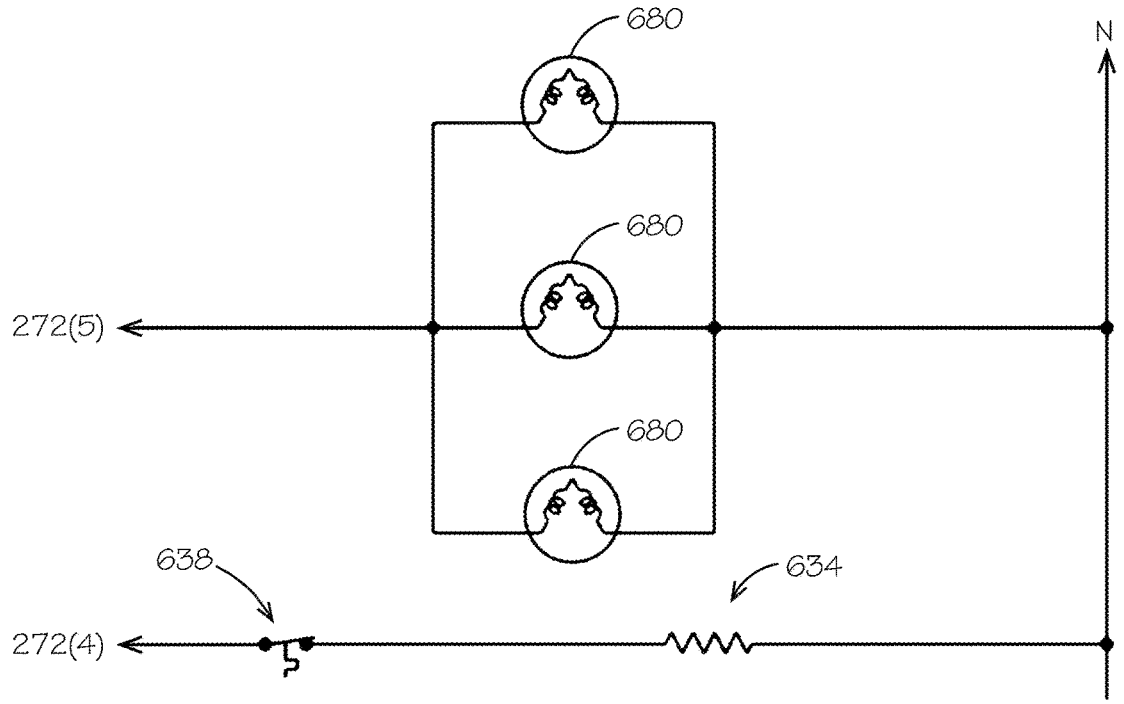
FIG. 20B is an evaporating unit portion of the electrical schematic of FIG. 19A taken from detail 20B of FIG. 19A.

FIG. 20B is the evaporating unit portion 1930 of the electrical schematic 1900*a* of FIG. 19A taken from detail 20B of FIG. 19A. The evaporating unit portion 1930 can be in electrical communication with the line wire L through terminal 5 of the primary controller 272 and can be in electrical communication with the neutral wire N. The defrost heater 634 and the defrost safety thermostat 636, which can be wired in series, can be in electrical communication with the line wire L through terminal 4 of the primary controller 272 and can be in electrical communication with the neutral wire N.

Figure 20D:
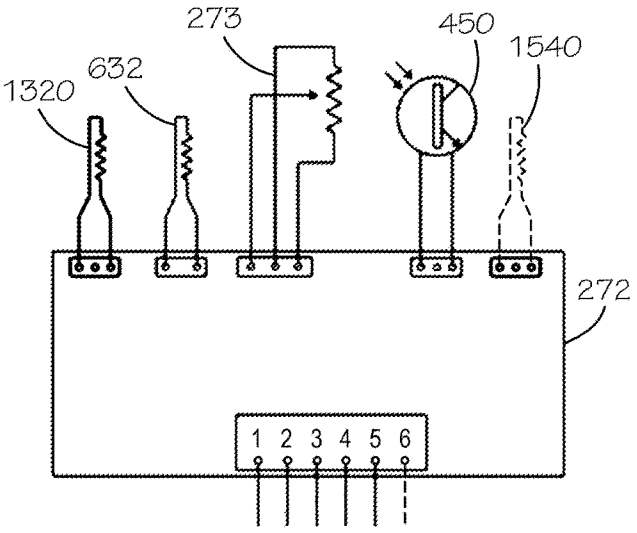
FIG. 20D is a primary controller portion of the electrical schematic of FIG. 19A taken from detail 20D of FIG. 19A.
Figure 20E:
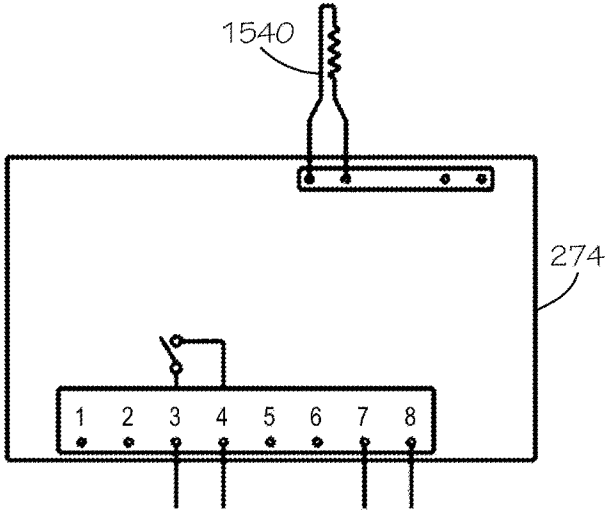
FIG. 20E is a secondary controller portion of the electrical schematic of FIG. 19A taken from detail 20E of FIG. 19A.
Figure 20C:
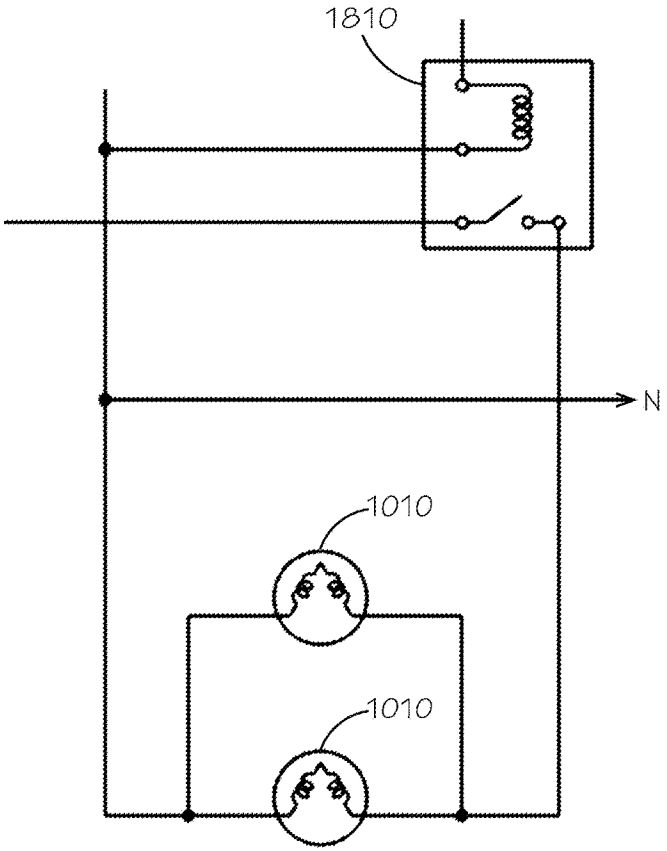
FIG. 20C is a cabinet cooling portion of the electrical schematic of FIG. 19A taken from detail 20C of FIG. 19A.

FIG. 20C is the cabinet cooling portion 1940 of the electrical schematic 1900*a* of FIG. 19A taken from detail 20C of FIG. 19A and can apply to only the dual controller configuration comprising both the primary controller portion 1972 and the secondary controller portion 1974 comprising the primary controller 272 and the secondary controller 274, respectively. The cabinet cooling portion 1940 can be in electrical communication with the line wire L through the cabinet fan switch 1810 and through terminal 2 of the primary controller 272 and through terminal 7 of the secondary controller 274 and can be in electrical communication with the neutral wire N.

FIG. 20D is the primary controller portion 1972 of the electrical schematic 1900*a* of FIG. 19A taken from detail 20D of FIG. 19A. In some aspects comprising both the primary controller portion 1972 and the secondary controller portion 1974 comprising the primary controller 272 and the secondary controller 274, respectively, the inputs can comprise the rail thermistor 1320, the defrost thermistor 632, the control interface 273 (for adjusting the rail temperature setpoint), and the sensor 450. The outputs can be as described elsewhere herein. In some aspects comprising only the single controller 272 of the controller portion 1972, the cabinet thermistor 1540 can constitute an additional input, and the controller 272 can comprise an additional output in electrical communication with the cabinet fans 1010 (shown in FIG. 19B). In some aspects, the controller 272 can power additional outputs such as, for example and without limitation, a remote display (not shown). The remote display can facilitate user monitoring and adjusting one or more of the temperature setpoints and other settings and can be configured to receive user inputs (via a keypad) and can be configured to show such settings.

FIG. 20E is the secondary controller portion 1974 of the electrical schematic 1900*a* of FIG. 19A taken from detail 20E of FIG. 19A. The sole input can comprise the cabinet thermistor 1540. The sole output to the cabinet fans 1010 can be as described elsewhere herein.

Figure 21:
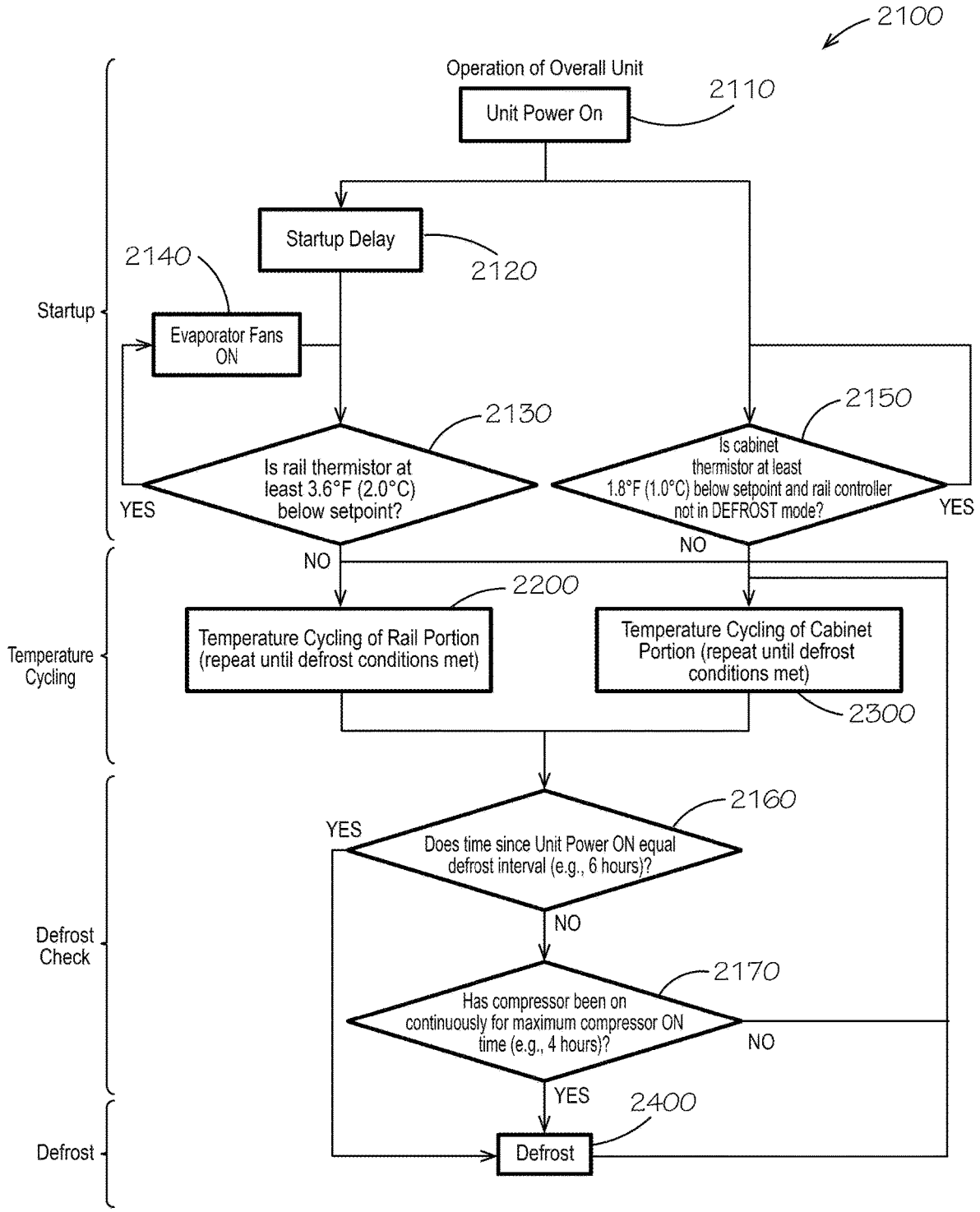
FIG. 21 is a flowchart for operation of the overall unit or appliance of FIG. 1A.

FIG. 21 is a flowchart 2100 for operation of the overall unit or appliance 100 of FIG. 1A. A method of using the appliance 100 according to the flowchart 2100 can comprise one or more of steps 2110 through 2400, some of which can be represented in separate flowcharts 2200, 2300, and 2400. More specifically, a startup period or stage can comprise steps 2110 through 2150, a temperature cycling stage can comprise steps—and flowcharts—2200 and 2300, a defrost check stage can comprise steps 2160 and 2170, and a defrost stage can comprise a step—or flowchart—2400.

In the startup stage, a step 2110 can comprise turning power ON to the unit or appliance 100. With respect to operation of the condensing unit 610 and cooling of the rail 120, a startup stage can comprise steps 2120 through 2140. The step 2120 can comprise implementing a startup delay before turning any main components ON or OFF. A step 2130 can comprise determining whether the rail thermistor 1320 is at least 3.6° F. below the rail setpoint. If the answer is YES, i.e., the rail 120 and, more specifically, the rail cavity 228, are already sufficiently cooled to not require further cooling down, a step 2140 can comprise turning power ON to the evaporator fans 680 to continue circulation of the cool air but otherwise leave the other main components OFF. If the answer is NO, temperature cycling of the first refrigerated portion 101 can proceed according to the flowchart 2200. The step 2130 can be repeated until the air inside the rail cavity 228 warms sufficiently to initiate temperature cycling of the rail portion 203 or first refrigerated portion 101 in the flowchart 2200. Meanwhile, with respect to operation of the cabinet fans 1010, a step 2150 can comprise determining whether the cabinet thermistor 1540 is at least 3.6° F. below the cabinet setpoint and the rail controller or primary controller 272 is not in defrost mode. If the answer is YES, i.e., the base 110 and, more specifically, the base cavity 218, are already sufficiently cooled to not require further cooling down, the step 2310 can be repeated until the air inside the base cavity 218 warms sufficiently to initiate temperature cycling of the cabinet portion or second refrigerated portion 102 in the flowchart 2300. If the answer is NO, temperature cycling of the second refrigerated portion 102 can proceed according to the flowchart 2300.

In the temperature cycling stage, the appliance can operate according to and repeat the steps of the flowcharts 2200,2300 until the conditions for defrost are met. As will be described, defrost of the appliance 100 can operate on a timer and can begin when the timer goes off. The temperature cycling of the refrigerated portions 101,102 need not be synchronized. In other words, the refrigerated portions 101, 102 can cool down or warm up at different times and at different rates. In some aspects, initiation of a defrost cycle can be inhibited or delayed by a compressor ON-time delay (e.g., 2 minutes).

In a defrost check stage, a step 2160 can comprise determining whether an elapsed time since power to the appliance 100 was turned ON is equal to the defrost interval (e.g., 6 hours). If the answer is YES, the appliance 100 can proceed to defrost according to the flowchart 2400. If the answer is NO, a step 2170 can comprise determining whether the compressor has been on continuously for a maximum compressor ON time (e.g., 4 hours). In response to the step 2170, if the answer is NO, temperature cycling of the refrigerated portions 101,102 can continue according to the respective flowcharts 2200,2300. If the answer is YES, the appliance 100 can proceed to defrost according to the flowchart 2400. After completion of defrost, temperature cycling of the refrigerated portions 101,102 can again continue according to the respective flowcharts 2200,2300.

Figure 22:
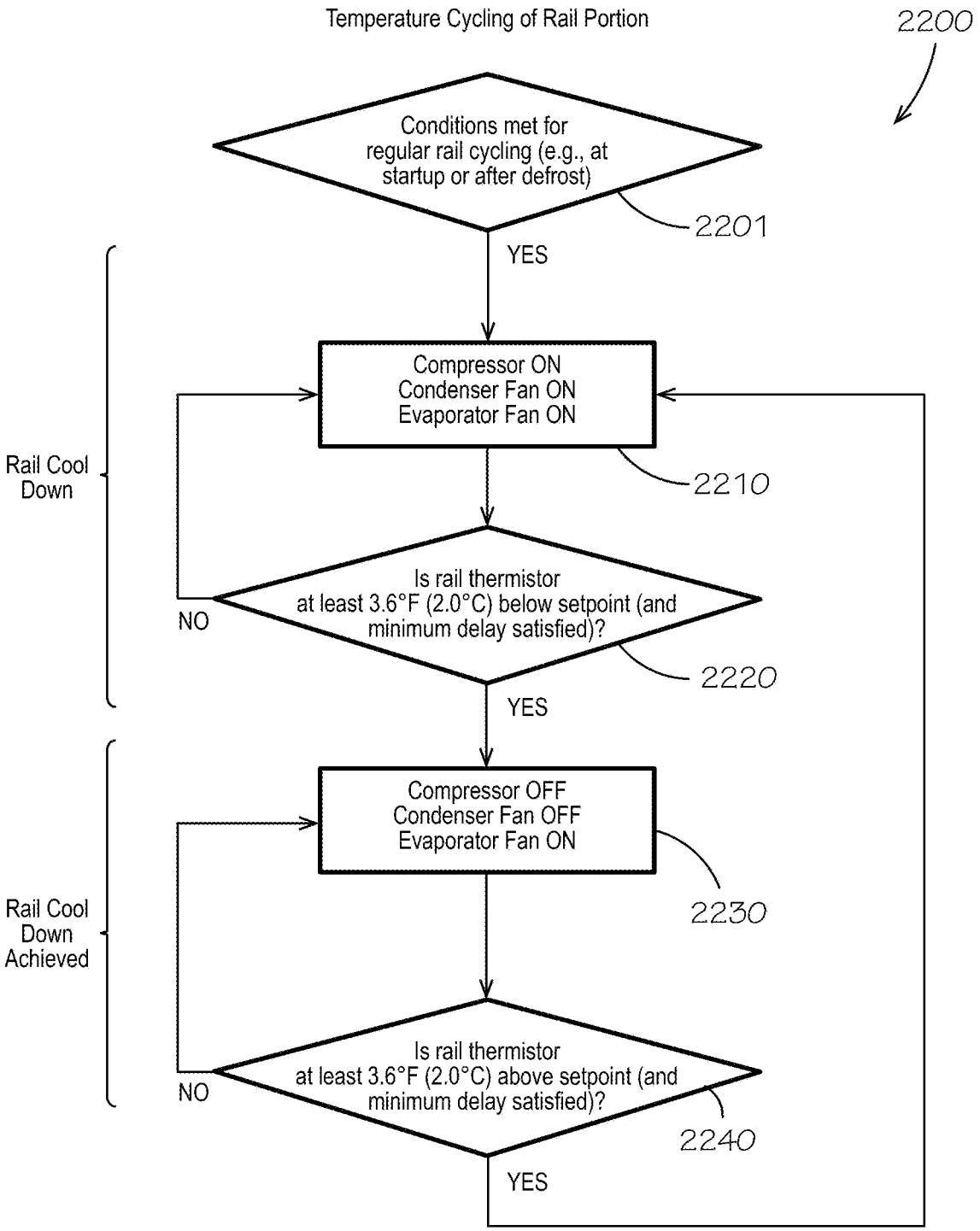
FIG. 22 is a rail temperature control detail portion of the flowchart of FIG. 21 showing temperature cycling of a rail portion of the appliance.

FIG. 22 is a rail temperature control detail portion of the flowchart 2100 of FIG. 21 showing temperature cycling of the rail portion or first refrigerated portion 101 of the appliance 100 in a flowchart 2200. A method of using the appliance 100 according to the flowchart 2200 can comprise one or more of steps 2201 through 2240. More specifically, a rail cool down stage can comprise the steps 2210 and 2220, and once rail cool down is achieved a rail warm up stage can comprise the steps 2230 and 2240.

A step 2201 can comprise determining whether conditions are met for regular temperature cycling of the rail 120 (e.g., at startup or after defrost). If so, in the rail cool down stage, a step 2210 can comprise turning ON the compressor 620, the condenser fan 640, and the evaporator fans 680. A step 2220 can comprise determining whether the rail thermistor 1320 is at least 3.6° F. below the rail setpoint and also whether the minimum compressor ON delay has been satisfied. If the answer at step 2220 is NO, the step 2210 can be repeated. If the answer at step 2220 is YES, a step 2230 can comprise turning power OFF to the compressor 620 and the condenser fan 640 and leaving power ON to the evaporator fans 680 to continue circulation of the cool air.

When the compressor 620 turns ON and OFF, the primary controller 272 can be configured to keep the compressor 620 ON for a certain minimum ON duration and can be configured to keep the compressor 620 OFF a certain minimum OFF duration (e.g., for health of the compressor 620). These delays can be two minutes in length. The method can comprise operating the appliance 100 in either "day" mode (also referred to as regular mode or normal mode) or "night mode" (also referred to as offset mode). Day mode and night mode can be associated with respective rail setpoints and offset from each other. Any change from one mode to the other will become effective immediately on operation of the rail 120 but will not affect the cabinet setpoint.

A step 2240 can comprise determining whether the rail thermistor 1320 is at least 3.6° F. above the rail setpoint and also whether the minimum compressor ON delay has been satisfied. If the answer at step 2240 is NO, the step 2230 can be repeated. If the answer at step 2240 is YES, the steps 2230 can be repeated.

Figure 23:
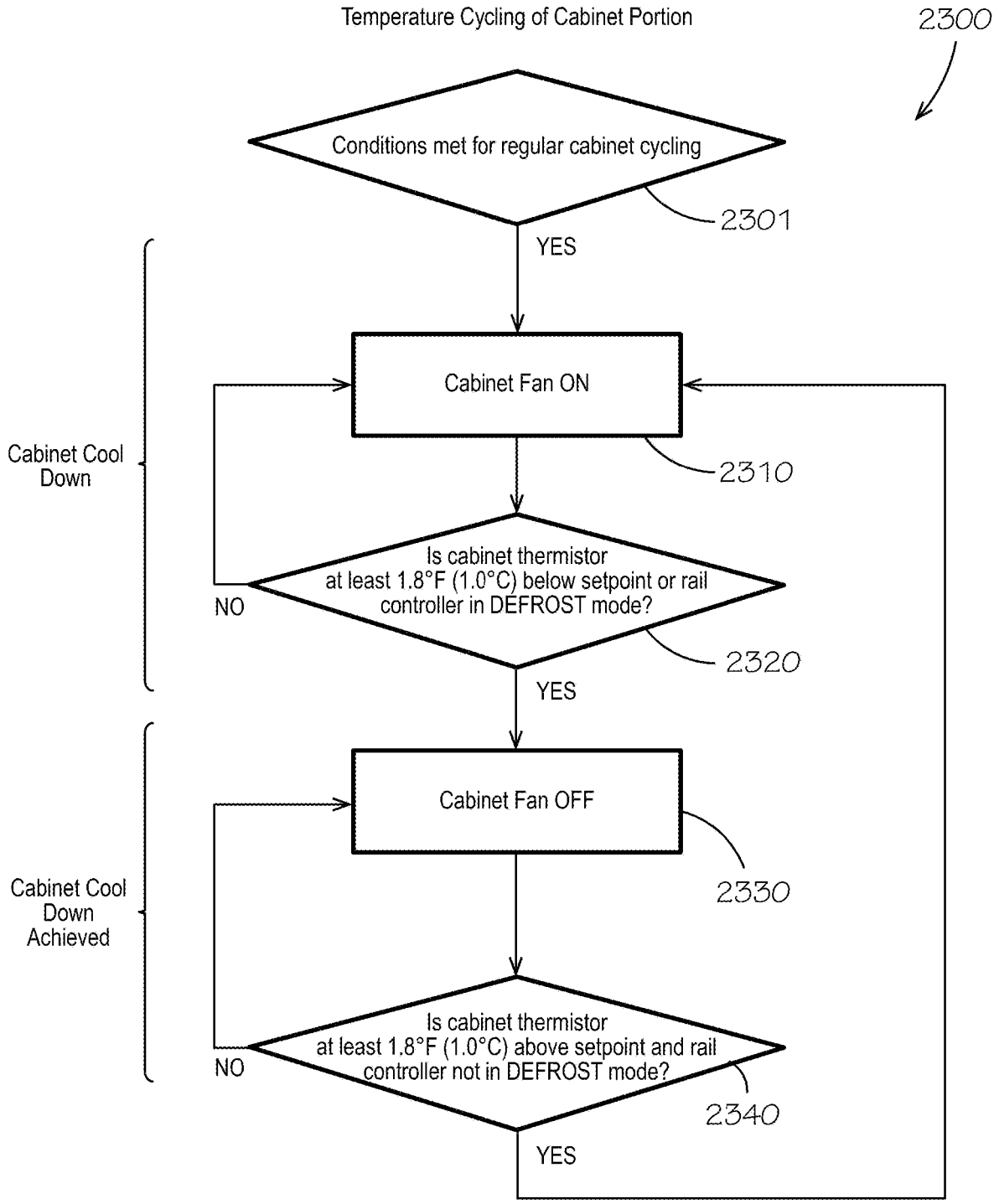
FIG. 23 is a cabinet temperature control detail portion of the flowchart of FIG. 21 showing temperature cycling of a cabinet portion of the appliance.

FIG. 23 is a cabinet temperature control detail portion of the flowchart 2100 of FIG. 21 showing temperature cycling of a cabinet portion of the appliance in a flowchart 2300. A method of using the appliance 100 according to the flowchart 2300 can comprise one or more of steps 2301 through 2340. More specifically, a cabinet cool down stage can comprise the steps 2310 and 2320, and once cabinet cool down is achieved a cabinet warm up stage can comprise the steps 2330 and 2340.

A step 2301 can comprise determining whether conditions are met for regular temperature cycling of the cabinet. If so, in the cabinet cool down stage, a step 2310 can comprise turning ON the cabinet fans 1010. A step 2320 can comprise determining whether the cabinet thermistor 1540 is at least 1.8° F. below the cabinet setpoint and also whether the minimum compressor ON delay has been satisfied. If the answer at step 2320 is NO, the step 2310 can be repeated. If the answer at step 2320 is YES, a step 2330 can comprise turning power OFF to the cabinet fans 1010. Flow of air into the base cavity 218 of the appliance 100 can thereby be regulated by temperature conditions in the base cavity 218, i.e., dynamically.

A step 2340 can comprise determining whether the cabinet thermistor 1540 is at least 1.8° F. above the cabinet setpoint and also whether the minimum compressor ON delay has been satisfied. If the answer at step 2340 is NO, the step 2330 can be repeated. If the answer at step 2340 is YES, the step 2310 can be repeated.

Figure 24:
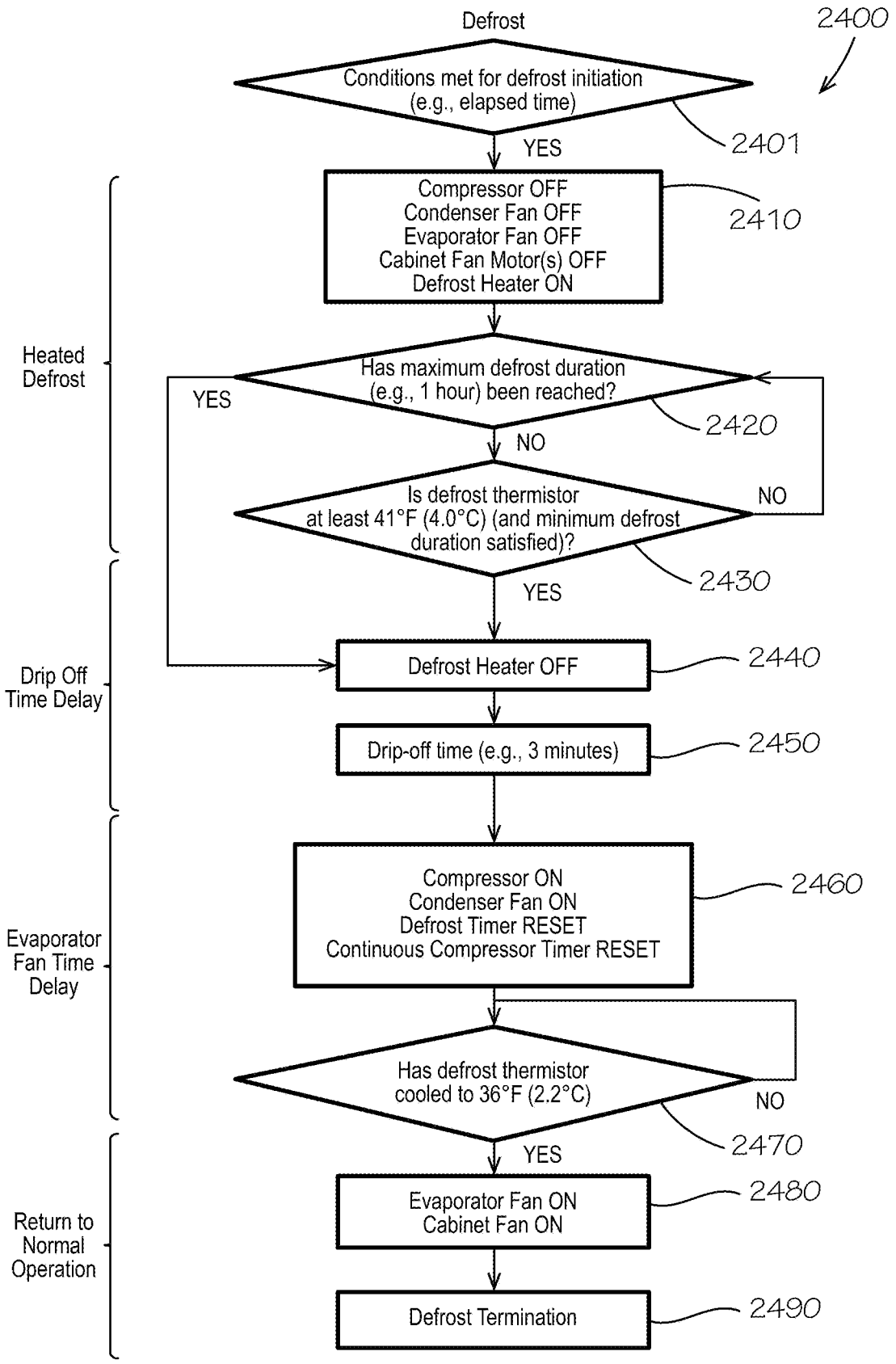
FIG. 24 is a defrost control detail portion of the flowchart of FIG. 21 showing operation of a defrost cycle of the appliance.

FIG. 24 is a defrost control detail portion of the flowchart 2100 of FIG. 21 showing operation of a defrost cycle of the appliance 100 in a flowchart 2400. A method of using the appliance 100 according to the flowchart 2400 can comprise one or more of steps 2401 through 2490. More specifically, a heated defrost stage can comprise the steps 2410 through 2430, a drip off time delay stage can comprise the steps 2440 and 2450, an evaporator fan time delay stage can comprise the steps 2460 and 2470, and a return to normal operation stage can comprise steps 2480 and 2490.

A step 2401 can comprise determining whether conditions are met for defrost initiation (e.g., elapsed time). If so, a step 2410 can comprise turning power OFF to the compressor 620, the condenser fan 640, the evaporator fans 680, and the cabinet fans 1010 and turning power ON to the defrost heater 634. A step 2420 can comprise determining whether the maximum defrost duration (e.g., one hour) has been reached. If the answer is YES, a step 2440 can comprise turning power OFF to the defrost heater 634. If the answer at step 2420 is NO, a step 2430 can comprise determining whether the defrost thermistor 632 is at least 41° F. and also whether the minimum defrost duration (e.g., 5 minutes) has been satisfied. If the answer is NO, the step 2420 can be repeated. In the answer is YES, the step 2440 can comprise turning power OFF to the defrost heater 634, which can initiate the drip off time delay stage.

In the evaporator fan time delay stage, a step 2460 can comprise turning power ON to the compressor 620 and the condenser fan 640 and resetting each of the defrost timer and the continuous compressor run timer. A step 2470 can comprise determining whether the defrost thermistor has cooled to 36° F. If the answer is NO, the step 2470 can be repeated. In a return to normal operation stage, a step 2480 can comprise turning power ON to the evaporator fans 680 and to the cabinet fans 1010.

A method of using the appliance 100 can comprise distributing air through an air plenum system of the appliance 100 and, more specifically, throughout the pan storage cavity 428 and around the pans 510 to maintain proper temperatures of food product stored therein. More specifically, the method can comprise complying with NSF/ANSI Standard 7 performance requirements in an ambient temperature of 86° F. (30° C.). The method can comprise complying with NSF/ANSI Standard 7 pan temperature requirements in an ambient temperature of 100° F. (37.8° C.). The method need not comprise distributing refrigerant as is typical in the aforementioned "cold-wall" design. The method can comprise properly maintaining air and product temperatures throughout the first refrigerated portion 101. The method can comprise cooling a first refrigerated portion 101 and a second refrigerated portion 102 with only a single refrigeration system 150 comprising only a single evaporator 670. The method can comprise regulating a temperature of the base cavity 218 with one or more cabinet fans 1010 only as needed based on input from a sensor such as the cabinet thermistor 1540.

A method of distributing air can comprise moving refrigerated air from an evaporator cavity 980 to the intake air cavity 910. The method can comprise moving air through the intake air cavity 910 in the longitudinal direction 403 along a length of the rail 120. The method can comprise directing air inside the intake air cavity 910 towards the rear wall 224 of the rail 120 and up between the rear wall 424 of the rail duct 205 and the rear wall 224 of the rail 120. The method can comprise moving air through the openings 480*a* such as, for example and without limitation, one or more of the air transmission openings 482*a*, the handle openings 484*a*, and the supplemental openings 486*a*. The method can comprise moving air, in one or more corners of the rail 120, through the openings 480*b* such as, for example and without limitation, the supplemental openings 486*b*. The method can comprise pressurizing air from the evaporator cavity 980 and thereby distributing air throughout the first refrigerated compartment 103. The method can comprise circulating air through the pan storage cavity 428 and around the plurality of pans 510 positioned therein. In some aspects, as shown, the method can comprise moving air from the rear of the rail 120 to the front of the rail 120 (i.e., front-to-back). In some aspects, by reconfiguring the rail duct 205 and the roof duct 206 the method can comprise moving air from the front of the rail 120 to the rear of the rail 120. The method can comprise moving air through the openings 480*b* and into the communication air cavity 938 in a direction towards the base cavity 218.

The method can comprise moving air from the pan storage cavity 428 to the communication air cavity 938. As such, the method can comprise moving air around an obstacle (e.g., the second divider 940) separating the communication air cavity 938 and the return air cavity 948 for a sufficient distance to discourage or prevent short cycling of air back to the evaporator cavity 980 before reaching the base cavity 218. The method can comprise moving air towards the one or more cabinet fan assemblies 207 in a direction parallel to the obstacle.

When the base cavity 218 does not require further cooling, the method can comprise bypassing the base cavity 218, i.e., returning some or all of the air directly to the evaporator cavity 980 without going through the base cavity 218. When the base cavity 218 does require further cooling, the method can comprise circulating the air through the base cavity 218 and then can comprise returning the air to the evaporator cavity 980.

More specifically, the method can comprise moving air through the cabinet opening 1080 defined in the roof duct 206 and through the cabinet fan 1010 of the cabinet fan assembly 207. The method can comprise controlling the cabinet fan 1010 by a separate thermostat, e.g., the cabinet thermistor 1540, of the secondary controller 274 or by a second temperature sensor extending from the primary controller 272. The method can comprise moving air through the cabinet fan enclosure 1020, which can evenly distribute air into the base cavity 218. The method can comprise moving air through the openings 1028 defined in the cabinet fan enclosure 1020. The method can comprise moving air into the base cavity 218 in a direction away from the main openings 118 and away from the closure devices 130 to reduce the risk of increased air leakage through the main openings 118. The method can comprise moving air from the base cavity 218 to the evaporator cavity 980. The method can comprise moving air from the base cavity 218 to the return side 980*b* of the evaporator cavity 980 through the return air opening 1380, which can be defined in a lower surface of the roof duct 206.

The method can comprise regulating a temperature of air circulating through the rail cavity 228 between the intake air cavity 910 and the return air cavity 948 with the rail thermistor 1320, which again can be mounted inside the return side 980*b* of the evaporator cavity 980. The method can comprise regulating a temperature of air circulating through the base cavity 218 with the cabinet thermistor 1540, which again can be mounted inside the base cavity 218.

The method can comprise receiving the intake air 1413 into an inlet 1412 of cabinet fan 1010 along the axis 1411 of the cabinet fan 1010 and expel exhaust air 1415 in a direction perpendicular to the axis 1411. Thus the method can comprise changing the direction of air flow between the inlet 1412 and the outlet 1414. In some aspects, the method can comprise drawing air from inside the roof duct 206 and directing such air into and through an air distribution duct 1520 that is separate from the cabinet fan enclosure 1020.

Figure 25:
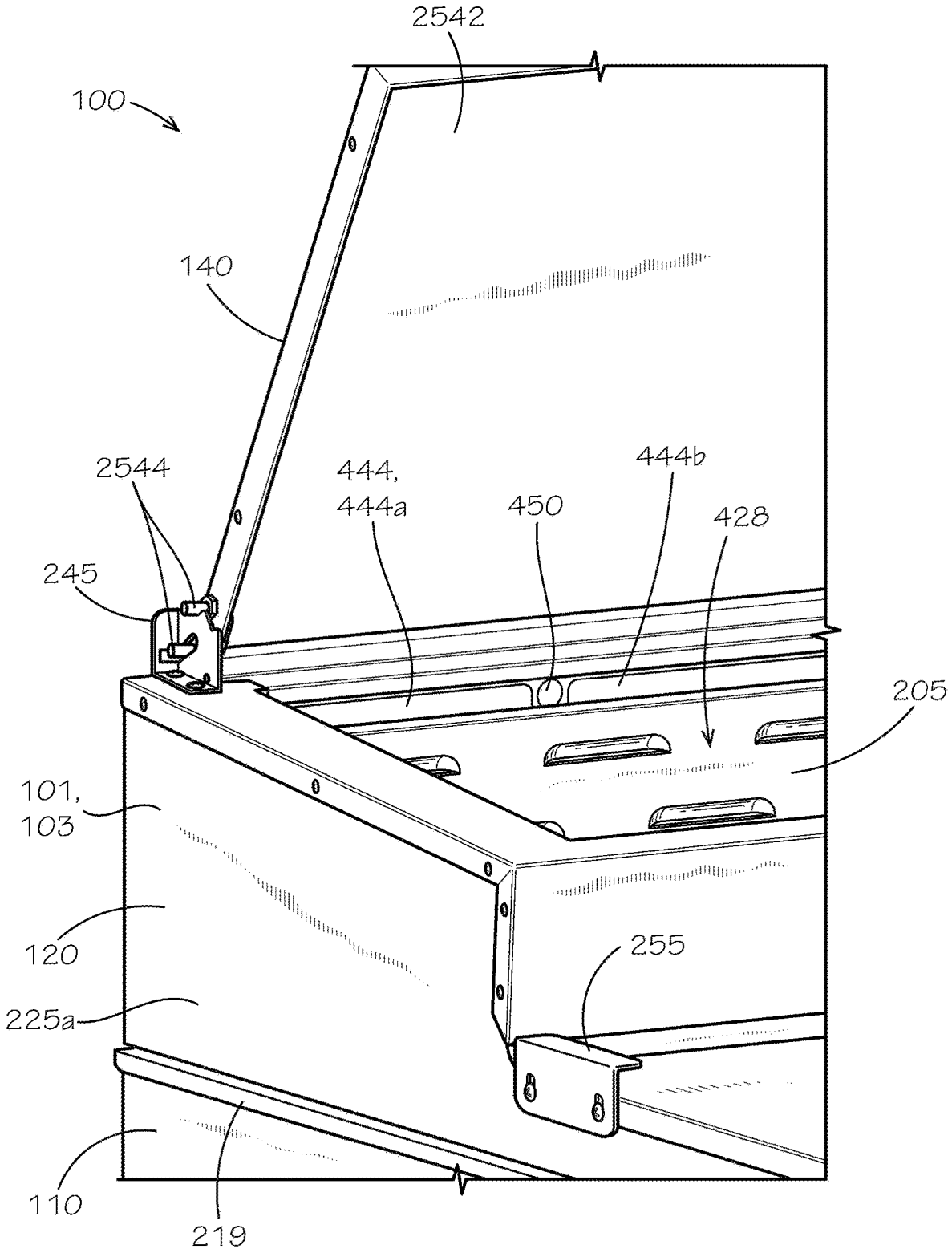
FIG. 25 is a perspective detail view of a left end of the appliance in accordance with another aspect of the current disclosure showing the sensor 450 as a light sensor.

FIG. 25 is a perspective detail view of a left end of the appliance 100 in accordance with another aspect of the current disclosure. In some aspects, as noted above, the sensor 450 can be a light sensor. While the closure device 140 is shown in an open condition, allowing user access to the pan storage cavity 428 and stored product positioned therein, the closure device 140 can be configured to move between the open position and a closed position—and be held in either position indefinitely—depending on user needs. The closure device 140 can comprise fasteners 2544, which can comprise or define pins. The fasteners 2544 can be secured to a panel of the closure device 140 and can be rotatably and/or translatably received within openings defined in the bracket 245 on opposite ends of the closure device 140. Interaction between the fasteners 2544 and the bracket 245 can facilitate movement and storage of the closure device 140. As shown, the closure device 140 can be configured to be held in at least one hold-open position by one or more of the brackets 245, which can couple the closure device 140 to a surface of the first refrigerated portion 101.

The closure device 140 can comprise an interior panel 2542, behind which an insulating material (e.g., an exemplary solid material such as foam or an exemplary gaseous material such as air) can be held in place to further restrict heat transfer through the closure device 140. Presence of the closure device 140, especially when insulated, can significantly reduce heat transfer into the food product from a warmer surrounding ambient temperature when the closure device 140 is in a closed condition and thereby significantly reduce temperatures throughout the food product if no adjustment is made to the appliance 100. Because some fresh ingredients can be rendered unusable by temperatures that are too low—just as spoilage can occur when temperatures are too high, such adjustment can be beneficial to a user.

To activate the sensor 450 when the sensor 450 is a light sensor, the closure device 140 can comprise or define at least one opaque surface through which light is completely blocked, or at least a surface that is sufficiently opaque to block light that would otherwise activate the sensor 450. For example and without limitation, one or more parts of the closure device 140 can be formed from a metal such as stainless steel originally in sheet form.

The sensor 450, which can facilitate adjustment of the unit sufficient to maintain proper temperatures inside the rail 120 even when the conditions of the rail 120 change (e.g., the closure device 140 being open or closed), can be positioned inside the pan storage cavity 428 but proximate to a top end of the rail duct 205. In some aspects, the sensor 450 can be positioned level with or below the top end of the rail duct 205. More specifically, the sensor 450 can be positioned in an opening defined by a break or interruption in a flange 444 defining a portion of the rail duct 205 and, more specifically, the top end of the rail duct 205. The flange 444 can thereby comprise portions 444*a,b*, one of which can extend along the top end of the rail duct 205 on either side of the sensor 450 in an assembled condition of the appliance 100.

Even with the pans 510 (shown in FIG. 5A) positioned in the rail 120, the sensor 450 can sense whether the closure device 140 is in the open position or the closed position. The sensor 450 can be exposed to light that is present in the room when the closure device 140 is in the open position, and the sensor 450 can be blocked from that same light when the closure device 140 is in the closed position. When the sensor 450 is activated (e.g., by the light) or deactivated, the controller 272 can be configured to adjust the rail temperature setpoint automatically to account for the change in conditions inside the rail 120. In some aspects, by default, the controller 272 can be configured to automatically adjust the rail temperature setpoint up by a predetermined offset value of 8° F. In some aspects, the controller 272 can be configured to adjust the rail temperature setpoint as little as 2° F. and as much as 12° F. or any range therebetween, inclusive of the end points. Note that, as disclosed herein, the predetermined offset value is the number of degrees of adjustment on the temperature scale used and is not an absolute temperature on that scale. In some aspects, the controller 272 can be configured to adjust the rail temperature setpoint outside of this range, depending on the conditions. In some aspects, in addition to the automatic adjustment based on input from the sensor 450, a user can make an adjustment to the dial control of the control interface 273 such that instead of the rail temperature increasing by 8° F. the temperature can be effectively increased by a different amount. As shown in FIG. 16C, an increase or decrease of one position in the dial setting 1655 (e.g., from position "5" to position "6") can have the effect of raising or lowering the rail temperature by 2.25° F. (1.25° C.). In some aspects, the controller 272 and the sensor 450 can configured such that the controller 272 cools at the cooler temperatures (i.e., in "day" mode or normal mode) in the case of failure of the sensor 450.

Figure 26:
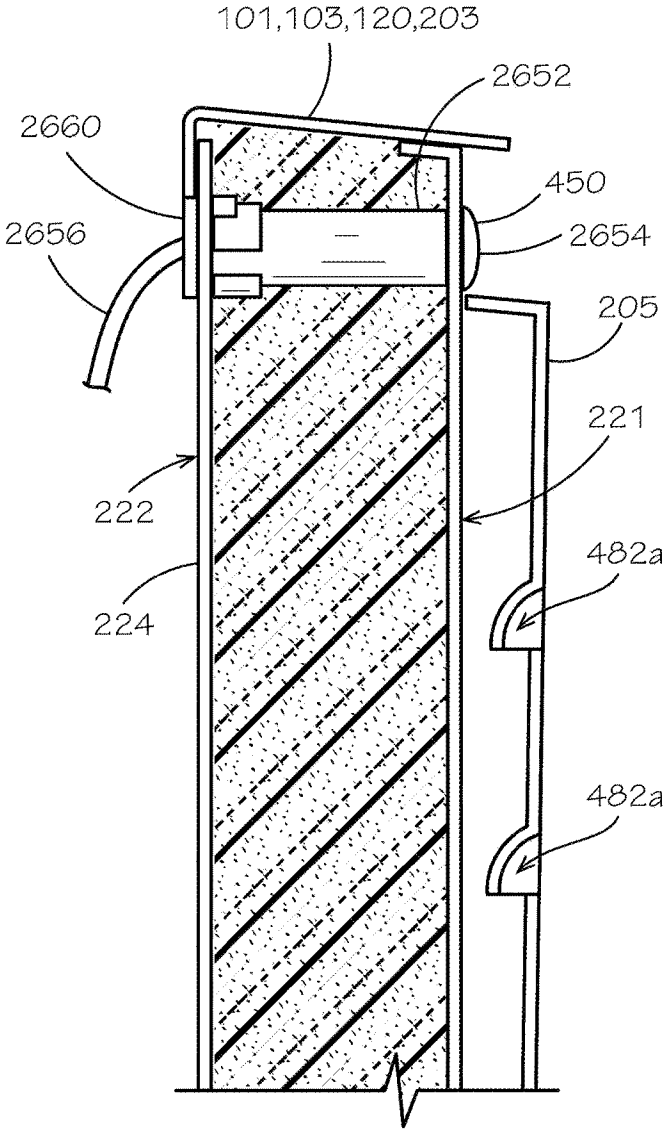
FIG. 26 is a sectional view of a rear wall of the rail taken along line 26-26 of FIG. 9A.

FIG. 26 is a sectional view of the rear wall 224 of the rail 120 taken along line 26-26 of FIG. 9A. The sensor 450 can comprise a body 2652. The sensor 450 can comprise a lens 2654, which can be defined in or coupled to the body 2652 at a first end of the sensor 450. At a second end of the sensor 450 distal from the first end, the body 2652 can be received within a fitting 2660 (e.g., a grommet or strain relief, which can be formed from a material such as, for example and without limitation, plastic or rubber). In some aspects, the sensor 450 can be installed before foaming of the rail 120 and can be replaceable in the field. In some aspects, the sensor 450 can be installed after foaming of the rail 120. The sensor 450 can comprise a lead wire 2656, which can be in electrical communication with the controller 272. More specifically, the lead wire 2656 can be covered with the wire cover 360 (shown in FIG. 4B). Moreover, the exterior surface 222 and other surrounding components of the rail 120 can be sized and otherwise configured to not block exposure of the sensor 450 sufficient to reflect a range of typical lid-up conditions, i.e., conditions when the closure device 140 is in an open condition. In some aspects, the night mode can be triggered by any digital input such as, for example and without limitation, the aforementioned light sensor, a door switch, a proximity sensor, an optical sensor, or a manual ON/OFF switch.

Figure 27:
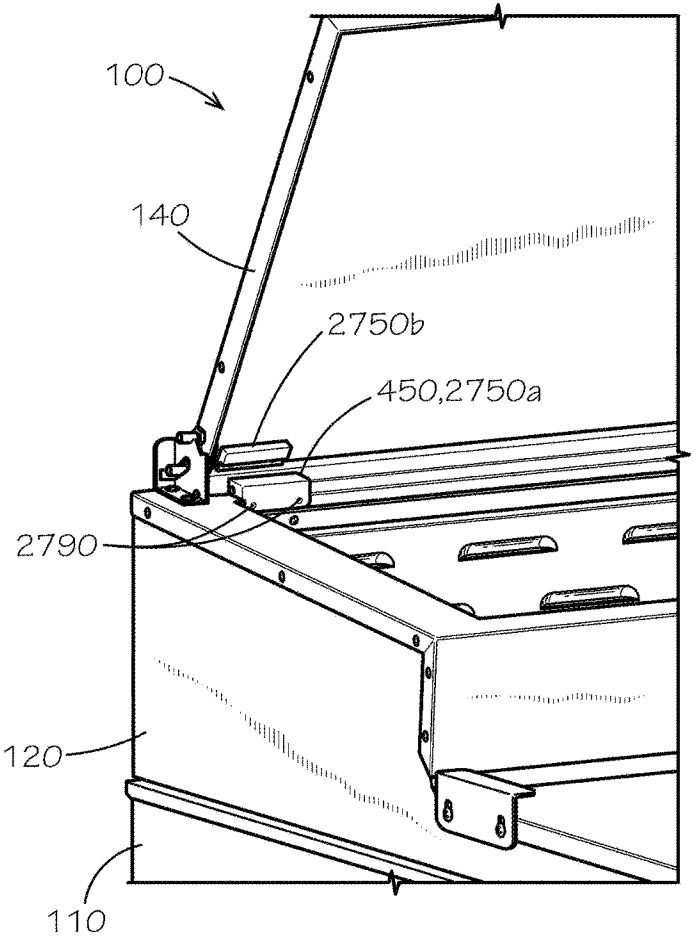
FIG. 27 is a perspective detail view of a left end of the appliance in accordance with another aspect of the current disclosure showing the sensor 450 as a proximity sensor.

FIG. 27 is a perspective detail view of a left end of the appliance 100 in accordance with another aspect of the current disclosure showing the sensor 450 as a proximity sensor. More specifically, the sensor 450 can comprise a magnet (not shown) and can be configured to activate or "trip" or close/open based on proximity between two portions of the sensor 450 or between the sensor 450 and a neighboring structure otherwise sufficient to activate the sensor 450. In some aspects, for example, a first portion 2750*a* of the sensor 450 can be secured or mounted to the rail 120 (e.g., at a top end), and a second portion 2750*b* of the sensor 450 can be secured or mounted to the closure device 140 (e.g., an underside thereof). Upon closure of the closure device 140, the second portion 2750*b*, which can enclose the magnet, will approach and lie in proximity to the first portion 2750*a* and can thereby trip the sensor 450. The wire 2656 (shown in FIG. 26) can carry the sensor signal as an input back to the controller 272. Based on the input from the sensor 450, the controller 272 can adjust the rail temperature setpoint, such as shown in FIG. 16C. In some aspects, the first portion 2750*a* of the sensor 450 can be secured to the appliance 100 with one or more fasteners 2790. As shown, the first portion 2750*a* of the sensor 450 can be secured to the appliance 100 with one or more fasteners 2890 (shown in FIG. 28A).

Figure 28B:
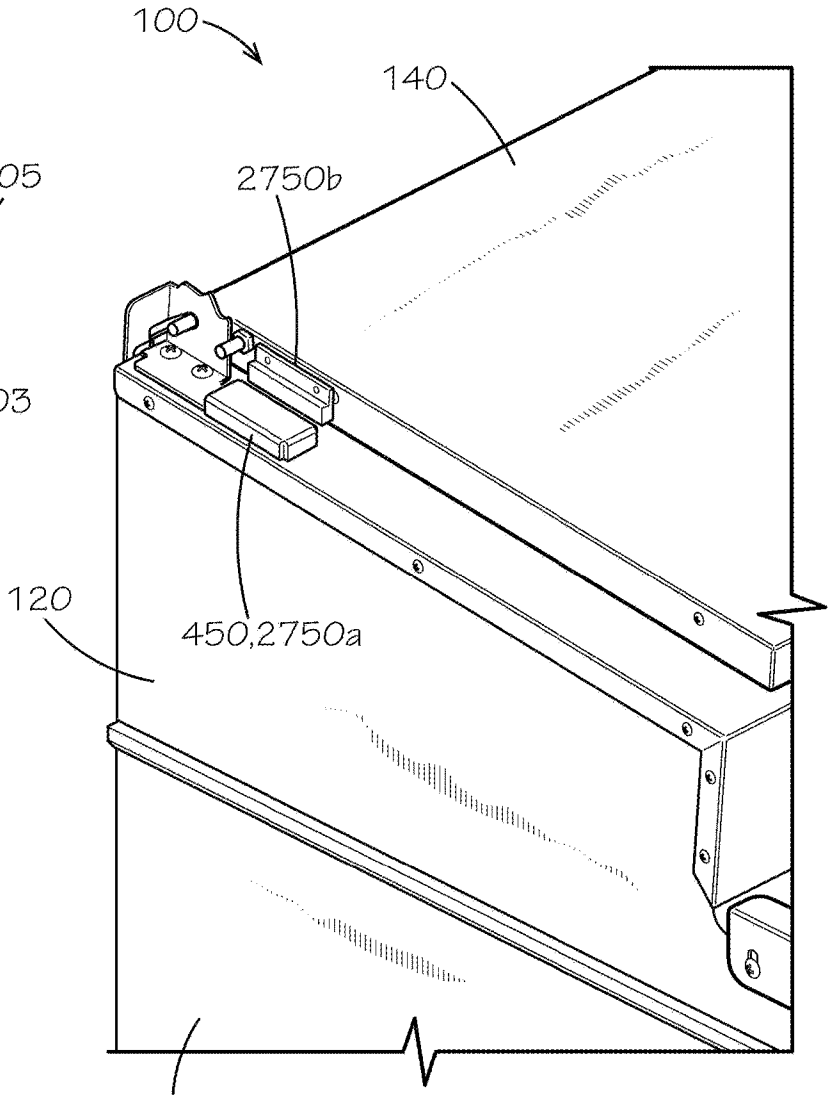
FIG. 28B is a perspective detail view of a left end of the appliance in accordance with another aspect of the current disclosure showing the sensor 450 as a proximity sensor and the closure device in a closed position.
Figure 28A:
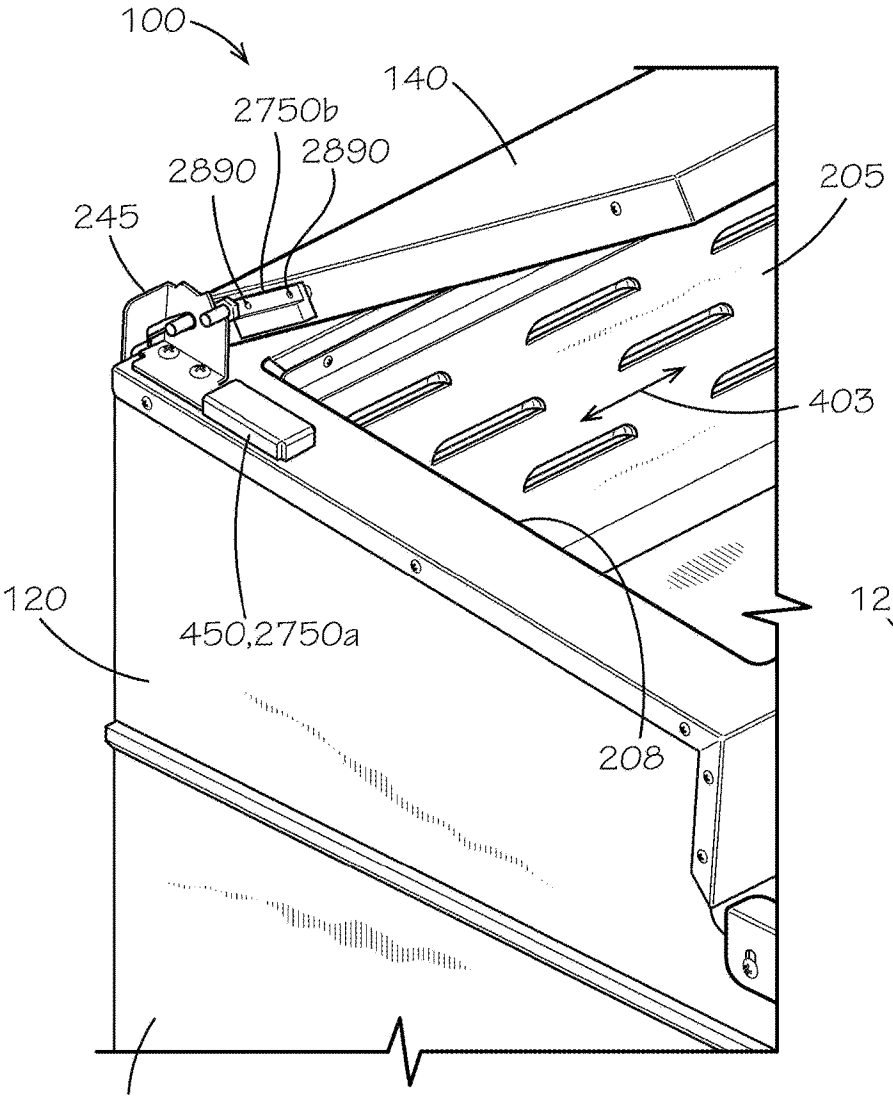
FIG. 28A is a perspective detail view of a left end of the appliance in accordance with another aspect of the current disclosure showing the sensor 450 as a proximity sensor and the closure device in an open position.

FIG. 28A is a perspective detail view of a left end of the appliance 100 in accordance with another aspect of the current disclosure showing the sensor 450 as a proximity sensor and the closure device 140 in an open position. As shown, the first portion 2750*a* and the second portion 2750*b* of the sensor 450 can be separated and the sensor 450 not activated when the closure device 140 is in an open position. In some aspects, each of the first portion 2750*a* and the second portion 2750*b* can be positioned on a side of the rail 120 and the closure device 140, respectively. Moreover, each of the first portion 2750*a* and the second portion 2750*b* can be positioned or can extend past the closure device 140 in the longitudinal direction 403. More specifically, each of the first portion 2750*a* and the second portion 2750*b* can be positioned outside of and offset from an edge of the opening 208 of the rail 120.

FIG. 28B is a perspective detail view of a left end of the appliance 100 in accordance with another aspect of the current disclosure showing the sensor 450 as a proximity sensor and the closure device 140 in the closed position. When the closure device 140 is in a closed position, the first portion 2750*a* and the second portion 2750*b* of the sensor 450 can be in sufficient proximity to activate the sensor 450. In some aspects, the sensor 450, as a proximity sensor, can comprise a reed switch (e.g., Part No. A341 from Manufacturer BNYZWOT). In some aspects, at least a portion of the sensor 450 can be installed behind an exposed surface of the rail 120 for improved cleanability or other benefits when exposure is not required. For example and without limitation, in aspects in which the sensor 450 is a proximity sensor, the first portion 2750*a* of the sensor 450 can be positioned behind or below an exterior surface of the rail 120. More specifically, the first portion 2750*a* can be hidden behind an access panel (not shown), which can be formed as a separate part sufficiently sized to cover the opening, and/or the second portion 2750*b* can be hidden inside the closure panel 140 and, more specifically, behind the interior panel 2542 (shown in FIG. 25).

In some aspects, the rail temperature setpoint can be adjusted manually by pressing a button on the primary controller or controller 272 or a remote display thereof (not shown) such as, for example and without limitation, the aforementioned Model No. RDI 107 available from Danfoss A/S. Such a button can be, for example and without limitation, the "ECO" or "night mode" button on the RDI 107 remote display. In some aspects, the rail temperature setpoint can be adjusted manually by activating a separate ON/OFF switch (not shown). In such aspects, the manual switch can replace the sensor 450 as an input to the controller 272. In some aspects in which the aforementioned button on the primary controller 272 functions as a separate switch the sensor 450 can become unnecessary. In some aspects, the controller 272 can incorporate an absolute clock (synced with real time) or a relative clock (which begins to run upon supply of power to the appliance 100) and can be programmed to initiate setpoint adjustments at predetermined times of the day or after the appliance has run for one or more predetermined durations of time and is expected to require the adjustments.

In some aspects, night mode can be initiated as disclosed herein but without a second sensor, e.g., the cabinet thermistor 1540, facilitating regulation of a temperature of the base cavity 218. In such aspects, air from the rail 120 can be diverted to the base cavity 218 using a passive system such as, for example, an adjustable mechanical baffle. Instead of air flow to the base cavity 218 being turned ON and OFF—as disclosed herein through use of the secondary controller 274 or the equivalent and the cabinet fans 1010—the air flow to the base cavity 218 can be reduced or choked to a level that maintains a desired temperature of the base cavity 218 based on the particular conditions.

In some aspects, a rail ambient temperature sensor (not shown) can be positioned inside the rail 120 and above the pans 510 (shown in FIG. 5A) and placed in electrical communication with the controller 272. The rail ambient temperature sensor can be place in any location on the rail 120 that would be influenced by opening and closing of the closure device 140 and other changes having an influence on a temperature of the air directly above the pans 510. In some aspects, the rail ambient temperature sensor can be positioned in a similar position in the rail 120 as the sensor 450. In other aspects, the rail ambient temperature sensor can be positioned elsewhere, can be protected against spillage of food product and/or direct air flow, and need not be visible. The rail ambient temperature sensor can be configured to sense a temperature in an area immediately surrounding the pans 510 and if the sensed temperature changes (for example, it decreases due to the closure device 140 being moved to a closed position or either increases or decreases due to a temperature in an ambient environment around the appliance 100 going up or down), the rail setpoint temperature can be automatically adjusted by the controller 272 to maintain temperatures of product inside the pans 510 in a similar way that the rail setpoint temperature can be automatically adjusted by the controller 272 in response to input from the sensor 450.

Figure 29:
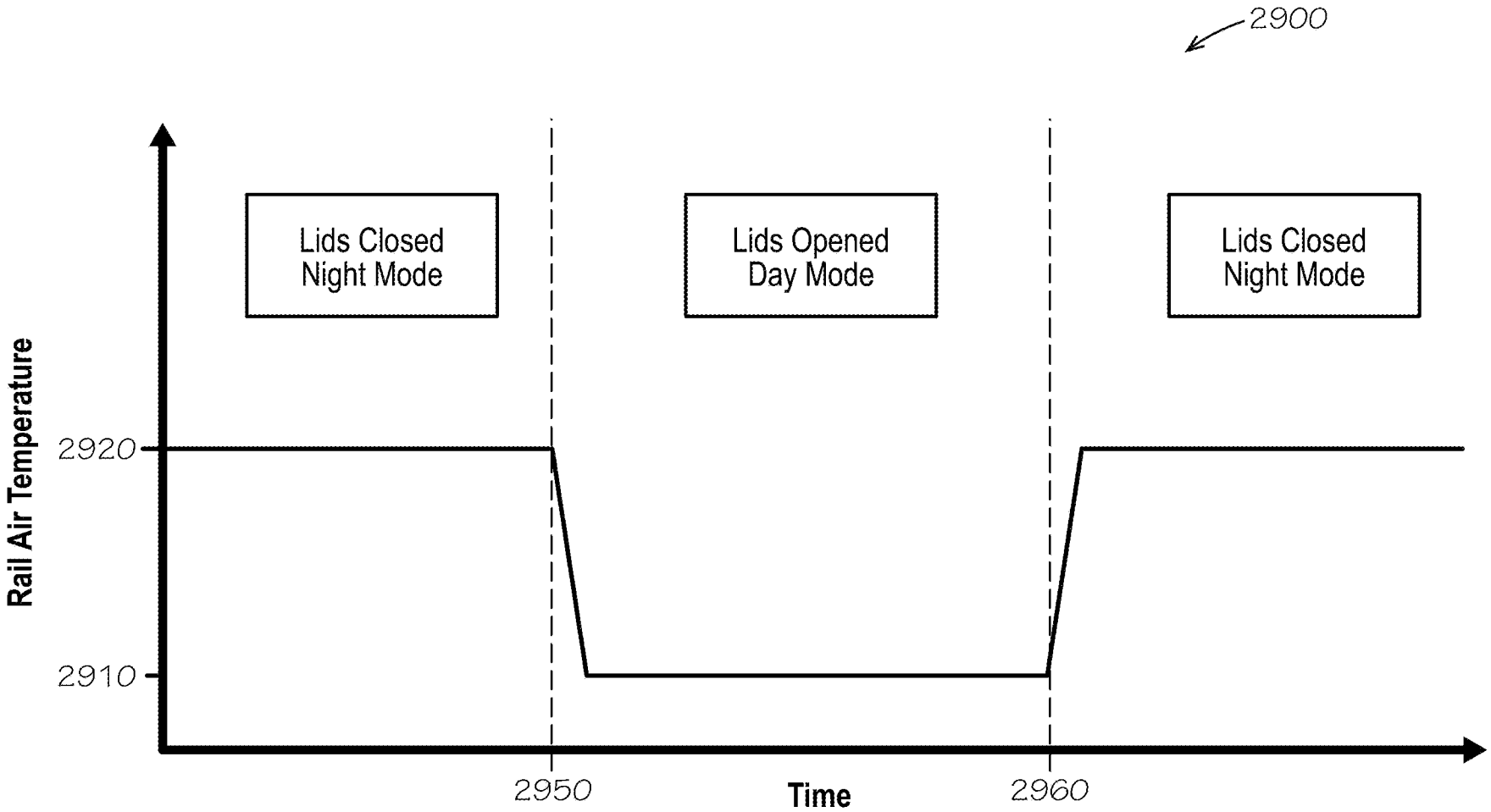
FIG. 29 is a graph showing rail air temperature vs. time.

FIG. 29 is a graph 2900 showing rail air temperature vs. time. Between times 2950 and 2960, the appliance 100 can be in night mode, as reflected in the lower rail temperature 2910. As shown, a transition between the lower rail temperature 2910 and a higher rail temperature 2920 can take at least some time and need not be instantaneous, even if the change in the setpoint temperature become effective immediately or at least upon activation of the sensor. Before time 2950 and after time 2960, the appliance 100 can be placed in night mode by activation of the sensor 450.

Figure 30:
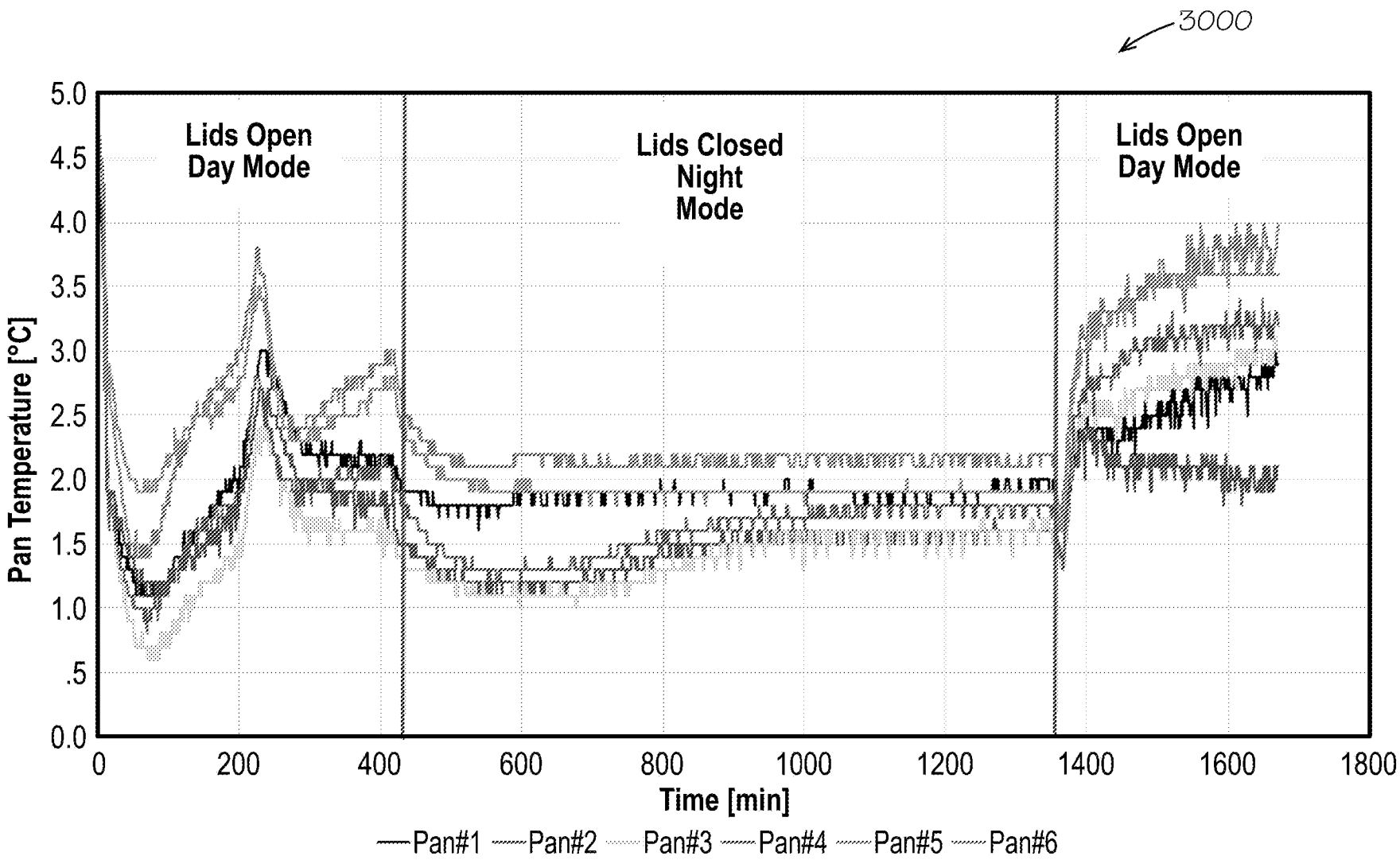
FIG. 30 is a graph showing pan temperature vs. time in accordance with another aspect of the current disclosure.

FIG. 30 is a graph 3000 showing pan temperature vs. time in accordance with another aspect of the current disclosure. As shown, temperatures of material inside multiple pans 510 inside the rail 120 can remain substantially constant—and also within an exemplary range of 0 to 5.0° C.—whether the closure device 140 (i.e., the rail lid) is open or closed, and thus whether the unit is in day mode or night mode, respectively. In the testing captured in the graph 3000, the pans 510 (shown in FIG. 5A) were filled and tested with water.

A method of using the appliance 100 can comprise activating the sensor 450 by either lowering or raising the closure device 140. The method can comprise either blocking light to or exposing light to the sensor 450. The method can comprise sending a signal to the controller 272, e.g., from the sensor 450, notifying the controller 272 as to which position the closure device is in. The method can comprise the sensor 450 recognizing that the closure device 140 is up or open, signaling a time in which the appliance 100 and, more specifically, the rail 120 is being actively used to prepare food items and can further comprise sending a signal to the controller 272 to trigger the controller 272 to operate at the predetermined lower setpoint. The method can comprise the sensor recognizing that the closure device 140 is down or closed, signaling a time in which the rail 120 is not being actively used and can further comprise sending a signal to the controller 272 to effect the predetermined and programmed differential or offset in the rail setpoint temperature.

In some aspects, a method of using the appliance 100 can comprise regulating a temperature of the first insulated enclosure 103 of the first refrigerated portion 101 of the appliance 100 within a first predetermined temperature range. More specifically, the appliance 100 can comprise the first refrigerated portion 101, and the second refrigerated portion 102 can be positioned below the first refrigerated portion 101. The method can comprise moving the closure device 140 of the first refrigerated portion 101 from an open position to a closed position. More specifically, the closure device 140 can be configured to selectively cover and limit leakage of air from an ambient environment to and from a second insulated enclosure 104 of the second refrigerated portion 102. The method can comprise adjusting a predetermined temperature range of the first insulated enclosure 103 by a predetermined offset value based on the sensor 450 signaling that the closure device 140 is in the closed position.

The method can comprise regulating a temperature of refrigerated air inside the first insulated enclosure 103 with the primary controller 272. The method can comprise regulating a temperature of refrigerated air inside the second insulated enclosure 104 with the secondary controller 274. The method can comprise cooling each of the first refrigerated portion 101 and the second refrigeration portion 102 with only air supplied by an air plenum system of the appliance 100. In some aspects, adjusting the predetermined temperature range of the first insulated enclosure 103 by the predetermined offset value can comprise adjusting the predetermined temperature range without any input from a user of the appliance 100. The method can further comprise maintaining a temperature of a material in each of a plurality of pans in a range of 0.6° C. to 5.0° C., inclusive, when the appliance is set up and tested in compliance with NSF/ANSI 7-2021 requirements with the closure device in either the open position or the closed position.

In some aspects, various components of the appliance 100 can be formed from or comprise a metal such as, for example and without limitation, steel. More specifically, components exposed to food and/or liquids including cleaning fluids including the user-facing surfaces of the appliance can be formed from or comprise stainless steel. Materials configured to insulate against heat transfer (e.g., the thermal break 219) and/or flex (e.g., door/drawer gaskets and an interior panel of the doors) can be formed from or comprise a polymer material such as polyvinyl chloride (PVC) or acrylonitrile butadiene styrene (ABS). In some aspects, the various components can be formed from any other material, any of which can optionally be corrosion-resistant or replaceable for serviceability.

The various components of the appliance 100 can be formed from any one or more of a variety of manufacturing processes. For example and without limitation, the rail duct 205, the roof duct 206, and various other components of the air plenum system of the appliance 100 can be fabricated using subtractive manufacturing processes such as cutting and stamping. In some aspects, components can be made using machining and/or forging; additive manufacturing processes such as three dimensional printing; and any other forming and assembly processes such as bending and riveting.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A refrigerated appliance comprising:

a refrigeration system; and a cabinet enclosing the refrigeration system at least partly and comprising:

a first refrigerated portion defining a first insulated enclosure defining a pan storage cavity configured to receive at least one food pan, the first refrigerated portion comprising a closure device configured to selectively cover and limit leakage of air from an ambient environment to and from the first insulated enclosure;

a second refrigerated portion positioned below the first refrigerated portion and defining a base cavity configured to receive stored product;

a first sensor configured to measure a temperature of air within the first insulated enclosure;

a second sensor configured to signal whether the closure device of the first refrigerated portion is in an open position or a closed position; and at least one controller configured to control, at least in part, the temperature of the air within the first insulated enclosure and measured by the first sensor within a predetermined temperature range, the at least one controller configured to adjust the predetermined temperature range by a predetermined offset value based on an input from the second sensor.

2. The appliance of claim 1, wherein the predetermined offset value is between 2 and 12° F., inclusive.

3. The appliance of claim 1, wherein an opening of the first refrigerated portion and an opening of the second refrigerated portion face in different directions, the opening of the first refrigerated portion facing generally upward and the opening of the second refrigerated portion facing generally forward, the appliance further comprising a worktop portion, the worktop portion positioned in front of the first refrigerated portion and above the second refrigerated portion, the first insulated enclosure extending in a vertical direction above the worktop portion.

4. The appliance of claim 1, wherein the closure device of the first refrigerated portion is configured to be held in at least one hold-open position by at least one bracket coupling the closure device of the first refrigerated portion to a surface of the first refrigerated portion.

5. The appliance of claim 1, wherein the second sensor is a light sensor.

6. The appliance of claim 5, wherein the second sensor is mounted through one of a rear wall, a front wall, and a side wall of the first insulated enclosure.

7. The appliance of claim 6, wherein the second sensor is mounted in a substantially vertical surface of the first insulated enclosure in a position recessed below an exterior surface of the first insulated enclosure defined at a top end of the first insulated enclosure.

8. The appliance of claim 5, wherein the closure device defines an opaque surface blocking light to the second sensor when the closure device is in the closed position.

9. The appliance of claim 1, wherein the second sensor is a proximity sensor.

10. The appliance of claim 9, wherein the proximity sensor is mounted to one of a surface of the first refrigerated portion and the closure device of the first refrigerated portion.

11. The appliance of claim 10, wherein the proximity sensor comprises a first portion and a second portion, the first portion mounted to the one of the surface of the first refrigerated portion and the closure device of the first refrigerated portion, the second portion mounted to the other of the one of the surface of the first refrigerated portion and the closure device of the first refrigerated portion, the second portion.

12. The appliance of claim 1, wherein the second sensor is a switch configured to be activated manually by a user.

13. The appliance of claim 1, wherein:

the refrigeration system comprises an evaporating unit configured to supply air to an air plenum system of the appliance, the air plenum system configured to cool the appliance;

the first insulated enclosure of the first refrigerated portion defines an interior surface, the first refrigerated portion further comprising:

a duct received within the first insulated enclosure and defining an inward-facing surface and an outward-facing surface, the inward-facing surface defining a pan storage cavity, the pan storage cavity configured to receive at least one food pan, the duct defining openings in each of a rear wall and a front wall thereof, the first refrigerated portion defining an intake air cavity between the interior surface of the first insulated enclosure and the outward-facing surface of the duct, the intake air cavity being in fluid communication with an evaporator cavity in which the evaporating unit is positioned and the pan storage cavity; and the second refrigerated portion further comprises;

a duct received within a second insulated enclosure of the second refrigerated portion, the duct of the second refrigerated portion defining, at least in part, a communication air cavity, the communication air cavity being in fluid communication with each of the pan storage cavity and a return air cavity, the return air cavity being in fluid communication with the evaporator cavity; and a closure device configured to selectively cover and limit leakage of air from an ambient environment to and from the second insulated enclosure.

14. A method of using a refrigerated appliance, the method comprising:

regulating a temperature of a first insulated enclosure of a first refrigerated portion of the appliance within a first predetermined temperature range, the appliance comprising the refrigerated portion and a second refrigerated portion positioned below the first refrigerated portion;

moving a closure device of the first refrigerated portion from an open position to a closed position, the closure device configured to selectively cover and limit leakage of air from an ambient environment to and from the first insulated enclosure of the first refrigerated portion; and adjusting a predetermined temperature range of the first insulated enclosure by the predetermined offset value based on a sensor signaling that the closure device is in the closed position.

15. The method of claim 14, further comprising:

regulating a temperature of refrigerated air inside the first insulated enclosure with a primary controller; and regulating a temperature of refrigerated air inside the second insulated enclosure with a secondary controller.

16. The method of claim 14, further comprising cooling each of the first refrigerated portion and the second refrigeration portion with only air supplied by an air plenum system of the appliance.

17. The method of claim 14, wherein adjusting the predetermined temperature range of the first insulated enclosure by the predetermined offset value comprises adjusting the predetermined temperature range without any input from a user of the appliance.

18. The method of claim 14, the sensor is a light sensor.

19. The method of claim 14, wherein the predetermined offset value is between 2 and 12° F., inclusive.

20. The method of claim 14, further comprising:

maintaining a temperature of a material in each of a plurality of pans in a range of 0.6° C. to 5.0° C., inclusive, when the appliance is set up and tested in compliance with NSF/ANSI 7-2021 requirements with the closure device in the open position; and maintaining the temperature of the material in each of the plurality of pans in the range of 0.6° C. to 5.0° C., inclusive, when the appliance is set up and tested in compliance with NSF/ANSI 7-2021 requirements with the closure device in the closed position.

21. A cabinet for a refrigerated appliance comprising:

a first refrigerated portion defining a first insulated enclosure, the first refrigerated portion comprising a closure device configured to selectively cover and limit leakage of air from an ambient environment to and from the first insulated enclosure;

a first sensor configured to measure a temperature of air within the first insulated enclosure;

a second sensor configured to signal whether the closure device of the first refrigerated portion is in a first position or a second position; and at least one controller configured to control, at least in part, the temperature of the air within the first insulated enclosure and measured by the first sensor within a predetermined temperature range, the at least one controller configured to adjust the predetermined temperature range based on an input from the second sensor.

22. An appliance comprising:

the cabinet of claim 21; and a refrigeration system coupled to the cabinet.

23. The appliance of claim 22, wherein the cabinet further comprises a second refrigerated portion:

positioned adjacent to the first refrigerated portion; and configured to receive stored product.

24. The appliance of claim 23, wherein:

the refrigeration system comprises an evaporating unit configured to supply air to an air plenum system of the appliance, the air plenum system configured to cool the appliance;

the first insulated enclosure of the first refrigerated portion defines an interior surface, the first refrigerated portion further comprising:

a duct received within the first insulated enclosure and defining an inward-facing surface and an outward-facing surface, the inward-facing surface defining a pan storage cavity, the pan storage cavity configured to receive at least one food pan, the duct defining openings in each of a rear wall and a front wall thereof, the first refrigerated portion defining an intake air cavity between the interior surface of the first insulated enclosure and the outward-facing surface of the duct, the intake air cavity being in fluid communication with an evaporator cavity in which the evaporating unit is positioned and the pan storage cavity; and the second refrigerated portion further comprises;

a duct received within a second insulated enclosure of the second refrigerated portion, the duct of the second refrigerated portion defining, at least in part, a communication air cavity, the communication air cavity being in fluid communication with each of the pan storage cavity and a return air cavity, the return air cavity being in fluid communication with the evaporator cavity; and a closure device configured to selectively cover and limit leakage of air from an ambient environment to and from the second insulated enclosure.

25. The cabinet of claim 21, wherein an opening of the first refrigerated portion and an opening of the second refrigerated portion face in different directions, the opening of the first refrigerated portion facing generally upward and the opening of the second refrigerated portion facing generally forward, the appliance further comprising a worktop portion, the worktop portion positioned in front of the first refrigerated portion and above the second refrigerated portion, the first insulated enclosure extending in a vertical direction above the worktop portion.

26. The cabinet of claim 21, wherein the second sensor is one of a light sensor, a proximity sensor.

27. A method of using a refrigerated appliance, the method comprising:

regulating a temperature of an insulated enclosure of a refrigerated portion of the appliance within a predetermined temperature range;

moving a closure device of the refrigerated portion from a first position to a second position, the closure device configured to selectively cover and limit leakage of air from an ambient environment to and from the insulated enclosure of the refrigerated portion; and adjusting the predetermined temperature range of the first insulated enclosure based on a sensor signaling that the closure device is in the second position.

28. The method of claim 27, wherein the refrigerated portion is a first refrigerated portion and the insulated enclosure is a first insulated enclosure, the cabinet further comprising a second refrigerated portion positioned adjacent to the first refrigerated portion and configured to receive stored product, the method further comprising:

regulating a temperature of refrigerated air inside the first insulated enclosure with a primary controller; and regulating a temperature of refrigerated air inside the second insulated enclosure with a secondary controller.

29. The method of claim 27, further comprising:

maintaining a temperature of a material in each of a plurality of pans in a range of 0.6° C. to 5.0° C., inclusive, when the appliance is set up and tested in compliance with NSF/ANSI 7-2021 requirements with the closure device in the first position; and maintaining the temperature of the material in each of the plurality of pans in the range of 0.6° C. to 5.0° C., inclusive, when the appliance is set up and tested in compliance with NSF/ANSI 7-2021 requirements with the closure device in the second position.

* * * * *